US008833594B2

(12) United States Patent
Stahl

(10) Patent No.: US 8,833,594 B2
(45) Date of Patent: Sep. 16, 2014

(54) TWO POSITION NESTABLE TRAY WITH DRAIN CHANNELS AND SCALLOPED HANDLES

(75) Inventor: Edward L. Stahl, Tyler, TX (US)

(73) Assignee: Orbis Canada Limited, Toronto (CA)

( * ) Notice: Subject to any disclaimer, the term of this patent is extended or adjusted under 35 U.S.C. 154(b) by 1032 days.

(21) Appl. No.: 11/828,960

(22) Filed: Jul. 26, 2007

(65) Prior Publication Data

US 2008/0023426 A1 Jan. 31, 2008

Related U.S. Application Data

(63) Continuation-in-part of application No. 29/248,075, filed on Jul. 27, 2006, now abandoned, and a continuation of application No. PCT/US2007/002457, filed on Jan. 29, 2007.

(51) Int. Cl.

| | |
|---|---|
| ***B65D 1/34*** | (2006.01) |
| ***A47F 3/14*** | (2006.01) |
| *B65D 1/40* | (2006.01) |

(52) U.S. Cl.

CPC ..... *A47F 3/14* (2013.01)
USPC ..... 220/571; 206/557; 220/601; 220/608

(58) Field of Classification Search

USPC ..... 220/571, 601, 755, 771, 533, 608; 206/557, 511

See application file for complete search history.

(56) References Cited

U.S. PATENT DOCUMENTS

| | | | |
|---|---|---|---|
| 2,026,204 | A | 12/1935 | Andrews |
| 2,029,746 | A | 2/1936 | Tufts et al. |
| 2,061,414 | A | 11/1936 | Tufts et al. |
| 2,134,875 | A | 11/1938 | Henze |
| 2,457,841 | A | 1/1949 | Smith et al. |
| 2,457,842 | A | 1/1949 | Smith et al. |

(Continued)

FOREIGN PATENT DOCUMENTS

| | | |
|---|---|---|
| CA | 892971 | 2/1972 |
| CA | 1273881 | 9/1990 |

(Continued)

OTHER PUBLICATIONS

Canadian Official Action for Canadian Patent Application No. 2,431,444 dated Dec. 12, 2005 (2 pages).

(Continued)

*Primary Examiner* — Mickey Yu
*Assistant Examiner* — Niki Eloshway
(74) *Attorney, Agent, or Firm* — Ungaretti & Harris LLP

(57) ABSTRACT

A tray for transporting and displaying baked products is disclosed. The tray can be stacked in a 0° and 180° stacking configuration. The trays further include substantially non-glossy, non-smooth surfaces that allow stickers to be more easily removed, as well as drain channels in the base to facilitate removal of water following washing. The trays further include a scalloped handle on one side of the tray only to allow operators to more easily recognize which side of the tray they are facing. A tray retrieval tool can be used with several hook areas to facilitate retrieval of the trays following washing in high temperature water, or following stacking and storage. The trays further include spacers and spacer holes to place the spacers so that different types of baked products can be accommodated without damaging or destroying the baked product.

25 Claims, 44 Drawing Sheets

(56) References Cited

U.S. PATENT DOCUMENTS 2,609,120 A 9/1952 Williams
2,641,383 A 6/1953 Coursey
2,918,379 A 12/1959 Lurie
3,154,215 A 10/1964 Le Vesconte
3,286,877 A * 11/1966 Haimes ..... 220/676
3,375,953 A 4/1968 Miller, Jr.
3,379,339 A 4/1968 Asenbauer
3,387,740 A 6/1968 Bockenstette
3,392,875 A 7/1968 Bockenstette
3,420,402 A 1/1969 Frater et al.
3,421,656 A 1/1969 Asenbauer
3,570,697 A 3/1971 Langston
3,659,743 A 5/1972 Box
3,672,530 A * 6/1972 Bridenstine et al. ..... 220/4.03
3,752,352 A 8/1973 Senecal
3,780,905 A 12/1973 Herolzer
D236,168 S 7/1975 Johnson
3,907,111 A 9/1975 Levenhagen
3,934,724 A 1/1976 Johnson
3,951,265 A 4/1976 Carroll
3,952,903 A 4/1976 Sanders et al.
3,993,211 A 11/1976 Astle
4,000,817 A 1/1977 Sanders et al.
4,093,070 A 6/1978 Stahl
4,093,071 A 6/1978 Stahl et al.
4,102,453 A 7/1978 Carroll et al.
4,105,117 A 8/1978 Atkin et al.
4,106,623 A 8/1978 Carroll et al.
4,106,624 A 8/1978 Thurman
4,106,625 A 8/1978 Carroll et al.
4,109,791 A 8/1978 Clipson et al.
4,189,052 A 2/1980 Carroll et al.
4,194,626 A 3/1980 Boller
4,211,327 A 7/1980 Stahl et al.
D258,050 S 1/1981 Cornou
4,247,004 A 1/1981 Bird
4,316,154 A 2/1982 Krause
4,320,837 A 3/1982 Carroll et al.
4,391,369 A 7/1983 Stahl et al.
4,423,813 A 1/1984 Kreeger et al.
4,426,001 A 1/1984 Stahl et al.
4,440,302 A 4/1984 Ehrman et al.
4,466,541 A 8/1984 Tabler et al.
4,520,928 A 6/1985 Wilson
4,523,681 A 6/1985 Kreeger
4,573,577 A 3/1986 Miller
4,577,759 A 3/1986 Kreeger
4,600,103 A 7/1986 Tabler
4,601,393 A 7/1986 Veenman et al.
RE32,223 E 8/1986 Kreeger et al.
4,619,366 A 10/1986 Kreeger
4,619,371 A 10/1986 Rehrig
4,643,310 A 2/1987 Deaton et al.
4,671,411 A 6/1987 Rehrig et al.
D292,634 S 11/1987 Chabot
4,759,451 A 7/1988 Apps
4,848,578 A 7/1989 Schafer
4,863,062 A 9/1989 Holliday
4,905,833 A 3/1990 Kreeger et al.
4,936,458 A * 6/1990 Tabler et al. ..... 206/507
4,947,992 A 8/1990 Schafer
4,960,207 A 10/1990 Tabler et al.
4,982,844 A 1/1991 Madan et al.
5,035,326 A 7/1991 Stahl
D319,908 S 9/1991 Stahl
D320,298 S 9/1991 Apps et al.
5,163,587 A 11/1992 Apps et al.
D343,042 S 1/1994 Apps et al.
D344,387 S 2/1994 Holliday
5,287,966 A 2/1994 Stahl
D348,138 S 6/1994 Lang-Ree et al.
D348,342 S 6/1994 Lang-Ree et al.
D348,343 S 6/1994 Lang-Ree et al.
D350,028 S 8/1994 Apps
5,339,676 A * 8/1994 Johnson ..... 73/40
D350,437 S 9/1994 Apps et al.
5,344,021 A 9/1994 Rose
5,344,022 A 9/1994 Stahl
5,372,257 A 12/1994 Beauchamp et al.
D354,167 S 1/1995 Stahl
5,377,858 A 1/1995 Morris, Sr.
5,392,915 A 2/1995 Kalin
5,415,293 A 5/1995 Ackermann et al.
5,452,739 A * 9/1995 Mustee et al. ..... 137/312
5,456,379 A * 10/1995 Krupa et al. ..... 220/835
5,469,986 A 11/1995 Jang
5,494,163 A 2/1996 Apps
5,527,052 A * 6/1996 Litin ..... 280/47.26
D374,555 S 10/1996 McMath
5,582,296 A 12/1996 Beauchamp et al.
5,584,412 A * 12/1996 Wang ..... 220/500
5,594,207 A * 1/1997 Fabian et al. ..... 174/58
5,609,254 A 3/1997 Loftus et al.
5,617,953 A 4/1997 Cope
D379,718 S 6/1997 Raghunathan
D381,203 S 7/1997 Ackermann et al.
D382,404 S 8/1997 Cope
D384,975 S 10/1997 Jackson
5,735,431 A 4/1998 LeTrudet
5,752,602 A 5/1998 Ackermann et al.
5,772,033 A 6/1998 Loftus et al.
D398,448 S 9/1998 Zanni
D400,711 S 11/1998 Hwang
D401,066 S 11/1998 Ackermann
D401,412 S 11/1998 LeTrudet
5,860,527 A 1/1999 Frankenberg et al.
5,881,902 A * 3/1999 Ackermann ..... 206/509
5,896,987 A 4/1999 Bettenhausen
5,896,992 A * 4/1999 McGrath ..... 206/507
5,924,572 A 7/1999 Cope
5,975,324 A 11/1999 Schmitt
5,992,673 A 11/1999 Hwang
6,015,056 A 1/2000 Overholt et al.
D420,219 S 2/2000 Elvin-Jensen et al.
6,036,049 A * 3/2000 Hwang ..... 220/826
D423,217 S 4/2000 Varfeldt
D424,299 S 5/2000 Varfeldt
6,059,114 A 5/2000 Loftus
6,089,373 A 7/2000 Cope
D429,565 S 8/2000 Aiken
6,098,827 A 8/2000 Overholt et al.
6,138,863 A 10/2000 Aiken
D436,729 S 1/2001 Aiken
D439,049 S 3/2001 Koefelda
6,209,742 B1 4/2001 Overholt et al.
6,250,490 B1 6/2001 Loftus
6,260,706 B1 7/2001 Koefelda
D446,017 S 8/2001 Koefelda
D446,392 S 8/2001 Overholt et al.
D446,939 S 8/2001 Koefelda
6,273,259 B1 8/2001 Stahl
6,293,418 B1 9/2001 Ogden et al.
6,308,858 B1 10/2001 Koefelda
D452,614 S 1/2002 Overholt
6,338,181 B1 1/2002 Hwang
6,386,388 B1 5/2002 Overholt
6,394,274 B1 5/2002 Cheeseman
D458,753 S 6/2002 Overholt et al.
6,398,054 B1 6/2002 Overholt et al.
6,405,888 B1 6/2002 Overholt et al.
6,409,041 B1 6/2002 Overholt et al.
D460,619 S 7/2002 Koefelda
D463,667 S 10/2002 Hwang
6,460,717 B1 10/2002 Smyers et al.
D478,421 S 8/2003 Overholt et al.
6,601,724 B1 8/2003 Koefelda et al.
6,607,199 B2 8/2003 Gruber
6,631,822 B1 10/2003 Overholt
D487,634 S 3/2004 Apps et al.
6,719,164 B2 * 4/2004 Maschio ..... 220/571
6,843,386 B2 1/2005 Raghunathan et al.
6,857,642 B2 2/2005 Gruber
6,863,180 B2 3/2005 Apps et al.
6,880,705 B2 4/2005 Otting et al.

(56) References Cited

U.S. PATENT DOCUMENTS

| | | | | |
|---|---|---|---|---|
| 6,886,710 | B2 | 5/2005 | Verna et al. | |
| 6,899,242 | B2 | 5/2005 | Overholt et al. | |
| 6,918,502 | B1 | 7/2005 | Overholt et al. | |
| 6,918,508 | B2 | 7/2005 | Hwang | |
| 6,938,772 | B2 | 9/2005 | Aiken et al. | |
| 6,994,216 | B2 | 2/2006 | Wong | |
| 7,014,043 | B2 | 3/2006 | Raghunathan et al. | |
| 7,017,745 | B2 | 3/2006 | Raghunathan | |
| 7,017,766 | B2 | 3/2006 | Hsu et al. | |
| 7,044,319 | B2 | 5/2006 | Overholt et al. | |
| 7,048,134 | B1 | 5/2006 | Hagan | |
| 7,048,135 | B2 | 5/2006 | Smyers et al. | |
| 7,059,489 | B2 | 6/2006 | Apps et al. | |
| 7,063,210 | B2 | 6/2006 | Smyers et al. | |
| 7,086,555 | B2 | 8/2006 | Overholt et al. | |
| 7,100,786 | B2 | 9/2006 | Smyers | |
| 7,104,414 | B2 | 9/2006 | Apps et al. | |
| 7,104,553 | B2 | 9/2006 | Gruber | |
| 7,128,231 | B2 | 10/2006 | Overholt | |
| 7,195,127 | B2 | 3/2007 | Hsu et al. | |
| 7,234,599 | B2 | 6/2007 | Hassell et al. | |
| 7,249,675 | B2 | 7/2007 | Hassell et al. | |
| 7,264,122 | B2 | 9/2007 | Koefelda et al. | |
| 2002/0056717 | A1 | 5/2002 | Hwang | |
| 2002/0130132 | A1 | 9/2002 | Overholt | |
| 2002/0148842 | A1 | 10/2002 | Overholt et al. | |
| 2002/0153682 | A1 | 10/2002 | Gruber | |
| 2002/0158067 | A1 | 10/2002 | Overholt et al. | |
| 2002/0179480 | A1 | 12/2002 | Raghunathan et al. | |
| 2003/0024845 | A1 | 2/2003 | Smyers et al. | |
| 2003/0042255 | A1 | 3/2003 | Smyers et al. | |
| 2003/0116564 | A1 | 6/2003 | Overholt et al. | |
| 2003/0132228 | A1 | 7/2003 | Apps et al. | |
| 2003/0155275 | A1 | 8/2003 | Apps et al. | |
| 2003/0222081 | A1 | 12/2003 | Apps et al. | |
| 2003/0230510 | A1 | 12/2003 | Aiken et al. | |
| 2004/0020821 | A1 | 2/2004 | Koefelda et al. | |
| 2004/0050742 | A1* | 3/2004 | Gruber | 206/509 |
| 2004/0060844 | A1 | 4/2004 | Stahl | |
| 2004/0069780 | A1 | 4/2004 | Apps et al. | |
| 2004/0099563 | A1* | 5/2004 | Otting et al. | 206/503 |
| 2004/0099662 | A1 | 5/2004 | Overholt | |
| 2004/0104231 | A1 | 6/2004 | Hassell et al. | |
| 2004/0144680 | A1 | 7/2004 | Stahl | |
| 2004/0155048 | A1 | 8/2004 | Aiken | |
| 2004/0178197 | A1 | 9/2004 | Hsu et al. | |
| 2004/0182858 | A1 | 9/2004 | Smyers | |
| 2004/0195139 | A1 | 10/2004 | Wong | |
| 2004/0226945 | A1 | 11/2004 | Hsu et al. | |
| 2004/0245142 | A1 | 12/2004 | Raghunathan | |
| 2005/0140107 | A1 | 6/2005 | Gruber | |
| 2005/0183980 | A1 | 8/2005 | Fernandez et al. | |
| 2005/0224385 | A1 | 10/2005 | Hassell et al. | |
| 2005/0263423 | A1 | 12/2005 | Hassell et al. | |
| 2005/0263424 | A1 | 12/2005 | Hassell et al. | |
| 2006/0011627 | A1 | 1/2006 | Overholt et al. | |
| 2006/0065567 | A1 | 3/2006 | Hassell et al. | |
| 2006/0070906 | A1 | 4/2006 | Verna et al. | |
| 2006/0096883 | A1 | 5/2006 | Raghunathan et al. | |
| 2006/0108372 | A1 | 5/2006 | Aiken et al. | |
| 2006/0118450 | A1 | 6/2006 | Stahl | |
| 2006/0180491 | A1 | 8/2006 | Zephir et al. | |
| 2006/0186123 | A1 | 8/2006 | Baltz et al. | |
| 2006/0196800 | A1 | 9/2006 | Baltz | |
| 2006/0231449 | A1 | 10/2006 | Hassell et al. | |
| 2006/0231555 | A1 | 10/2006 | Smyers et al. | |
| 2006/0237341 | A1 | 10/2006 | McDade | |
| 2007/0056874 | A1 | 3/2007 | Apps et al. | |
| 2007/0144931 | A1 | 6/2007 | McTavish et al. | |
| 2007/0175790 | A1 | 8/2007 | Fernandez et al. | |
| 2007/0178197 | A1* | 8/2007 | LaRue et al. | 426/129 |
| 2007/0187276 | A1 | 8/2007 | Stahl | |
| 2007/0246471 | A1* | 10/2007 | Hrovat | 220/533 |

FOREIGN PATENT DOCUMENTS

| | | |
|---|---|---|
| CA | 2032012 | 6/1991 |
| CA | 2129617 | 2/1995 |
| CA | 2130973 | 3/1995 |
| CA | 2212239 | 8/1996 |
| CA | 2484830 | 8/1996 |
| CA | 2313137 | 7/1999 |
| CA | 2296895 | 7/2000 |
| CA | 2326118 | 5/2001 |
| CA | 2387491 | 5/2001 |
| CA | 2389010 | 5/2001 |
| CA | 2392265 | 6/2001 |
| CA | 2395367 | 7/2001 |
| CA | 2397522 | 8/2001 |
| CA | 2406099 | 10/2001 |
| CA | 2408247 | 11/2001 |
| CA | 2384941 | 1/2002 |
| CA | 2421595 | 3/2002 |
| CA | 2426949 | 5/2002 |
| CA | 2367649 | 7/2002 |
| CA | 2442723 | 10/2002 |
| CA | 2455355 | 2/2003 |
| CA | 2458773 | 3/2003 |
| CA | 2472360 | 7/2003 |
| CA | 2475531 | 9/2003 |
| CA | 2485544 | 12/2003 |
| CA | 2448920 | 7/2004 |
| CA | 2431444 | 12/2004 |
| DE | 3511321 | 10/1986 |
| DE | 3521894 | 1/1987 |
| DE | 20002537 | 6/2001 |
| EP | 0368713 | 5/1990 |
| EP | 370771 | 5/1990 |
| EP | 0557002 | 8/1993 |
| EP | 697341 | 2/1996 |
| EP | 926073 | 6/1999 |
| EP | 953509 | 11/1999 |
| FR | 1131652 | 2/1957 |
| FR | 2678585 | 1/1993 |
| GB | 2067167 | 7/1981 |
| GB | 2124588 | 2/1984 |
| GB | 2129401 | 5/1984 |
| GB | 2137167 | 10/1984 |
| GB | 2141778 | 1/1985 |
| GB | 2171980 | 9/1986 |
| GB | 2180821 | 4/1987 |
| GB | 2209737 | 5/1989 |
| GB | 2296009 | 6/1996 |
| GB | 2333285 | 7/1999 |
| GB | 2340485 | 2/2000 |
| GB | 2350350 | 11/2000 |
| GB | 2373239 | 9/2002 |
| GB | 2374859 | 10/2002 |
| GB | 2373240 | 1/2008 |
| NL | 7905105 | 12/1980 |
| TW | 338405 | 8/1998 |
| TW | 372539 | 10/1999 |
| WO | 9801352 | 1/1998 |
| WO | 0027716 | 5/2000 |
| WO | 0051900 | 9/2000 |
| WO | 0066440 | 11/2000 |
| WO | 0185558 | 11/2001 |
| WO | 2006062899 | 6/2006 |

OTHER PUBLICATIONS

Canadian Official Action for Canadian Patent Application No. 2,408,247 dated Nov. 24, 2005 (3 pages).

International Preliminary Examination Report dated Sep. 10, 2002, issued in PCT/CA01/00640 (11 pages).

Correspondence regarding European Patent Application No. 01 931 236.6-2308 dated May 27, 2004 (2 pages).

Correspondence regarding European Patent Application No. 01 931 236.6-2308 dated Jun. 2, 2005 (3 pages).

* cited by examiner

TWO POSITION NESTABLE TRAY WITH DRAIN CHANNELS AND SCALLOPED HANDLES

CLAIM FOR PRIORITY

The present application claims priority as a continuation-in-part application under 35 U.S.C. §120 to U.S. Non-provisional Design patent application Ser. No. 29/248,075, filed on Jul. 27, 2006, the entire contents of which are expressly incorporated herein by reference, and as a continuation of International Patent Application No. PCT/US2007/002457, with an international filing date of Jan. 29, 2007, the entire contents of which are expressly incorporated herein by reference.

BACKGROUND OF THE INVENTION

1. Field of the Invention

The invention relates to stackable trays. More particularly, the invention relates to a stackable tray for use in delivering baked products.

2. Background Art

The use of plastic trays for the storage and delivery of baked products is well known to those of ordinary skill in the art of the present invention. Such trays generally incorporate features such as a handles, which allows users to pickup trays to stack or un-stack them. Other well known features included stacking in a 0° stacking orientation and a 180° stacking orientation. The 0° stacking orientation describes the configuration when a second, similar tray is placed upon a lower tray such that the front wall of the upper and lower tray face the same direction. In the 180° stacking orientation, the front wall of the upper tray is located above the rear wall of the lower tray. Usually, the 180° stacking orientation increases the efficiency of stacking empty trays because when in the 180° stacking orientation, the upper tray partially nests within the lower tray, reducing the total height of the stacked trays.

As described, stacking trays in a 180° stacking orientation reduces the overall height of the stacked trays as compared to the 0° stacking orientation. Thus, retailers can place more of the stacked trays in less space for storage until the provider of the baked goods retrieves them to be filled at a warehouse or bakery. However, when the baked product manufacturer retrieves the empty trays stacked in the 180° stacking orientation, it is sometimes difficult to un-stack the empty trays. It is difficult to un-stack the empty trays because the stacking feet of the upper tray that fit within receptacles in the lower trays tend to be difficult to extract from the receptacles. When there are hundreds of trays to un-stack and move, increasing the ease of un-stacking can make a considerable difference in the time and effort required to un-stack the trays, thereby saving money.

Further, known trays suffer from problems when fully loaded and stacked in the 0° stacking orientation. Because trays are manufactured to tight size and weight tolerances, the amount of plastic used (in most cases, high density polyethylene (HDPE) to manufacture the trays) is reduced to an amount that sometimes is inadequate to fully support the weight of the baked products. When a tray is fully loaded, bending of the base of the tray can occur which can damage the tray, and more importantly, the product located in a lower tray. This is especially true when the baked product are flour or corn tortillas.

Further, as well known to those of skill in the art of the invention, when trays are designed to carry heavier loads of baked product, it becomes very difficult to use bases that are ribbed. To provide greater strength, the trays are provided with substantially flat, horizontal upper surface on the base. Trays that have such upper surface on the base, however, are difficult to clean and subsequently dry. Water will pool on the substantially flat, upper surface of the base.

Some retailers will attempt to use rudimentary tools to retrieve empty trays. Known trays have either excessively large handles that weaken side walls, or smaller handles that make the side wall stronger but which are difficult to retrieve with the tray retrieving tool. The industry standard tray retrieving tool has a handle at one end, a long thin member attached to the handle at a proximate end, and a hook at a distal portion of the long thin member. The user retrieves trays with the hooked end by sliding or inserting it into the handle and pulling on the tray.

Further, known trays have handles that are similarly designed so that the trays are substantially symmetrical about all four side walls. While aesthetically pleasing, however, such handles make it difficult for a user to determine, at a glance, whether multiple stacked trays are in a 0° or a 180° stacking orientation.

Furthermore, known trays are typically designed to handle only one type of product. That is, the dimensions of the tray (interior width, depth, height, and stacking depths) are configured to optimally fit just one type of product. While different products can be placed and shipped in these prior art trays, movement can occur during shipping and handling, leading to product damage.

Thus, a need exists for a tray that overcomes the problems described above of difficulty in un-stacking in a 180 stacking orientation, in cleaning substantially flat upper surfaces of the bases, and in retrieving trays in an efficient manner.

SUMMARY OF THE INVENTION

It is therefore a general object of the invention to provide a tray that will obviate or minimize problems of the type previously described.

It is an object of the invention to provide a tray that is easier to un-stack than conventional trays.

It is another object of the present invention to provide a tray with substantially vertical stacking legs and substantially vertical stacking recesses such that when substantially similar trays are stacked upon each other, whether in the 0° or 180 stacking orientation, the upper trays are substantially easier to remove from the lower trays.

It is another object of the present invention to provide a tray with a scalloped handle such that when substantially similar trays are stacked upon each other, whether in the 0° stacking orientation or 180 stacking orientation, the stacking orientation of the trays are substantially easier to recognize and subsequently easier to remove from the lower trays.

It is another object of the present invention to provide a tray with an elongated opening on a side wall in the horizontal direction such that when substantially similar trays are stacked upon each other, whether in the 0° or 180 stacking orientation, the upper trays are substantially easier to remove from the lower trays.

It is another object of the present invention to provide a tray with an elongated opening in a substantially horizontal direction at the handle, on the side walls such that when substantially similar trays are stacked upon each other, whether in the 0° or 180 stacking orientation, the upper trays are substantially easier to remove from the lower trays.

It is another object of the present invention to provide a tray with an elongated opening in a substantially horizontal direction at the handles on the side walls such that when substantially similar trays are stacked upon each other, whether in the 0° or 180 stacking orientation, the upper trays are substantially easier to remove from the lower trays by locating a tray retrieving hook through the elongated opening in a substantially horizontal direction and retrieving the tray.

It is another object of the present invention to provide a tray that can be cleaned relatively easily than conventional trays.

It is another object of the present invention to provide a tray with drain channels in the base of the tray such that the tray can be cleaned relatively easily than conventional trays.

It is another object of the present invention to provide a tray wherein the amount of storage space can be substantially easily modified.

It is another object of the present invention to provide a tray with spacers such that the amount of storage space can be substantially easily modified.

It is another object of the present invention to provide a tray with spacers and holes in the base of the tray such that the amount of storage space can be substantially easily modified by placing the spacers in appropriate locations to modify the dimensions of the storage space in the tray.

All the above described disadvantages are overcome and a number of advantages are realized by a first aspect of the present invention that relates to a tray for transporting baked products, comprising: a base, a front wall, a right side wall, a rear wall, and a left side wall, wherein the front wall and rear wall are substantially parallel to each other, the front wall and rear wall are each substantially perpendicular to the left side wall and right side wall, the left and right side walls are substantially parallel to each other, and each of the front wall, right side wall, rear wall, and left side walls are all substantially perpendicular to the base; a plurality of drain holes, including a center drain hole located substantially centrally on the base; and a plurality of drain channels located on an upper surface of the base, wherein each of the drain channels slopes downward from a respective wall towards the center drain hole, and wherein the drain channels are configured to drain fluid out of the tray.

The first aspect of the present invention further provides for a tray for transporting baked products wherein the plurality of drain channels comprises four drain channels, each of the four drain channels originating at a drain channel originating point located at a corner of the tray, and wherein a width of each of the four drain channels increases from the drain channel originating point to the center drain hole.

According to the first aspect of the present invention, each of the four drain channels comprises: a first sloped surface; a second sloped surface; and a centerline formed at an intersection between the first sloped surface and the second sloped surface. According to the first aspect of the present invention, the centerline is formed at a first angle with respect to a substantially horizontal and substantially planar upper surface of the base. Still further according to the first aspect of the present invention, the first angle is between about 0.10° and about 0.40°, or the first angle is about 0.25°.

According to the first aspect of the present invention, each of the four drain channels further comprises: a first upper surface located at a junction between the upper surface of the base and the first sloped surface; a second upper surface located at a junction between the upper surface of the base and the second sloped surface; and a spread angle that is formed between the first and second upper surfaces. According to the first aspect of the present invention, the spread angle is between about 13.5° and about 15.5°, or the spread angle is about 14.6°.

According to the first aspect of the present invention, each of the four drain channels comprises a range in depth from substantially no depth at the drain hole originating point to a first depth at the center drain hole. Still further, the first depth is between about 0.50 inches and about 0.70 inches, or the first depth is about 0.60 inches.

According to the first aspect of the present invention, each of the four drain channels terminates at a drain channel terminating portion located at a central portion of the base adjacent to two other drain channels. Still further according to the first aspect, each drain channel terminating portion comprises: a drain interface surface shared by two adjacent drain channels, wherein each of the drain interface surfaces originates from an upper surface of the base of the tray, and wherein each of the drain interface surfaces terminates at the center drain hole, whereby, each of the drain interface surfaces is formed at a drain interface angle with respect to the upper surface of the base. Still further according to the first aspect of the present invention, the drain interface angle is between about 1° and about 3°, or the drain interface angle is about 1.5°.

According to the first aspect of the present invention, the tray for transporting baked products further comprises a first handle, wherein the first handle is substantially centrally located on one of the left side wall and the right side wall, and includes an open portion, wherein the open portion includes a first open portion part that is substantially rectangular, and wherein a long side of the first open portion part is substantially parallel to an upper surface of the side wall and to the base, and further wherein the open portion includes a second open portion part, adjacent to the first open portion part, wherein the second open portion part is substantially rectangular and wherein a long side of the second open portion part is substantially parallel to the upper surface of the side wall and to the base, and wherein the first handle further includes an inner flat portion located above the first open portion and on an inner surface of the side wall where the first handle is located, and an outer flat portion that is located above the first open portion and on an outer surface of the side wall where the first handle is located, and a scalloped portion located on an upper portion of the side wall where the first handle is located, the scalloped portion including a plurality of scallops, each of the scallops extending from the inner surface of the side wall up to and including the upper surface of the side wall, and further wherein the first handle enables a user to grip the tray and identify an orientation of the tray.

According to the first aspect of the present invention, the tray for transporting baked products still further comprises a second handle, wherein the second handle is substantially centrally located on one of the left side wall and the right side wall, and includes an open portion, wherein the open portion includes a first open portion part that is substantially rectangular, and wherein a long side of the first open portion part is substantially parallel to an upper surface of the side wall and to the base, and a second open portion part, adjacent to the first open portion part, wherein the second open portion part is substantially rectangular and wherein a long side of the second open portion part is substantially parallel to the upper surface of the side wall and to the base, and wherein the second handle further includes an inner flat portion located above the first open portion and on an inner surface of the side wall where the second handle is located, an outer flat portion located above the first open portion and on an outer surface of the side wall where the second handle is located, and wherein on both of the first and second handles, the second open portion part is longer than the first open portion part, and is thereby configured to provide an opening for a tray retrieving tool such that the tray retrieving tool can retrieve the tray from a storage location.

Still further according to the first aspect of the present invention, the upper surface of the base is substantially smooth and even, and further wherein each of the plurality of drain channels is configured to substantially prevent marking of any baked products stored in the tray.

According to a second aspect of the present invention, a tray for transporting baked products is provided, comprising: a base, a front wall, a right side wall, a rear wall, and a left side wall, wherein the front wall and rear wall are substantially parallel to each other, the front wall and rear wall are each substantially perpendicular to the left side wall and right side wall, the left and right side walls are substantially parallel to each other, and further wherein, each of the front wall, right side wall, rear wall, and left side walls are all substantially perpendicular to the base; a first handle, wherein the first handle is substantially centrally located on one of the left side wall and the right side wall, and includes an open portion, wherein the open portion includes a first open portion part that is substantially rectangular, and wherein a long side of the first open portion part is substantially parallel to an upper surface of the side wall and to the base, and a second open portion part, adjacent to the first open portion part, wherein the second open portion part is substantially rectangular and wherein a long side of the second open portion part is substantially parallel to the upper surface of the side wall and to the base, and wherein the first handle further includes an inner flat portion located above the first open portion and on an inner surface of the side wall where the first handle is located, an outer flat portion that is located above the first open portion and on an outer surface of the side wall where the first handle is located, and a scalloped portion located on an upper portion of the side wall where the first handle is located, the scalloped portion including a plurality of scallops, each of the scallops extending from the inner surface of the side wall up to and including the upper surface of the side wall, and further wherein the first handle enables a user to grip the tray and identify an orientation of the tray.

According to the second aspect of the present invention, the second open portion part is longer than the first open portion, and wherein the second open portion part is configured to provide an opening for a tray retrieving tool such that the tray retrieving tool can retrieve the tray from a storage location. Still further, the tray comprises a second handle that includes a first open portion part, and a second open portion part, and wherein the first open portion part of the second handle is substantially similar to the first open portion part of the first handle, and further wherein, the second open portion part of the second handle is substantially similar to the second open portion part of the first handle.

According to the second aspect of the present invention, the tray for transporting baked products further comprises: a plurality of drain holes, including a center drain hole located substantially centrally on the base of the tray; and a plurality of drain channels located on an upper surface of the base, wherein each of the drain channels slopes downward from a respective wall towards the center drain hole, and wherein the drain channels are configured to drain fluid out of the tray.

According to the second aspect of the present invention, the tray for transporting baked products further comprises: a plurality of spacers, wherein each of the plurality of the spacers include a plurality of plugs on a bottom surface of the spacer, and wherein each of the plurality of plugs fits within a corresponding spacer plug receptacle on the base of the tray, such that the spacer is removably attached to the base of the tray at a predetermined distance from each the left side wall and the right side wall, and further wherein the spacers are configured to change an internal storage dimension of the tray, such that a plurality of baked products can be stored and/or transported in the tray without significant damage to any of the plurality of baked products.

According to a third aspect of the present invention, a tray for transporting baked products is provided, comprising: a base, a front wall, a right side wall, a rear wall, and a left side wall, wherein the front wall and rear wall are substantially parallel to each other, the front wall and rear wall are each substantially perpendicular to the left side wall and right side wall, the left and right side walls are substantially parallel to each other, and each of the front wall, right side wall, rear wall, and left side walls are all substantially perpendicular to the base; a plurality of spacers, wherein each of the plurality of the spacers include a plurality of plugs on a bottom surface of the spacer; and a plurality of spacer plug receptacles located on the base, wherein a first plurality of the plurality of spacer plug receptacles are located adjacent to the left side wall, and a second plurality of the plurality of spacer plug receptacles are located adjacent to the right side wall, and wherein each of the plurality of plugs fits within a corresponding spacer plug receptacle on the base of the tray, such that each of the plurality of spacers is removably attached to the base of the tray at a predetermined distance from each of the left side wall and the right side wall, and wherein the spacers are configured to change an internal storage dimension of the tray, such that a plurality of baked products can be stored and/or transported in the tray without significant damage to any of the plurality of baked products.

According to the third aspect of the present invention, the spacers comprise: a substantially vertical portion; a substantially horizontal portion that is substantially perpendicular to the substantially vertical portion; a plurality of reinforcing portions, wherein each of the reinforcing portions is joined to both the substantially vertical portion and the substantially horizontal portion, and each of the reinforcing portions is configured to transfer force from the substantially vertical portion to the substantially horizontal portion and subsequently to the base.

Still further according to the third aspect of the present invention, each of the reinforcing portions comprises: a conically shaped tube structure, and further wherein the substantially vertical portion includes a substantially flat surface configured to interface with one or more baked products stored in the tray, and further wherein each of the plurality of spacer plug receptacles is located adjacent to one of the side walls of the tray, such that each of the plurality of spacers can only be removably attached to the base in a single orientation, wherein the substantially flat portion of the spacer faces towards an interior portion of the tray.

According to the third aspect of the present invention a plurality of spacers can be used or a single spacer can be used to change the internal storage dimension of the tray such that a plurality of baked products can be stored and/or transported in the tray without significant damage to any of the plurality of baked products.

According to a fourth aspect of the present invention, a method is provided for retrieving a tray, wherein the tray comprises at least one handle, wherein the handle includes a first portion and a second portion, and wherein the first portion includes a first substantially rectangular section, and the second portion includes a second substantially rectangular section, wherein the second substantially rectangular section is longer than the first substantially rectangular section, wherein the method comprises: inserting a tray retrieving tool into the second substantially rectangular section; and retrieving the tray from a storage location by using the tray retrieving tool to pull the handle.

According to a fifth aspect of the present invention, a method for altering storage space in a tray is provided, comprising: orienting at least one spacer such that each of a plurality of spacer plugs located on a bottom portion of each of the at least one spacer is substantially aligned with a corresponding one of a plurality of spacer plug receptacles located on a base of the tray; and inserting each of the plurality of spacer plugs into the corresponding spacer plug receptacle, thereby removably attaching the at least one spacer to the base of the tray.

According to the fifth aspect of the present invention, the step of inserting at least one spacer into the tray comprises: altering a storage space of an interior portion of the tray, and the step of inserting each of the plurality of spacer plugs into the corresponding spacer plug receptacle can only be accomplished in a single orientation, such that a substantially flat portion of a substantially vertical portion of the spacer is substantially parallel to front wall and rear wall of the tray, or is substantially parallel to a left side wall and a right side wall of the tray, and wherein the substantially flat portion of the substantially vertical portion of the spacer faces an inner portion of the tray.

According to the fifth aspect of the present invention, the step of inserting each of the plurality of spacer plugs into the corresponding spacer plug receptacle comprises: altering the storage space of the tray such that different types of goods can be orderly arranged and stored without substantial space between the different types of goods, and wherein the at least one spacer comprises two spacers.

According to a sixth aspect of the present invention, a method for cleaning a tray is provided, comprising: applying a cleaning liquid to the tray; rinsing the tray with water; and draining rinse water and cleaning liquid from the tray via one or more of a plurality of drain channels located on an upper surface of a base of the tray, wherein the upper surface of the base of the tray is substantially flat and each of the plurality of drain channels is substantially shallow, such that markings or damage to baked goods stored in the tray are substantially prevented.

According to the sixth aspect of the present invention, the step of draining comprises: draining substantially all the water and cleaning liquid out of the tray, and the step of draining rinse water and cleaning liquid from the tray further comprises: flowing the rinse water and cleaning liquid from any location within the tray to a draining location, wherein each of the plurality of drain channels originates at or close to a wall of the tray, and further wherein each of the plurality of drain channels is relatively deeper at or close to a center of the base of the tray, and still further wherein each of the plurality of drain channels is relatively shallower at or close to a respective wall of the tray; and draining the rinse water and cleaning liquid from the tray at the draining location.

Still further according to the sixth aspect of the present invention, the draining location comprises a center hole located at a substantially central portion of the base of the tray, and the step of applying a cleaning liquid to the tray comprises immersing, showering, and/or spraying the tray with cleaning liquid.

According to the sixth aspect of the present invention, the cleaning liquid comprises water at a substantially elevated temperature relative to room temperature, and the cleaning liquid comprises water and a cleaning solution configured to remove dirt, bacteria and other waste residue from the tray.

According to a seventh aspect of the present invention, a tray for transporting baked products is provided, comprising: a base, a front wall, a right side wall, a rear wall, and a left side wall, wherein the front wall and rear wall are substantially parallel to each other, the front wall and rear wall are each substantially perpendicular to the left side wall and right side wall, the left and right side walls are substantially parallel to each other, and each of the front wall, right side wall, rear wall, and left side walls are all substantially perpendicular to the base; a plurality of stacking feet on each of the front wall, right side wall, rear wall, and left side wall, wherein each of the plurality of stacking feet includes an angled left wall portion and right wall portion, a substantially horizontal stacking foot flat portion, and a stacking foot cross member; a plurality of 0° stacking receptacles on each of the front wall, right side wall, rear wall, and left side wall, wherein each of the plurality of 0° stacking receptacles includes a receiving portion, and a 0° stacking foot cross member receptacle, wherein, each of the plurality of 0° stacking receptacles is configured to receive a corresponding stacking foot when an upper tray is stacked on a lower, substantially similar tray in a 0° stacking orientation, such that a front wall of the upper tray faces a same direction as a front wall of the lower tray, and further wherein, each of the plurality of 0° stacking feet receptacles is configured to receive a lower portion of each of the angled left wall portions and right wall portions of each of the stacking feet, the substantially horizontal stacking foot flat portion, and the stacking foot cross member, and wherein the stacking foot cross member of each of the plurality of stacking feet is received within the 0° stacking foot cross member receptacle, such that lateral and/or frontwardly and/or rearwardly motions of the containers about each other is substantially reduced or prevented.

According to the seventh aspect of the present invention, each of the 0° stacking foot cross member receptacles comprises: a first bifurcated portion and second bifurcated portion of an inner wall of each of the front wall, right side wall, rear wall, and left side wall of the tray, the first and second bifurcated portions rising a distance above a bottom portion of the 0° stacking foot receptacle receiving portion; and an opening between the first bifurcated portion and second bifurcated portion is configured to receive the stacking foot cross member.

Still further according to the seventh aspect of the present invention, the stacking foot cross member is substantially orthogonal to both the first bifurcated portion and the second bifurcated portion when the opening between the first bifurcated portion and the second bifurcated portion receives the stacking foot cross member.

According to the seventh aspect of the present invention, the tray further comprises: a stacking ledge, portions of which are located on each of the plurality of stacking feet and on each of the front wall, right side wall, rear wall, and left side wall; and a plurality of 180° stacking receptacles on each of the front wall, right side wall, rear wall, and left side wall, wherein each of the plurality of 180° stacking receptacles includes a receiving portion, and a 180° stacking foot cross member receptacle, wherein, each of the plurality of 180° stacking receptacles is configured to receive a corresponding stacking foot when an upper tray is stacked on a lower, substantially similar tray in a 180° stacking orientation, such that a front wall of the upper tray faces a same direction as a rear wall of the lower tray, and further wherein, each of the plurality of 180° stacking feet receptacles is configured to receive a lower portion of each of the angled left wall portions and right wall portions of each of the stacking feet, the substantially horizontal stacking foot flat portion, and the stacking foot cross member, and wherein the stacking foot cross member of each of the plurality of stacking feet is received within the 0° stacking foot cross member receptacle, such that lateral and/or frontwardly and/or rearwardly motion of the containers about each other is substantially reduced or prevented.

According to the seventh aspect of the present invention, each of the 180° stacking foot cross member receptacles comprises: a first raised wall portion and a second raised wall portion, wherein each of the first raised wall portion and second raised wall portion originates from a bottom portion of the 180° stacking foot receptacle receiving portion; and an opening between the first raised wall portion and second raised portion is configured to receive the stacking foot cross member.

Still further according to the seventh aspect of the present invention, the stacking foot cross member is substantially orthogonal to both the first raised wall portion and second raised wall portion when the opening between the first raised wall portion and second raised wall portion receives the stacking foot cross member.

BRIEF DESCRIPTION OF THE DRAWINGS

The novel features and advantages of the present invention will best be understood by reference to the detailed description of the preferred embodiments which follows, when read in conjunction with the accompanying drawings, in which.

DETAILED DESCRIPTION OF THE PREFERRED EMBODIMENTS

Figure 1:
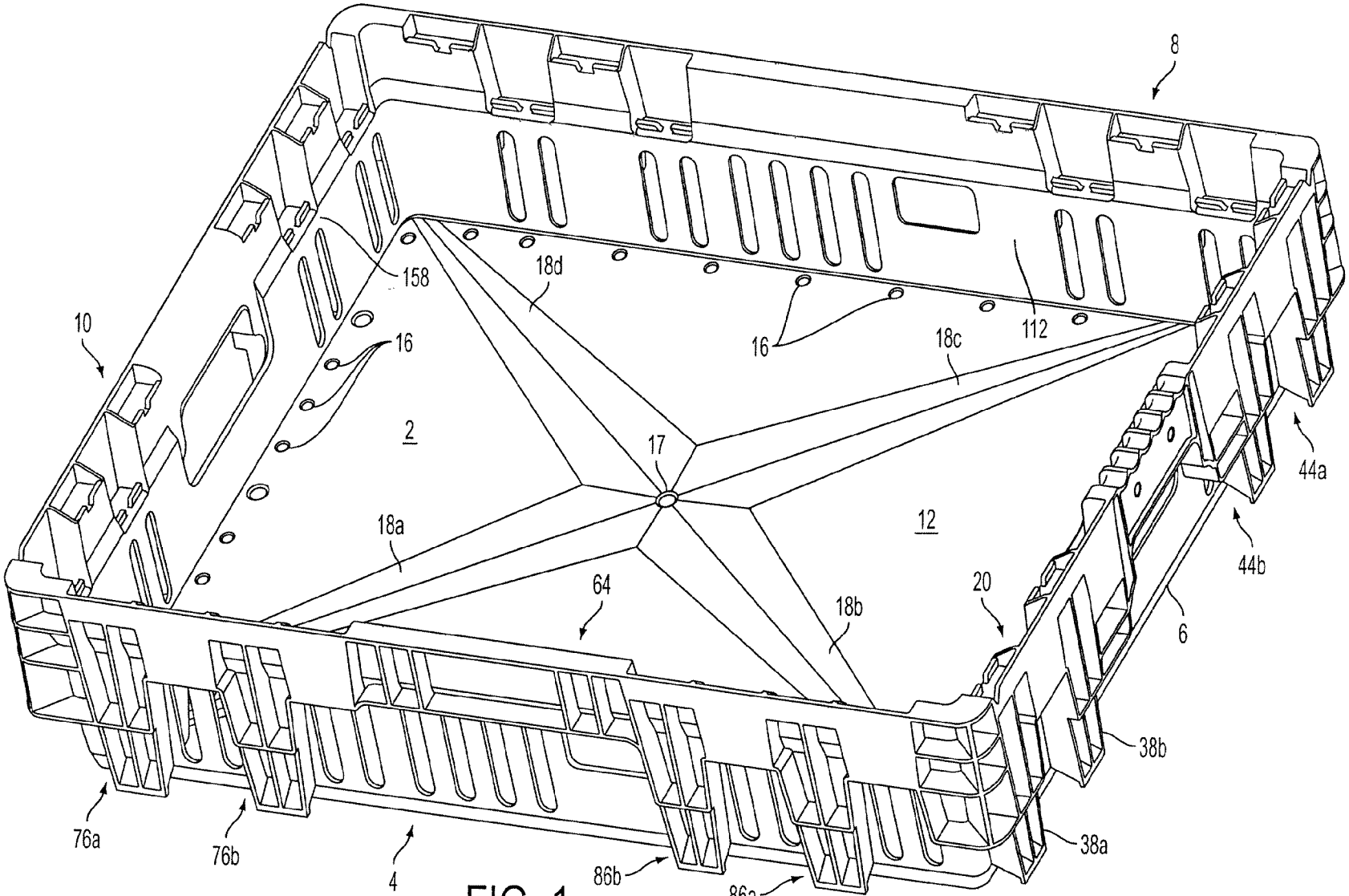
FIG. 1 is a front perspective view of a nestable, stackable food tray (tray) with substantially vertical walls, interlocking recesses on the sidewalls for zero degree and 180 degree stacking of a second like container, and a first and second handle, according to an embodiment of the present invention.
Figure 2:
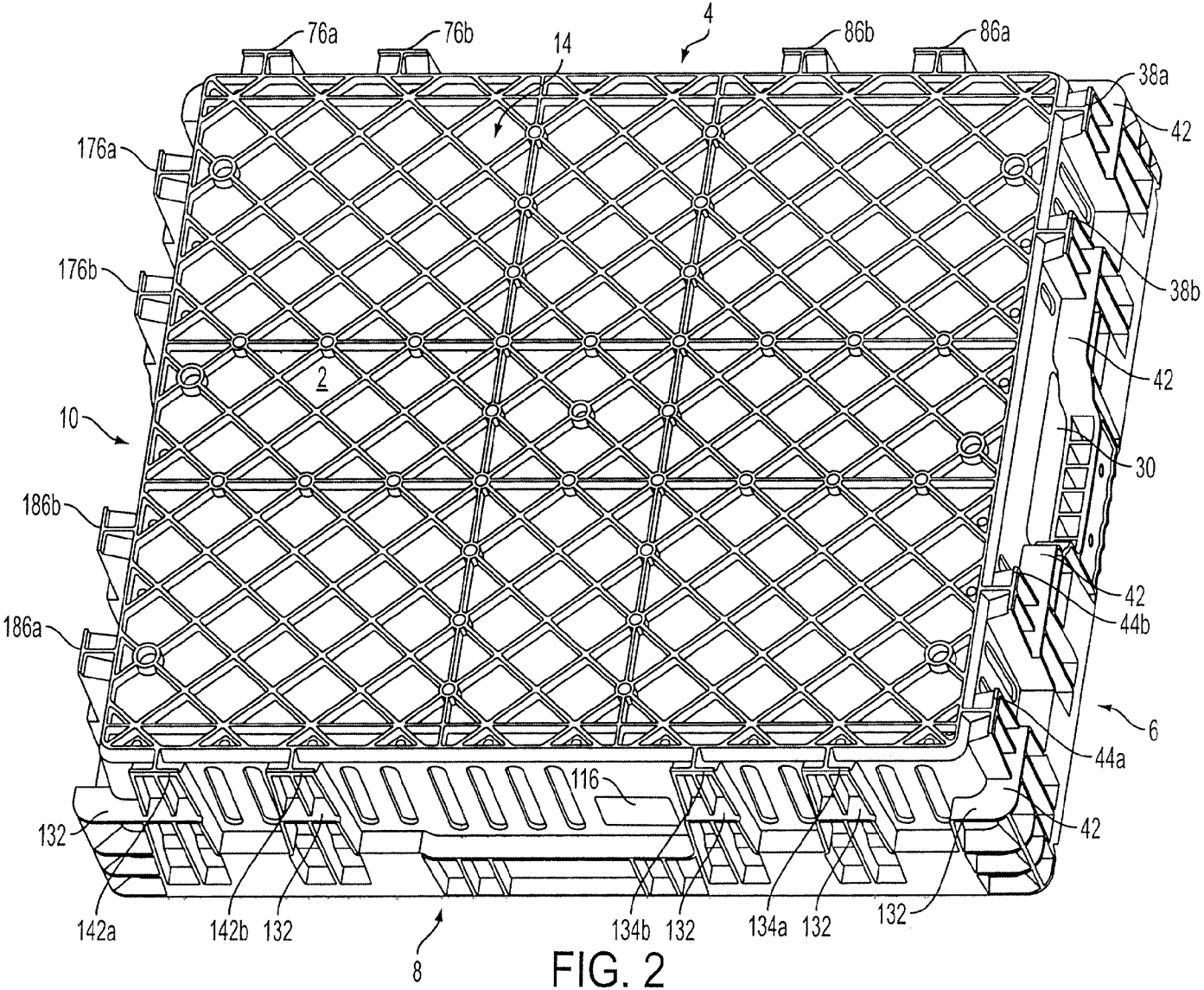
FIG. 2 is a bottom perspective view of the nestable, stackable food tray shown in FIG. 1.
Figure 3:
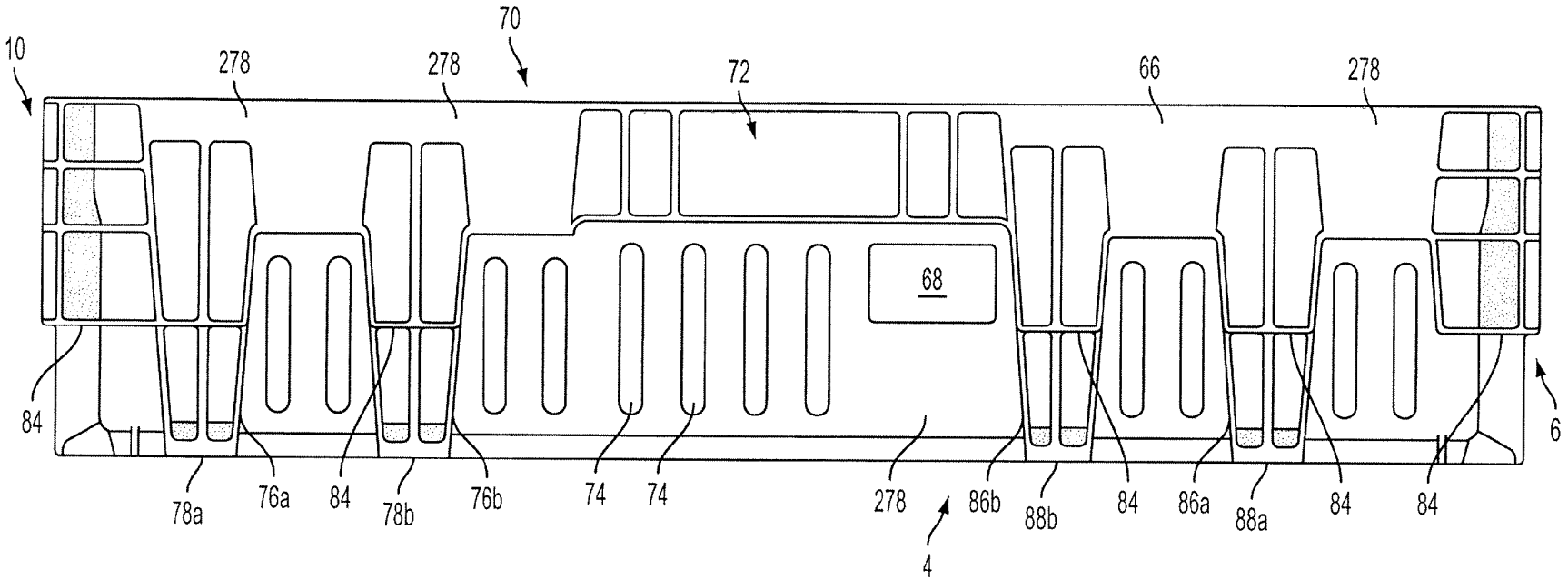
FIG. 3 is a front view of the tray shown in FIG. 1.

The various features of the preferred embodiments will now be described with reference to the drawing figures, in which like parts are identified with the same reference characters. The following description of the presently contemplated best mode of practicing the invention is not to be taken in a limiting sense, but is provided merely for the purpose of describing the general principles of the invention.

I. Summary of the Exemplary Embodiments of the Invention

Tray 100 comprises a base 2, front wall 4 and rear wall 8, left side wall 10 and right side wall 6, wherein the walls are all substantially orthogonal to each other and the base 2. Tray 100 is preferably constructed from high density polyethylene (HDPE) plastic, though other materials can also be used. Tray 100 is preferably used in the baked product industry to carry products such as loaves of bread, rolls, buns, and other similar products. According to a preferred embodiment of the present invention, however, tray 100 carries flour or corn tortilla products. As one of ordinary skill in the art can appreciate, however, other types of products, or goods, can also be carried in tray 100.

Figure 40:
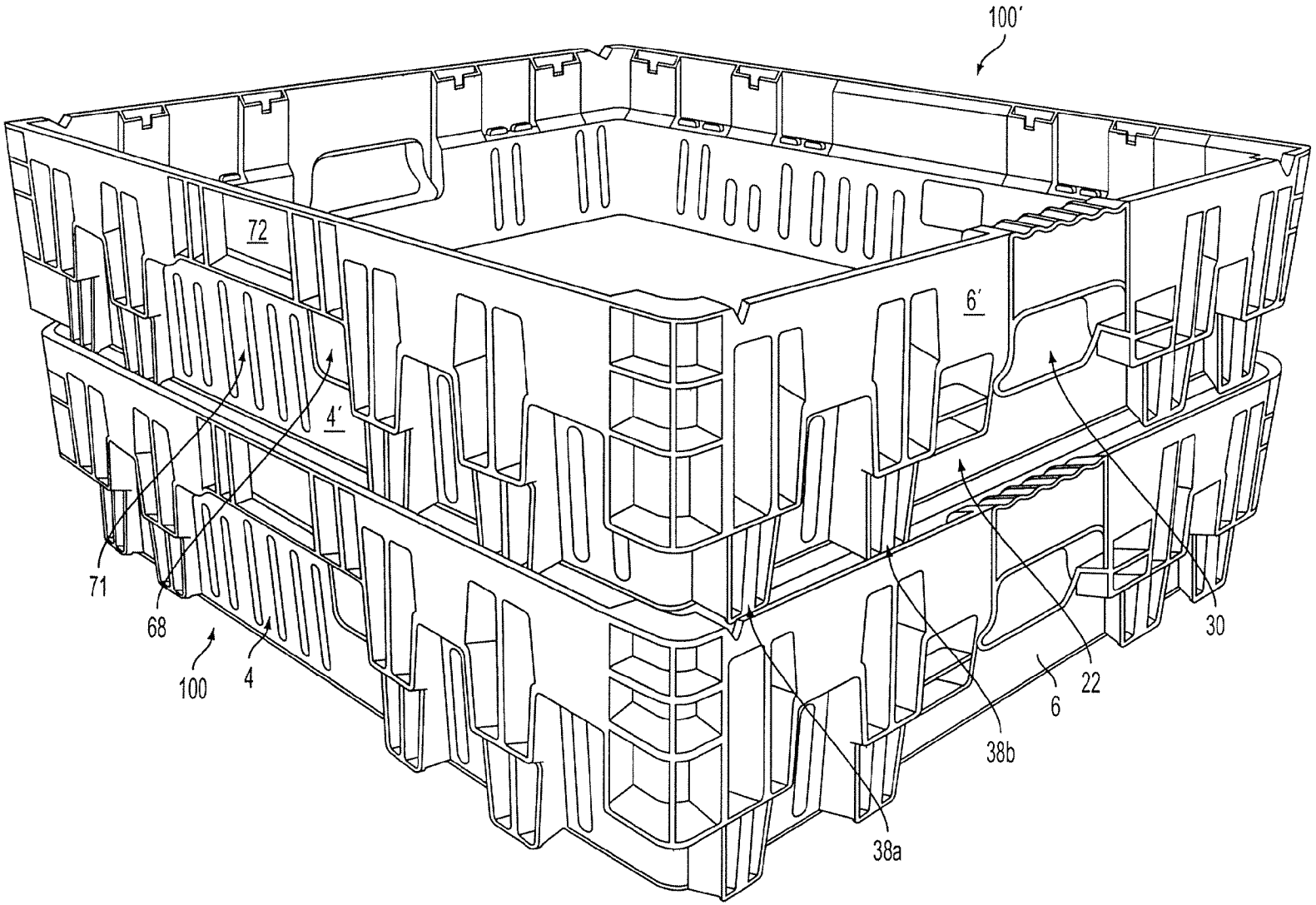
FIG. 40 is a front isometric view of the two trays shown in FIG. 1 in a 0° stacking orientation according to an embodiment of the present invention.
Figure 41:
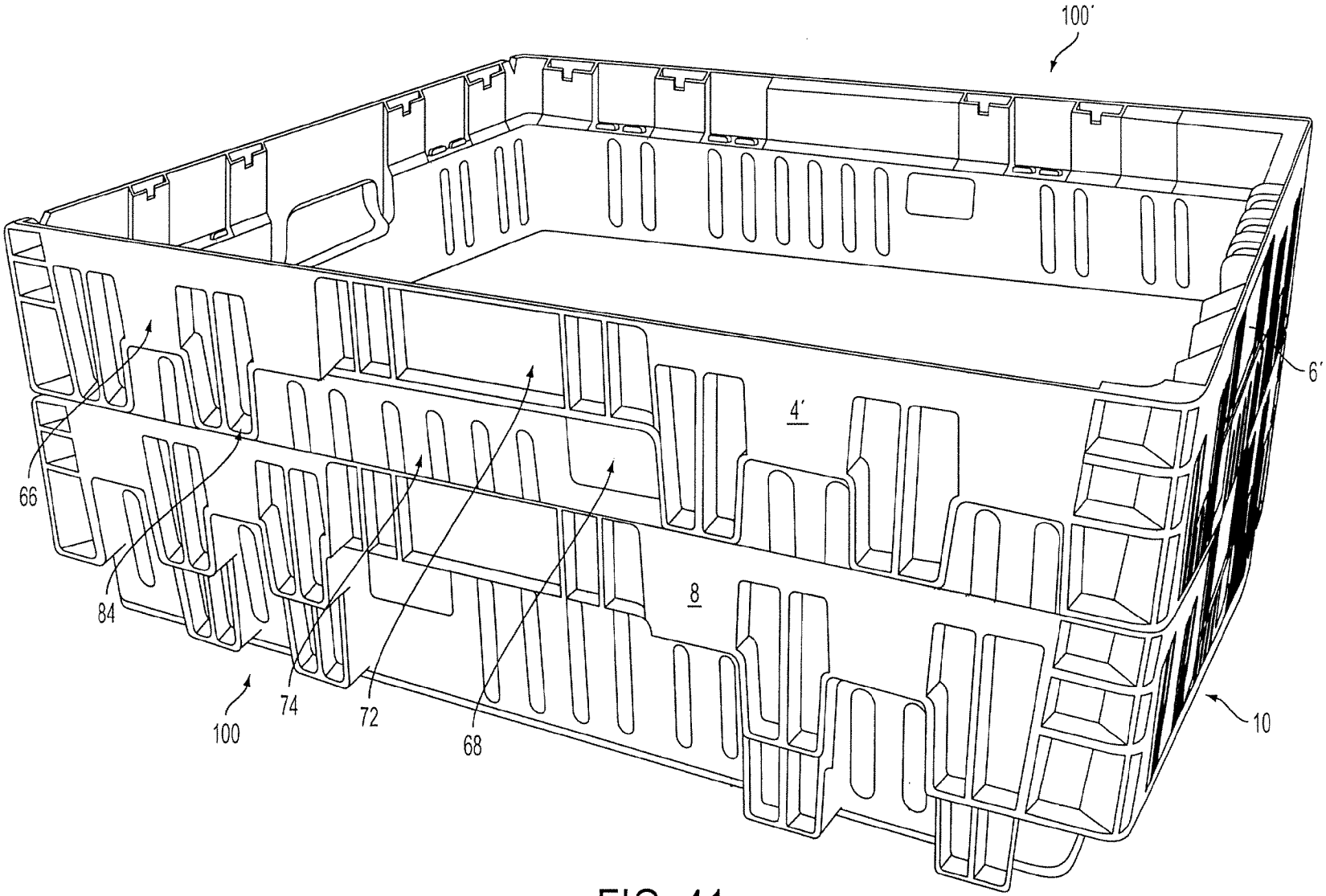
FIG. 41 is a front isometric view of the two trays shown in FIG. 1 in a 180° stacking orientation according to an embodiment of the present invention.

Two or more like trays 100 can be stacked in either a 0° stacking orientation, or a 180° stacking orientation. In the 0° stacking orientation, the upper tray (designated as tray 100'), rests upon a lower tray 100 and faces the same direction. In a 180° stacking orientation, rear wall 8' of the upper tray 100' is in the same direction as front wall 4 of lower tray 100. FIG. 40 illustrates a 0° stacking orientation, and FIG. 41 illustrates a 180° stacking orientation according to an embodiment of the present invention.

As briefly described above, tray 100 comprises a base 2, a front wall 4, a left and right side wall 10, 6, and a rear wall 8. Each of the walls further comprises several features that assist in the stacking of like trays 100, and the retrieval of like trays 100 from the stacking orientations. For example, left side wall 10 comprises left side wall rear outer stacking foot 186*a*, left side wall rear inner stacking foot 186*b*, left side wall front outer stacking foot 176*a*, and left side wall front inner stacking foot 176*b*. Right side wall 6 comprises right side wall rear outer stacking foot 44*a*, right side wall rear inner stacking foot 44*b*, right side wall front outer stacking foot 38*a*, and right side wall front inner stacking foot 38*b*. Because tray 100 is designed to carry several packages of flour or corn tortillas, and the total weight can be as much as about 54 lbs, tray 100 incorporates additional stacking feet on both the front and rear walls as well. Front wall 4 comprises front side wall left outer stacking foot 78*a*, front side wall left inner stacking foot 78*b*, front side wall right outer stacking foot 86*a*, and front side wall right inner stacking foot 86*b*. Rear wall 8 comprises rear wall right outer stacking foot 134*a*, rear wall right inner stacking foot 134*b*, rear wall left outer stacking foot 124*a*, and rear wall left inner stacking foot 124*b*.

As discussed above, trays 100 are designed to carry significant amounts of weight of baked products. For this reason, front wall 4, right side wall 6, rear wall 8 and left side wall 10 are substantially perpendicular to base 2, and each comprises a significant amount of plastic material. Further, separate 0° and 180° stacking receptacles are provided that each comprise several surfaces, among other features, to retain upper tray 100' in the stacked positions. The stacking receptacles will be discussed in greater detail below. Further, each of front wall 4, right side wall 6, rear wall 8 and left side wall 10 comprises a 180° stacking ledge that sets upon upper surfaces of the respective walls of a lower similar tray 100 when in an 180° stacking orientation. This too will be discussed in greater detail below.

According to other exemplary embodiments of the present invention, substantially glossy free surfaces 278 can be provided on all surfaces of tray 100 and spacers 210, 212. According to a preferred embodiment of the present invention, substantially glossy free surfaces 278 can be provided on outer surfaces 22, 66, 114, and 160 of front wall 4, right side wall 6, rear wall 8, and left side wall 10 such that if one or more stickers were to be placed on the outer surfaces 22, 66, 114, and 160 of front wall 4, right side wall 6, rear wall 8, and left side wall 10, they can be easily removed during a cleaning process. According to a preferred embodiment of the present invention, substantially glossy free surfaces 278 can also be provided on inner surfaces 64, 20, 112, and 158 of front wall 4, right side wall 6, rear wall 8, and left side wall 10 such that if one or more stickers were to be placed on the inner surfaces 64, 20, 112, and 158 of front wall 4, right side wall 6, rear wall 8, and left side wall 10, they can be easily removed during a cleaning process. According to a preferred embodiment of the present invention, substantially glossy free surfaces 278 can also be provided on spacer wall side 224 and/or spacer product side 226 of spacers 210, 212 such that if one or more stickers were to be placed on spacer wall side 224 and/or spacer product side 226 of spacers 210, 212, they can be easily removed during a cleaning process. Substantially glossy free surfaces 278 of left and right side walls 10, 6 are used to prevent or alleviate tray counting devices from misreading a single tray as multiple trays. According to an exemplary embodiment of the present invention tray counting devices utilize optical transceivers to count or register trays before, during and after cleaning, and before, during, and after being filled with baked product. According to an exemplary embodiment of the present invention, substantially glossy free surfaces 278 prevent reflection of a light beam from being received by an optical receiver, and may comprise a plurality of micro-bumps, recesses, ribs, grooves, and various other types of markings, indentations and other alterations of the surface, which shall be described in greater detail below. According to a preferred embodiment of the present invention, the light beam is generated by an infra-red transmitter or a laser.

The exemplary embodiments of the preferred embodiments of the present invention shall now be described in greater detail.

II. Components of Tray 100

A. Front Wall 4

As discussed in greater detail below, certain conventions are utilized in describing various components of tray 100. For example, "outer" refers to components that are located proximal to the left and right side walls 10, 6 for components on the front and rear walls 4, 8, and more proximal to front and rear walls 4, 8 for components on the left and right side walls 10, 6, whereas "inner" refers to those components that are located more proximal to a center portion of tray 100.

Referring to FIGS. 1, 3, 7, and 8, front wall 4 includes an inner surface 64 and outer surface 66. Outer surface 66 of front wall 4 includes nameplate area 72. Front wall 4 further includes top surface 70. Two pairs of stacking feet are located on both sides of front wall 4, on outer surface 66; a first pair are located a short distance from left side wall 10 and a second pair are located a short distance from right side wall 6. Located adjacent to left side wall 10 of front wall 4 are front wall left outer stacking foot 78*a*, and front wall left inner stacking foot 78*b*. Located adjacent to right side wall 6 of front wall 4 are front wall right outer stacking foot 86*a*, and front wall right inner stacking foot 86*b*.

Each of the stacking feet comprise certain common characteristic components. Front wall left outer stacking foot 76*a* comprises front wall left outer stacking foot flat portion 78*a*, front wall left outer stacking foot cross member 80*a*, and front wall left outer stacking foot sloped surface 82*a*. Front wall left inner stacking foot 76*b* comprises front wall left inner stacking foot flat portion 78*b*, front wall left inner stacking foot cross member 80*b*, and front wall left inner stacking foot sloped surface 82*b*. Front wall right outer stacking foot 86*a* comprises front wall right outer stacking foot flat portion 88*a*, front wall right outer stacking foot cross member 90*a*, and front wall right outer stacking foot sloped surface 92*a*. Front wall right inner stacking foot 86*b* comprises front wall right inner stacking foot flat portion 88*b*, front wall right inner stacking foot cross member 90*b*, and front wall right inner stacking foot sloped surface. Front wall right inner stacking foot 86*b* comprises front wall right inner stacking foot flat portion 88*b*, front wall right inner stacking foot cross member 90*b*, and front wall right inner stacking foot sloped surface 92*b*.

Figure 39:
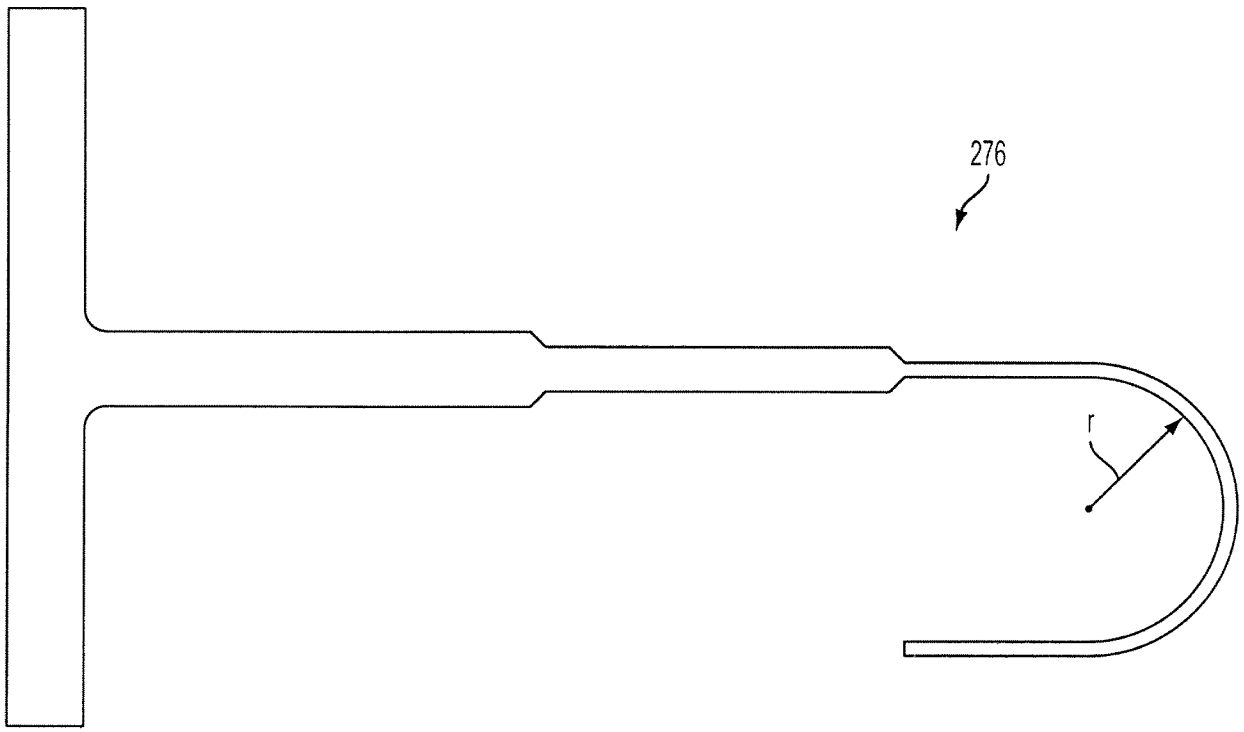
FIG. 39 is a top view of a tray retrieval tool.

Furthermore, front wall 4 comprises 180° stacking ledge 84 that sits upon upper surface 118 of rear wall 8 when upper tray 100' is stacked in a 180° stacking orientation on lower tray 100 (as shown in FIG. 41). As can be seen in the above referenced drawings, front wall 4, and its components are substantially wider than conventional trays because of the significant amount of weight tray 100 is designed to carry. Front wall 4 further comprises ventilation slots 74, to provide air flow through tray 100, especially when upper trays 100', 100" and so on are stacked upon lower tray 100. Front wall 4 further includes front wall hook area 68 that provides a location for a user to place the hook end of tray retrieving tool 276, as shown in FIG. 39. By incorporating similar structures on all four walls, it is much easier for users to pull tray 100 off other trays or from a tray cleaning area.

Located on inner surface 64 of front wall 4 are receptacles for 0° and 180° stacking. Two pairs of stacking receptacles (a pair of 0° stacking receptacles, and a pair of 180° stacking receptacles) are located on inner surface 64 on the left side of front wall 4, and two pairs of stacking receptacles (a pair of 0° stacking receptacles, and a pair of 180° stacking receptacles) are located on inner surface 64 of the right side of front wall 4. Located at the right side of front wall 4 (as viewed from the interior of tray 100) are 0° front wall left outer stacking foot receptacle 94*a*, and 0° front wall left inner stacking foot receptacle 94*b*. Between 0° front wall left outer stacking foot receptacle 94*a* and 0° front wall left inner stacking foot receptacle 94*b* is 180° front wall left outer stacking foot receptacle 108*a*, and to the left of 0° front wall left inner stacking foot receptacle 94*b* is 180° front wall left inner stacking foot receptacle 108*b* (as viewed from inside tray 100). Located at the left side of front wall 4 (as viewed from the interior of tray 100) are 180° front wall right outer stacking foot receptacle 104*a*, and 180° front wall right inner stacking foot receptacle 104*b*. Between 180° front wall right outer stacking foot receptacle 104*a* and 180° front wall right inner stacking foot receptacle 104*b* is 0° front wall right outer stacking foot receptacle 98*a*, and to the right of 180° front wall right inner stacking foot receptacle 104*b* is 0° front wall right inner stacking foot receptacle 98*b* (as viewed from inside tray 100).

Figure 7:
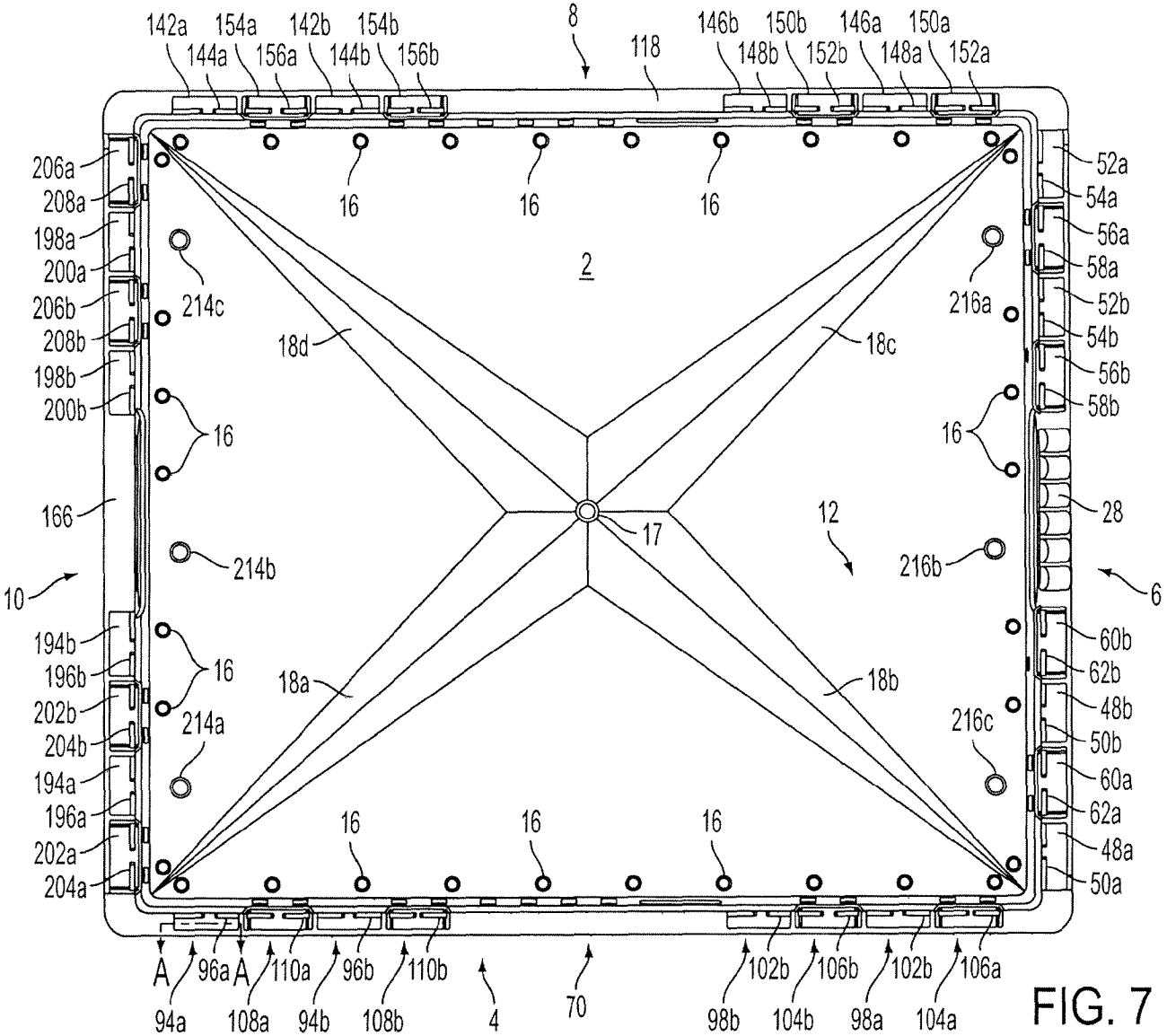
FIG. 7 is a top view of the tray shown in FIG. 1 illustrating a plurality of fanned drain channels, comprising a general star shape, on an upper surface of a substantially solid base surface of the tray.

As shown in FIG. 7, 0° front wall left outer stacking foot receptacle 94*a* includes 0° front wall left outer stacking foot cross member receptacle 96*a*; 0° front wall left inner stacking foot receptacle 94*b* includes 0° front wall left inner stacking foot cross member receptacle 96*b*; 0° front wall right outer stacking foot receptacle 98*a* includes 0° front wall right outer stacking foot cross member receptacle 102*a*; and 0° front wall right inner stacking foot receptacle 98*b* includes 0° front wall right inner stacking foot cross member receptacle 102*b*.

As further shown in FIG. 7, 180° front wall left outer stacking foot receptacle 108*a* includes 180° front wall left outer stacking foot cross member receptacle 110*a;* 180° front wall left inner stacking foot receptacle 108*b* includes 180° front wall left inner stacking foot cross member receptacle 110*b;* 180° front wall right outer stacking foot receptacle 104*a* includes 180° front wall right outer stacking foot cross member receptacle 106*a*; and 180° front wall right inner stacking foot receptacle 104*b* includes 180° front wall right inner stacking foot cross member receptacle 106*b*. Operation of the stacking feet and receptacles will be discussed in greater detail below for both the 0° and 180° stacking orientations.

B. Rear Wall 8

Referring to FIGS. 1, 5, 7, and 8, rear wall 8 includes an inner surface 112 and outer surface 114. Outer surface 114 of rear wall 8 includes nameplate area 120. Rear wall 8 further includes top surface 118. Two pairs of stacking feet are located on both sides of rear wall 8, on outer surface 114; a first pair are located a short distance from left side wall 10 and a second pair are located a short distance from right side wall 6. Located adjacent to left side wall 10 of rear wall 8, are rear wall left outer stacking foot 124*a*, and rear wall left inner stacking foot 124*b*. Located adjacent to right side wall 6 of rear wall 8 are rear wall right outer stacking foot 134*a*, and rear wall right inner stacking foot 134*b*.

Each of the stacking feet comprise certain common characteristic components. Rear wall left outer stacking foot 124*a* comprises rear wall left outer stacking foot flat portion 126*a*, rear wall left outer stacking foot cross member 128*a*, and rear wall left outer stacking foot sloped surface 130*a*. Rear wall left inner stacking foot 124*b* comprises rear wall left inner stacking foot flat portion 126*b*, rear wall left inner stacking foot cross member 128*b*, and rear wall left inner stacking foot sloped surface 130*b*. Rear wall right outer stacking foot 134*a* comprises rear wall right outer stacking foot flat portion 136*a*, rear wall right outer stacking foot cross member 138*a*, and rear wall right outer stacking foot sloped surface 140*a*. Rear wall right inner stacking foot 134*b* comprises rear wall right inner stacking foot flat portion 136*b*, rear wall right inner stacking foot cross member 138*b*, and rear wall right inner stacking foot sloped surface 140*b*.

Furthermore, rear wall 8 comprises 180° stacking ledge 132 that sits upon upper surface 70 of front wall 8 when upper tray 100' is stacked in a 180° stacking orientation on lower tray 100 (as shown in FIG. 41). As can be seen in the above referenced drawings, rear wall 8, and its components, are substantially wider than conventional trays because of the significant amount of weight tray 100 is designed to carry. Rear wall 8 further comprises ventilation slots 122, to provide air flow through tray 100, especially when upper trays 100', 100" and so on are stacked upon lower tray 100. Rear wall 8 further includes rear wall hook area 116 that provides a location for a user to place the hook end of tray retrieving tool 276, as shown in FIG. 39. By incorporating similar structures on all four walls, it is much easier for users to pull tray 100 off other trays or from a tray cleaning area.

Located on inner surface 112 of rear wall 8 are receptacles for 0° and 180° stacking. Two pairs of stacking receptacles (a pair of 0° stacking receptacles, and a pair of 180° stacking receptacles) are located on inner surface 112 on the left side of rear wall 8, and two pairs of stacking receptacles (a pair of 0° stacking receptacles, and a pair of 180° stacking receptacles) are located on inner surface 112 of the right side of rear wall 8. Located at the right side of rear wall 8 (as viewed from the interior of tray 100) are 180° rear wall right outer stacking foot receptacle 150*a*, and 180° rear wall right inner stacking foot receptacle 150*b*. Between 180° rear wall right outer stacking foot receptacle 150*a* and 180° rear wall right inner stacking foot receptacle 150*b* is 0° rear wall right outer stacking foot receptacle 146*a*, and to the left of 180° rear wall right inner stacking foot receptacle 150*b* is 0° rear wall right inner stacking foot receptacle 146*b* (as viewed from inside tray 100). Located at the left side of rear wall 8 (as viewed from the interior of tray 100) are 0° rear wall left outer stacking foot receptacle 142*a*, and 0° rear wall left inner stacking foot receptacle 142*b*. Between 0° rear wall left outer stacking foot receptacle 142*a* and 0° rear wall left inner stacking foot receptacle 142*b* is 180° rear wall left outer stacking foot receptacle 154*a*, and to the right of 0° rear wall left inner stacking foot receptacle 142*b* is 180° rear wall left inner stacking foot receptacle 154*b* (as viewed from inside tray 100).

As shown in FIG. 7, 180° rear wall right outer stacking foot receptacle 150*a* includes 180° rear wall right outer stacking foot cross member receptacle 152*a*; 180° rear wall right inner stacking foot receptacle 150*b* includes 180° rear wall right inner stacking foot cross member receptacle 152*b*; 0° rear wall right outer stacking foot receptacle 146*a* includes 0° rear wall right outer stacking foot cross member receptacle 148*a*; and 0° rear wall right inner stacking foot receptacle 146*b* includes 0° rear wall right inner stacking foot cross member receptacle 148*b*.

As further shown in FIG. 7, 0° rear wall left outer stacking foot receptacle 142*a* includes 0° rear wall left outer stacking foot cross member receptacle 144*a*; 0° rear wall left inner stacking foot receptacle 142*b* includes 0° rear wall left inner stacking foot cross member receptacle 144*b*; 180° rear wall left outer stacking foot receptacle 154*a* includes 180° rear wall left outer stacking foot cross member receptacle 156*a*; and 180° rear wall left inner stacking foot receptacle 154*b* includes 180° rear wall left inner stacking foot cross member receptacle 156*b*. Operation of the stacking feet and the receptacles will be discussed in greater detail below for both the 0° and 180° stacking orientations.

C. Right Side Wall 6

Referring to FIGS. 1, 4, 7, and 8, right side wall 6 includes an inner surface 20 and outer surface 22. Outer surface 22 includes tag holder 26, which, according to an exemplary embodiment of the present invention, can hold a radio frequency (RF) identification (RFID) tag (not shown). RFID tags are well known to those of ordinary skill in the art, and detailed discussion of them has been omitted for the purpose of brevity. Tag holder 26 preferably comprises a recessed area from front wall outer surface 22, is substantially rectangular, and further comprises a plurality of mounting holes 27*a, b*. Right side wall 6 further includes top surface 24. Two pairs of stacking feet are located on both sides of right side wall 6, on outer surface 22; a first pair are located a short distance from front wall 4 and a second pair are located a short distance from rear wall 8. Located adjacent to front wall 4 of right side wall 6 are right side wall left outer stacking foot 38*a*, and right side wall left inner stacking foot 38*b*. Located adjacent to rear wall 8 of right side wall 6 are right side wall right outer stacking foot 44*a*, and right side wall right inner stacking foot 44*b*.

Each of the stacking feet comprise certain common characteristic components. Right side wall right outer stacking foot 44*a* comprises right side wall rear outer stacking foot flat portion 45*a*, right side wall rear outer stacking foot cross member 46*a*, and right side wall rear outer stacking foot sloped surface 47*a*. Right side wall right inner stacking foot 44*b* comprises right side wall rear inner stacking foot flat portion 45*b*, right side wall rear inner stacking foot cross member 46*b*, and right side wall rear inner stacking foot sloped surface 47*b*. Right side wall left outer stacking foot 38*a* comprises right side wall front outer stacking foot flat portion 39*a*, right side wall front outer stacking foot cross member 40*a*, and right side wall front outer stacking foot sloped surface 41 *a*. Right side wall left inner stacking foot 38*b* comprises right side wall front inner stacking foot flat portion 39*b*, right side wall front inner stacking foot cross member 40*b*, and right side wall front inner stacking foot sloped surface 41*b*.

Figure 4:
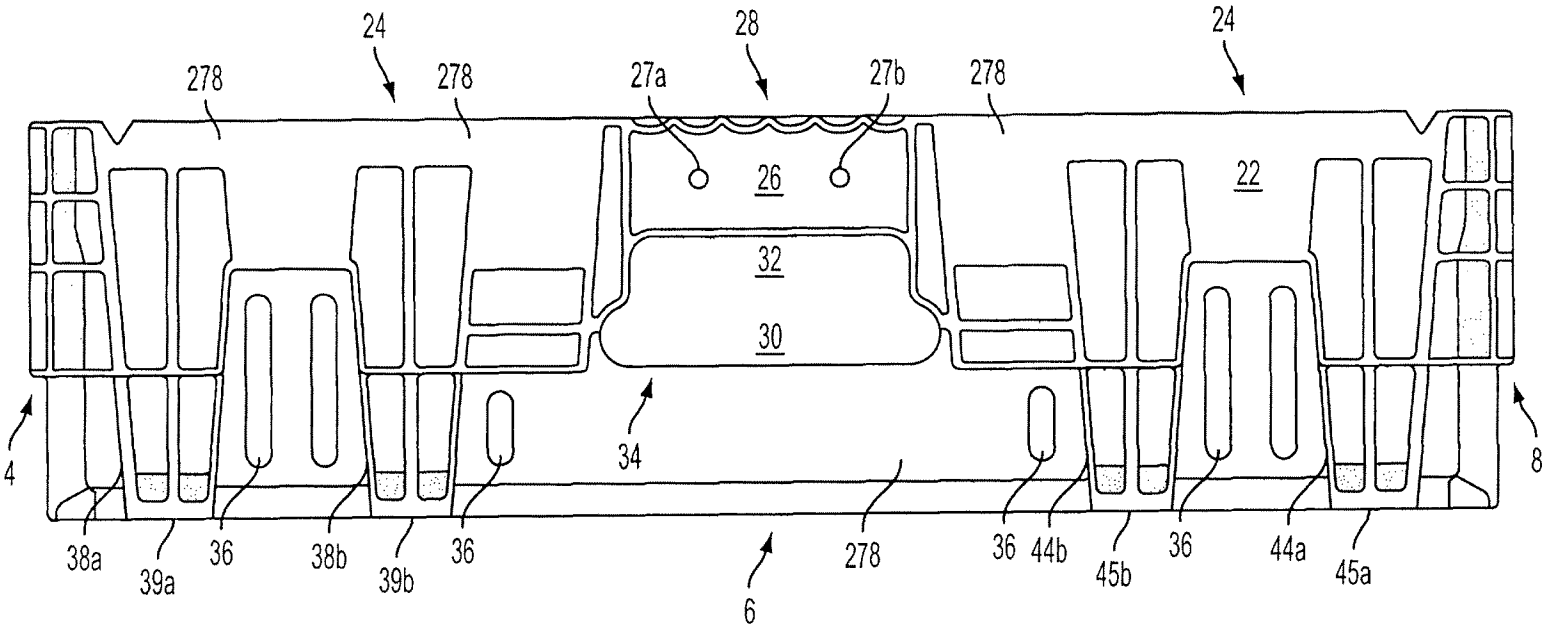
FIG. 4 is a right side view of the tray shown in FIG. 1 illustrating a first handle having scalloped finger recesses along an upper surface of the tray, and further having an elongated, generally rectangular shaped horizontal bottom portion, with substantially circular or oval shaped end portions.
Figure 5:
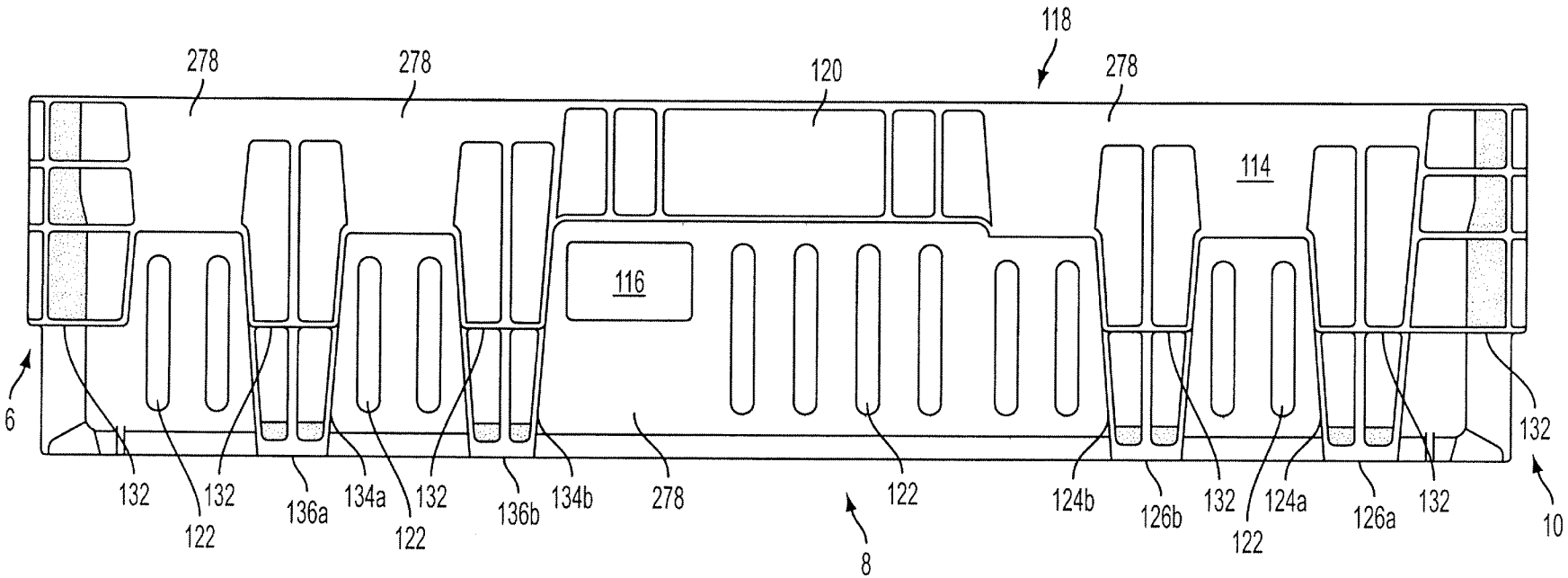
FIG. 5 is a rear view of the tray shown in FIG. 1.
Figure 6:
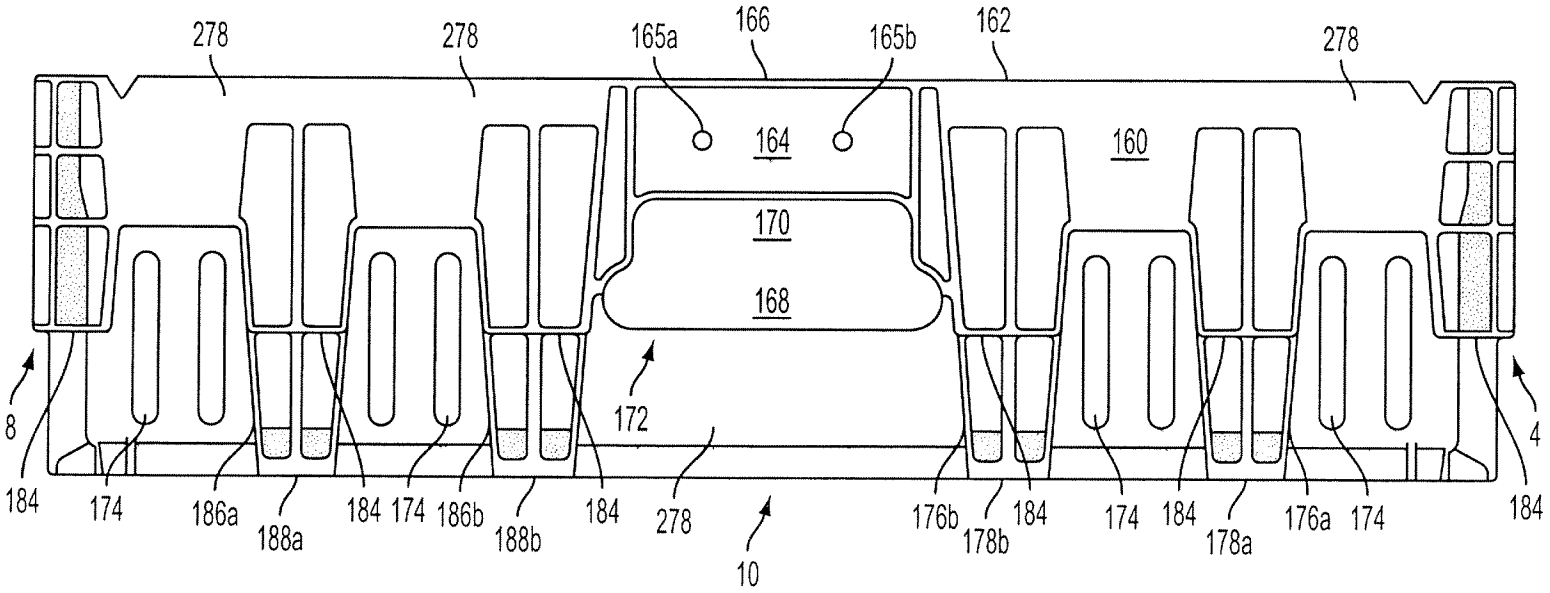
FIG. 6 is a left side view of the tray shown in FIG. 1 illustrating a second handle having an elongated, generally rectangular shaped horizontal bottom portion, with substantially circular or oval shaped end portions.

Furthermore, right side wall 6 comprises 180° stacking ledge 42 that sits upon upper surface 162 of left side wall 10 when upper tray 100' is stacked in a 180° stacking orientation on lower tray 100 (as shown in FIG. 41). As can be seen in the above referenced drawings, right side wall 6, and its components, are substantially wider than conventional trays because of the significant amount of weight tray 100 is designed to carry. Right side wall 6 further comprises ventilation slots 36, to provide air flow through tray 100, especially when upper trays 100', 100" and so on are stacked upon lower tray 100. Right side wall 6 further includes right side wall handle 34, which includes right side wall handle opening lower 30 and right side wall handle opening upper 32. Right side wall handle opening lower 30 provides a location for a user to place the hook end of tray retrieving tool 276, as shown in FIG. 39. By incorporating similar structures on all four walls, it is much easier for users to pull tray 100 off other trays or from a tray cleaning area. Located above right side wall handle opening upper 32, on an upper surface of right side wall 6 are scalloped surfaces 28, which extend from top surface 24 of right side wall 6 to a point just above where right side wall handle opening upper 32 ends on inner surface 20 of right side wall 6, as shown in FIGS. 1, 4 and 7. Scalloped surfaces 28 provide a substantially easier means for a user to grip tray 100, and also provides a means for a user to determine, at a quick glance, which way tray 100 is oriented, because it is the only surface area of tray 100 that has that unique scallop design.

Located on inner surface 20 of right side wall 6 are receptacles for 0° and 180° stacking. Two pairs of stacking receptacles (a pair of 0° stacking receptacles, and a pair of 180° stacking receptacles) are located on inner surface 20 on the left side of right side wall 6, and two pairs of stacking receptacles (a pair of 0° stacking receptacles, and a pair of 180° stacking receptacles) are located on inner surface 20 of the right side of right side 6. Located at the right side of right side wall 6 (as viewed from the interior of tray 100) are 0° right side wall front outer stacking foot receptacle 48*a*, and 0° right side wall front inner stacking foot receptacle 48*b*. Between 0° right side wall front outer stacking foot receptacle 48*a* and 0° right side wall front inner stacking foot receptacle 48*b* is 180° right side wall front outer stacking foot receptacle 60*a*, and to the left of 48*b* is 180° right side wall front inner stacking foot receptacle 60*b* (as viewed from inside tray 100). Located at the left side of right side wall 6 (as viewed from the interior of tray 100) are 0° right side wall rear outer stacking foot receptacle 52*a*, and 0° right side wall rear inner stacking foot receptacle 52*b*. Between 0° right side wall rear outer stacking foot receptacle 52*a* and 0° right side wall rear inner stacking foot receptacle 52*b* is 180° right side wall rear outer stacking foot receptacle 56*a*, and to the right of 0° right side wall rear inner stacking foot receptacle 52*b* is 180° right side wall rear inner stacking foot receptacle 56*b* (as viewed from inside tray 100).

As shown in FIG. 7, 0° right side wall front outer stacking foot receptacle 48*a* includes 0° right side wall front outer stacking foot cross member receptacle 50*a*; 0° right side wall front inner stacking foot receptacle 48*b* includes 0° right side wall front inner stacking foot cross member receptacle 50*b*; 180° right side wall front outer stacking foot receptacle 60*a* includes 180° right side wall front outer stacking foot cross member receptacle 62*a*; and 180° right side wall front inner stacking foot receptacle 60*b* includes 180° right side wall front inner stacking foot cross member receptacle 62*b*. Also as shown in FIG. 7, 0° right side wall rear outer stacking foot receptacle 52*a* includes 0° right side wall rear outer stacking foot cross member receptacle 54*a*; 0° right side wall rear inner stacking foot receptacle 52*b* includes 0° right side wall rear inner stacking foot cross member receptacle 54*b*; 180° right side wall rear outer stacking foot receptacle 56*a* includes 180° right side wall rear outer stacking foot cross member receptacle 58*a*; and 180° right side wall rear inner stacking foot receptacle 56*b* includes 180° right side wall rear inner stacking foot cross member receptacle 58*b*. Operation of the stacking feet and the receptacles will be discussed in greater detail below for both the 0° and 180° stacking orientations.

D. Left Side Wall 10

Referring to FIGS. 1, 6, 7, and 8, left side wall 10 includes an inner surface 158 and outer surface 160. Outer surface 22 includes tag holder 164, which, according to an exemplary embodiment of the present invention, can hold a radio frequency (RF) identification (RFID) tag (not shown). RFID tags are well known to those of ordinary skill in the art, and detailed discussion of them has been omitted for the purpose of brevity. Tag holder 164 preferably comprises a recessed area from front wall outer surface 160, is substantially rectangular, and further comprises a plurality of mounting holes 165*a, b*. Left side wall 10 further includes top surface 162. Two pairs of stacking feet are located on both sides of left side wall 10, on outer surface 160; a first pair located a short distance from rear wall 8 and a second pair located a short distance from front wall 4. Located to the left side of left side wall 10 are left side wall left outer stacking foot 186*a*, and left side wall left inner stacking foot 186*b*. Located to the right of left side wall 10 are left side wall right outer stacking foot 176*a*, and left side wall right inner stacking foot 176*b*.

Each of the stacking feet comprise certain common characteristic components. Left side wall right outer stacking foot 176*a* comprises left side wall front outer stacking foot flat portion 178*a*, left side wall front outer stacking foot cross member 180*a*, and left side wall front outer stacking foot sloped surface 182*a*. Left side wall right inner stacking foot 176*b* comprises left side wall front inner stacking foot flat portion 178*b*, left side wall front inner stacking foot cross member 180*b*, and left side wall front inner stacking foot sloped surface 182*b*. Left side wall rear outer stacking foot 186*a* comprises left side wall rear outer stacking foot flat portion 188*a*, left side wall rear outer stacking foot cross member 190*a*, and left side wall rear outer stacking foot sloped surface 192*a*. Left side wall rear inner stacking foot 186*b* comprises left side wall rear inner stacking foot flat portion 188*b*, left side wall rear inner stacking foot cross member 190*b*, and left side wall rear inner stacking foot sloped surface 192*b*.

Furthermore, left side wall 10 comprises 180° stacking ledge 184 that sits upon upper surface 24 of right side wall 6 when upper tray 100' is stacked in a 180° stacking orientation on lower tray 100 (as shown in FIG. 41). As can be seen in the above referenced drawings, left side wall 10, and its components, are substantially wider than conventional trays because of the significant amount of weight tray 100 is designed to carry. Left side wall 10 further comprises ventilation slots 174, to provide air flow through tray 100, especially when upper trays 100', 100" and so on are stacked upon lower tray 100. Left side wall 10 further includes left side wall handle 172, which includes left side wall handle opening lower 168 and left side wall handle opening upper 170. Left side wall handle opening lower 168 provides a location for a user to place the hook end of tray retrieving tool 276, as shown in FIG. 39. By incorporating similar structures on all four walls, it is much easier for users to pull tray 100 off other trays or from a tray cleaning area.

Located on inner surface 158 of left side wall 10 are receptacles for 0° and 180° stacking. Two pairs of stacking receptacles (a pair of 0° stacking receptacles, and a pair of 180° stacking receptacles) are located on inner surface 158 on the left side of left side wall 10, and two pairs of stacking receptacles (a pair of 0° stacking receptacles, and a pair of 180° stacking receptacles) are located on inner surface 158 of the right side of left side wall 10. Located adjacent to rear wall 8 of left side wall 10 (as viewed from the interior of tray 100) are 180° left side wall rear outer stacking foot receptacle 206*a*, and 180° left side wall rear inner stacking foot receptacle 206*b*. Between 180° left side wall rear outer stacking foot receptacle 206*a* and 180° left side wall rear inner stacking foot receptacle 206*b* is 0° left side wall rear outer stacking foot receptacle 198*a*, and to the left of 180° left side wall rear inner stacking foot receptacle 206*b* is 0° left side wall rear inner stacking foot receptacle 198*b* (as viewed from inside tray 100). Located adjacent to front wall 4 of left side wall 10 (as viewed from the interior of tray 100) are 180° left side wall front outer stacking foot receptacle 202*a*, and 180° left side wall front inner stacking foot receptacle 202*b*. Between 180° left side wall front outer stacking foot receptacle 202*a* and 180° left side wall front inner stacking foot receptacle 202*b* is 0° left side wall front outer stacking foot receptacle 194*a*, and to the right of 180° left side wall front inner stacking foot receptacle 202*b* is 0° left side wall front inner stacking foot receptacle 194*b* (as viewed from inside tray 100).

As shown in FIG. 7, 180° left side wall rear outer stacking foot receptacle 206*a* includes 180° left side wall rear outer stacking foot cross member receptacle 208*a*; 180° left side wall rear inner stacking foot receptacle 206*b* includes 180° left side wall rear inner stacking foot cross member receptacle 208*b*; 0° left side wall rear outer stacking foot receptacle 198*a* includes 0° left side wall rear outer stacking foot cross member receptacle 200*a*; and 0° left side wall rear inner stacking foot receptacle 198*b* includes 0° left side wall rear inner stacking foot cross member receptacle 200*b*. Also as shown in FIG. 7, 180° left side wall front outer stacking foot receptacle 202*a* includes 180° left side wall front outer stacking foot cross member receptacle 204*a*; 180° left side wall front inner stacking foot receptacle 202*b* includes 180° left side wall front inner stacking foot cross member receptacle 204*b*; 0° left side wall front outer stacking foot receptacle 194*a* includes 0° left side wall front outer stacking foot cross member receptacle 196*a*; and 0° left side wall front inner stacking foot receptacle 194*b* includes 0° left side wall front inner stacking foot cross member receptacle 196*b*. Operation of the stacking feet and the receptacles will be discussed in greater detail below for both the 0° and 180° stacking orientations.

E. Base 2

Reference is made to FIGS. 1, 2, 7, and 8 for a description of base 2. As shown in FIGS. 1, 2, 7, and 8, base 2 comprises an essentially uniform solid base, but further includes several drain holes 16 alongside front wall 4, right side wall 6, rear wall 8 and left side wall 10. Base 2 further includes center drain hole 17. Base 2 includes an upper surface 12, and a lower surface 14. Further, lower surface 14 of base 2 includes a plurality of ribs to form a substantially strong base structure, for carrying additional weight due to the type of baked products to be carried in tray 100. According to an exemplary embodiment of the present invention, base 2 further comprises a plurality of drain channels, 18*a-d*, which are described in greater detail below. Drain channels 18*a-d* provide a mechanism to drain water following washing of tray 100. According to an exemplary embodiment of the present invention, base 2 still further includes a plurality of left side spacer holes 214*a-c*, and right side spacer holes 216*a-c*. Preferably, spacer holes 214, 216 provide means to retain optional left and right spacers 210, 212 that can be used to change the interior dimensions of tray 100 to carry different types of product. Spacers 210, 212 will be described in greater detail below.

F. Spacers 210, 212

Figure 9:
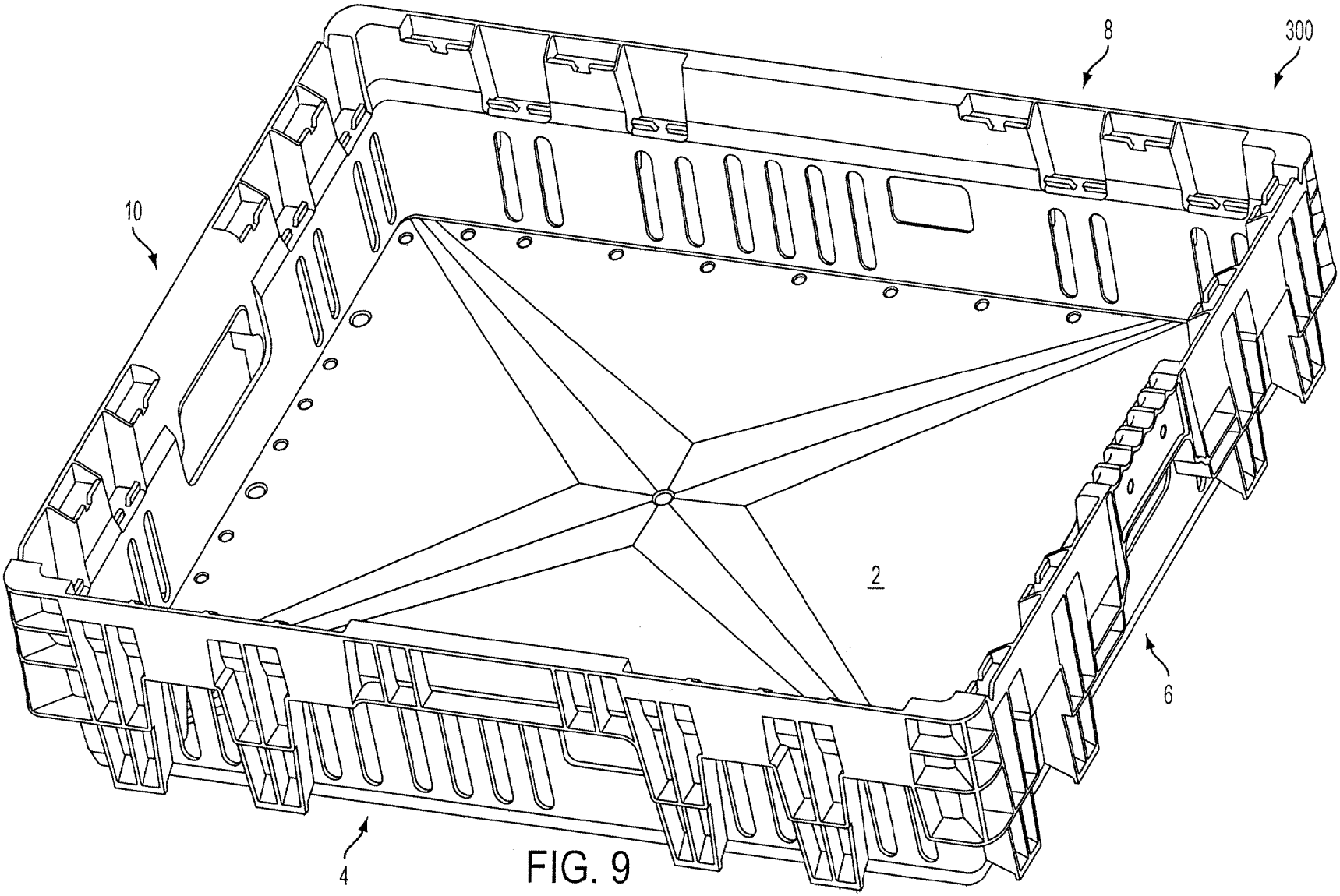
FIG. 9 is a front perspective view of a nestable, stackable food tray (tray) with substantially vertical walls, interlocking recesses on the sidewalls for zero degree and 180 degree stacking of a second like container, and a first and second handle, according to an alternative embodiment of the present invention.
Figure 10:
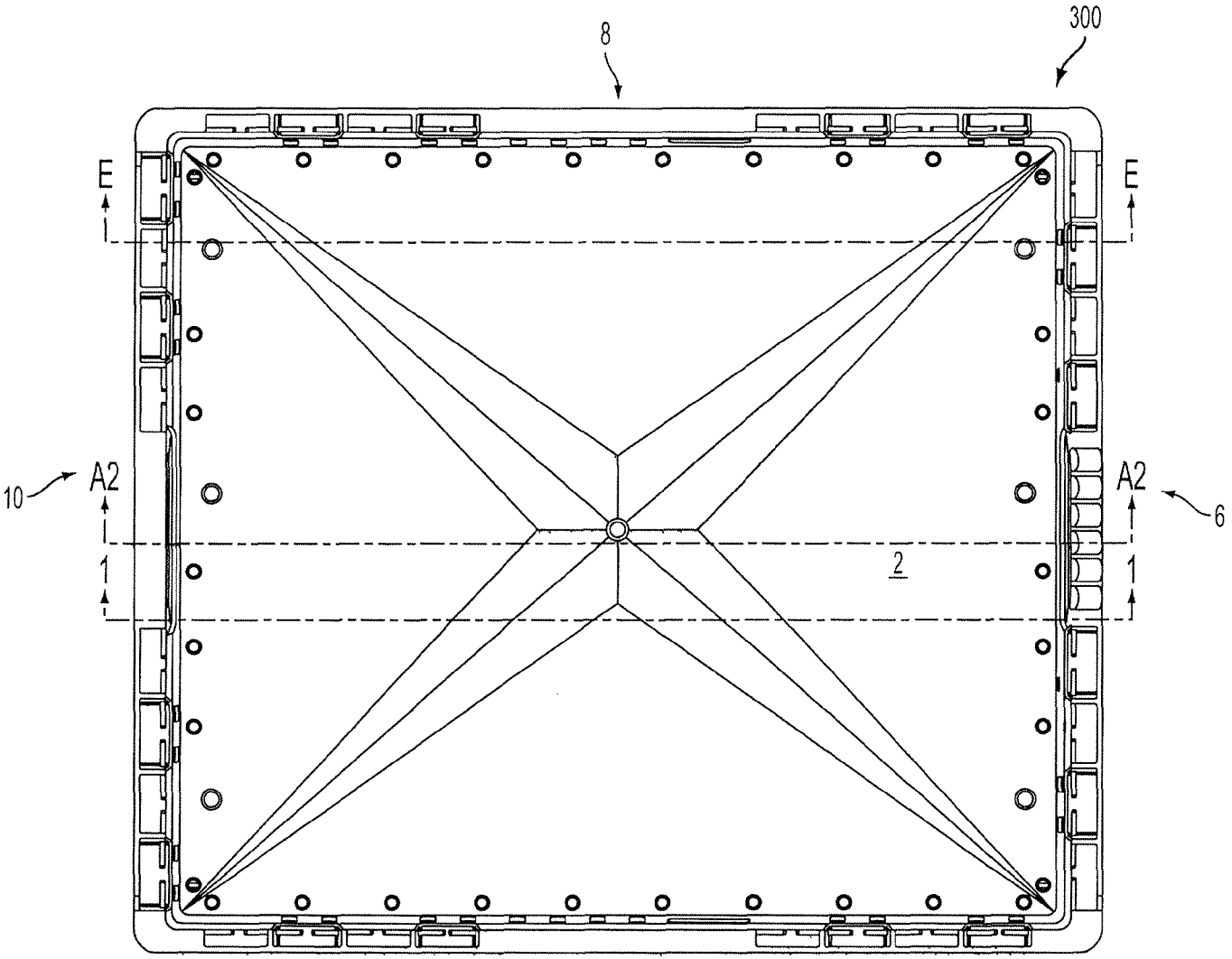
FIG. 10 is a top view of the tray shown in FIG. 9 illustrating a plurality of fanned drain channels, comprising a general star shape, on an upper surface of a substantially solid base surface of the tray.
Figure 11:
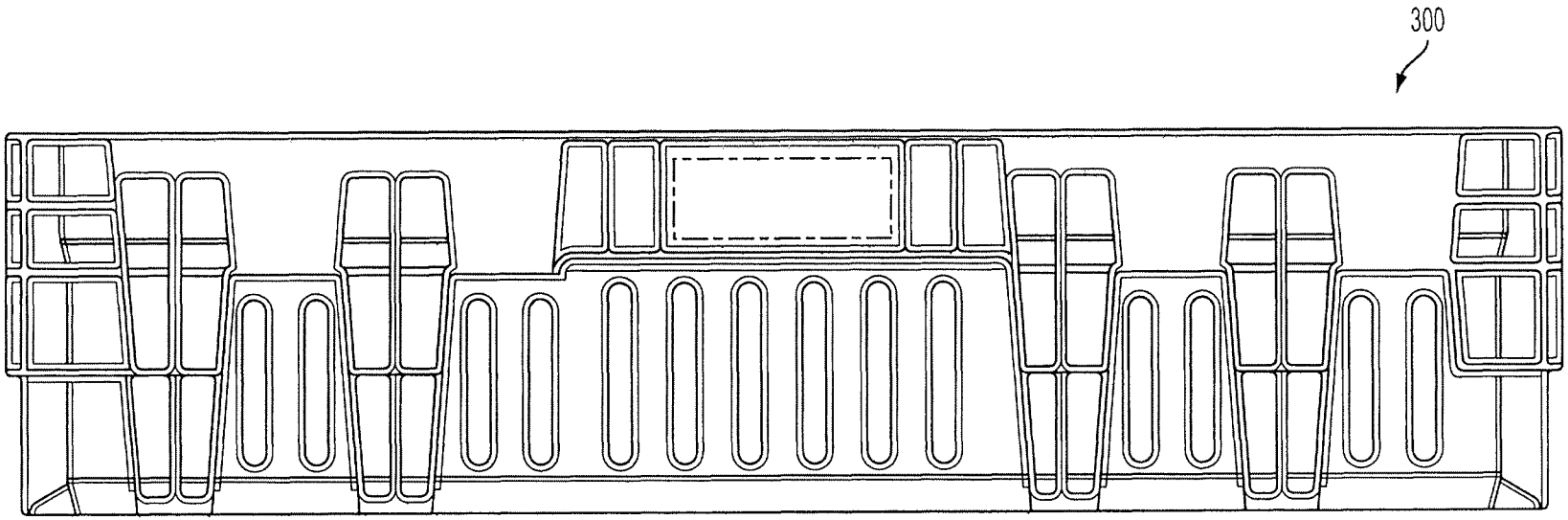
FIG. 11 is a front view of the tray shown in FIG. 9.
Figure 12:
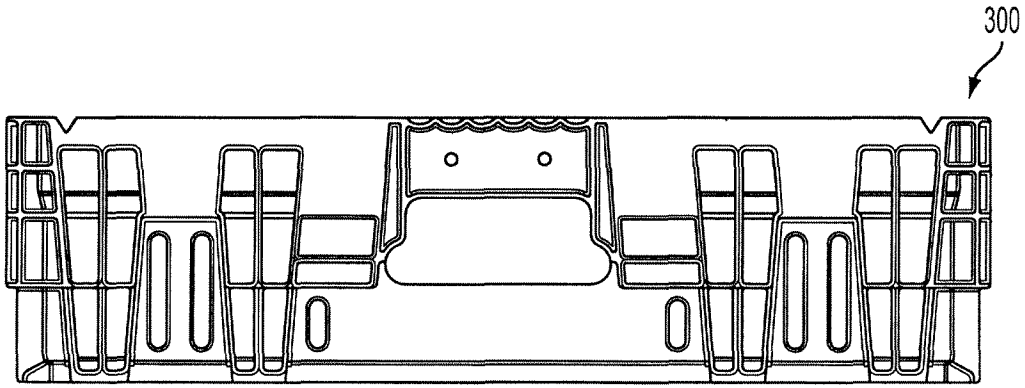
FIG. 12 is a right side view of the tray shown in FIG. 9 illustrating the first handle having scalloped finger recesses along an upper surface of the tray, and further having an elongated, generally rectangular shaped horizontal bottom portion, with substantially circular or oval shaped end portions.
Figure 13:
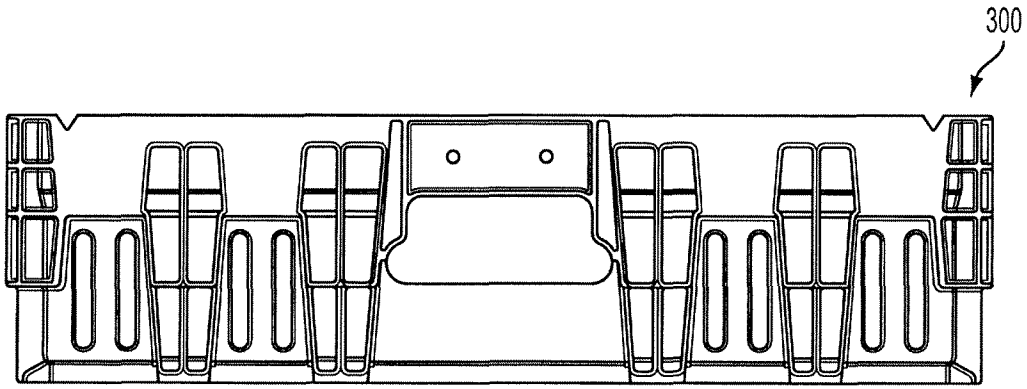
FIG. 13 is a left side view of the tray shown in FIG. 9 illustrating the second handle having an elongated, generally rectangular shaped horizontal bottom portion, with substantially circular or oval shaped end portions.
Figure 14:
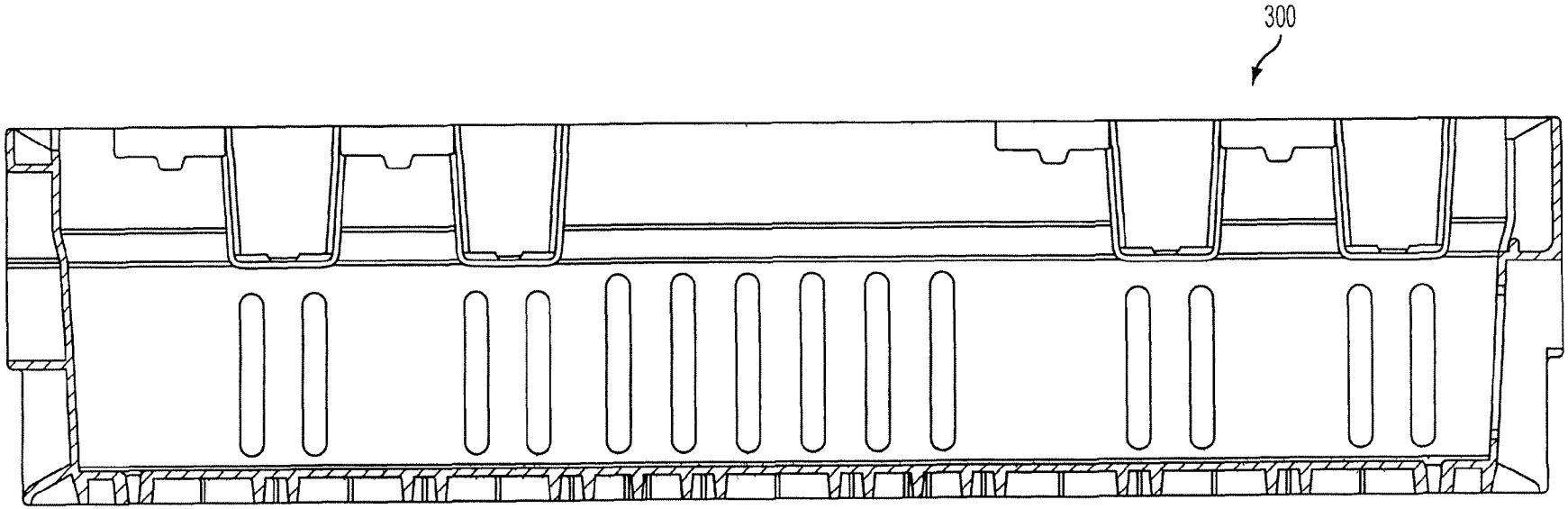
FIG. 14 is a cross sectional view of the tray shown in FIG. 9, along line E-E as shown in FIG. 10, illustrating a cross section view of a stacking receptacle.
Figure 15:
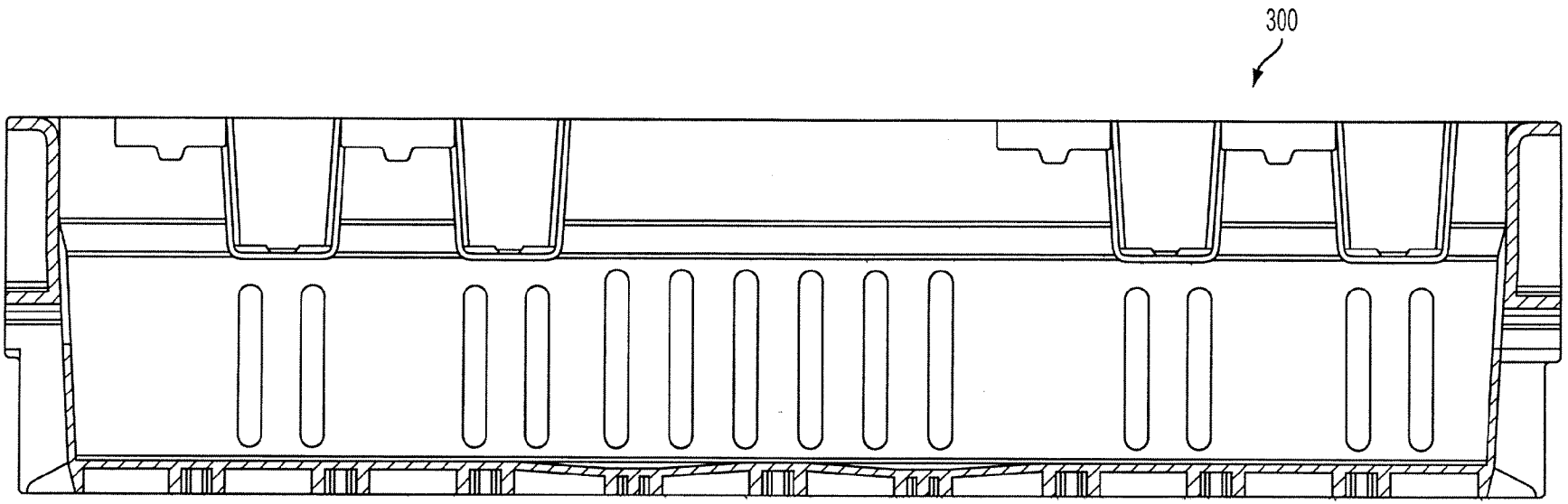
FIG. 15 is a cross sectional view of the tray shown in FIG. 9, along line 1-1 as shown in FIG. 10, illustrating a first portion of the scalloped finger recesses of the upper portion of the first handle.
Figure 16:
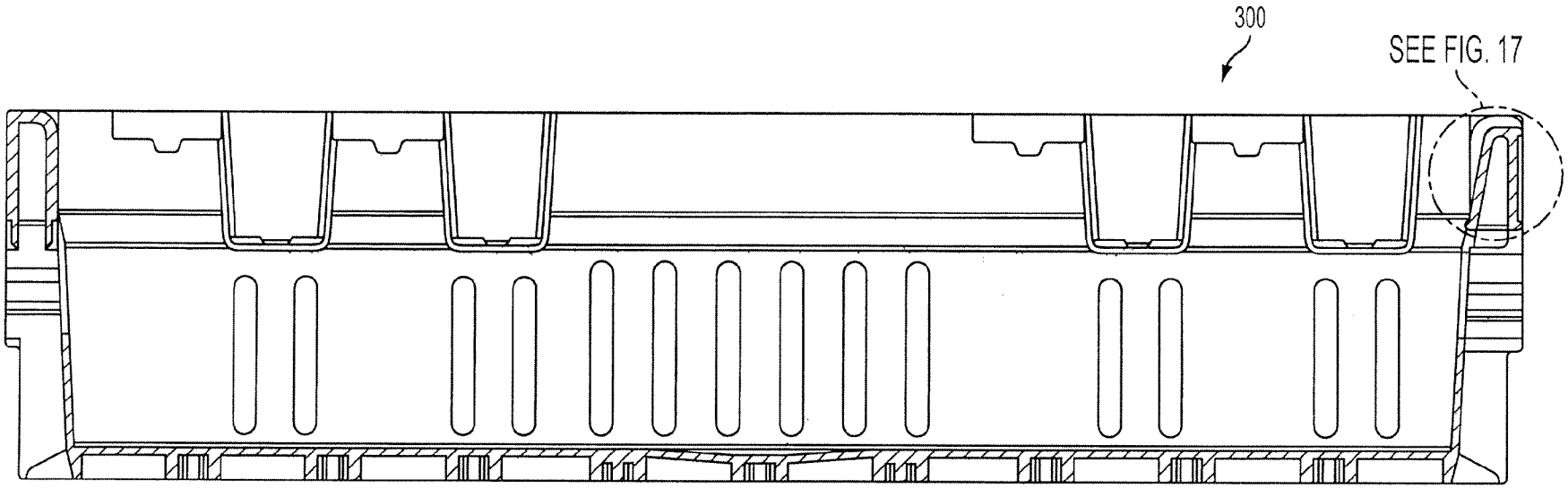
FIG. 16 is a cross sectional view of the tray shown in FIG. 9, along line A2-A2 as shown in FIG. 10, illustrating a second portion of the scalloped finger recesses of the upper portion of the first handle.
Figure 17:
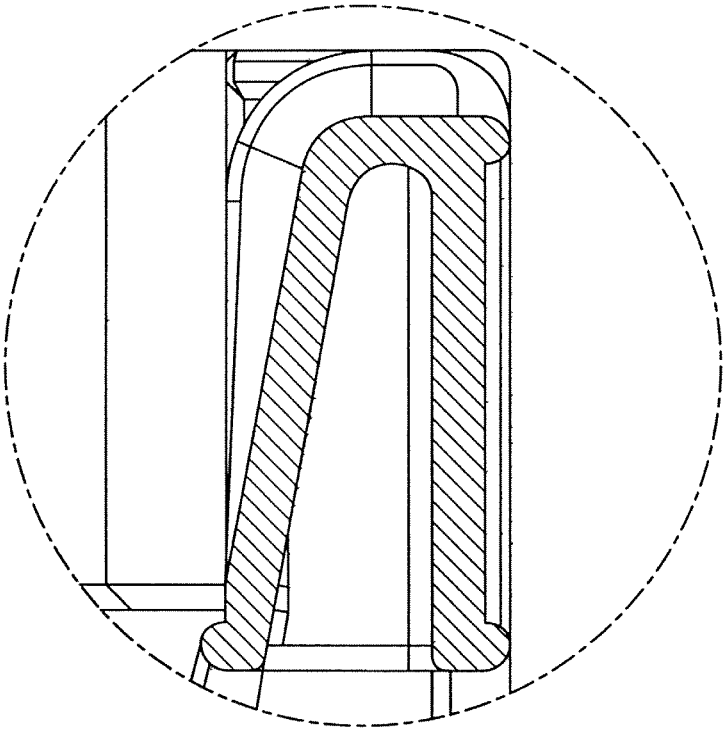
FIG. 17 is an expanded view of the tray shown in FIG. 9, illustrating an expanded cross sectional view of the scalloped handle as shown in FIG. 16.
Figure 18:
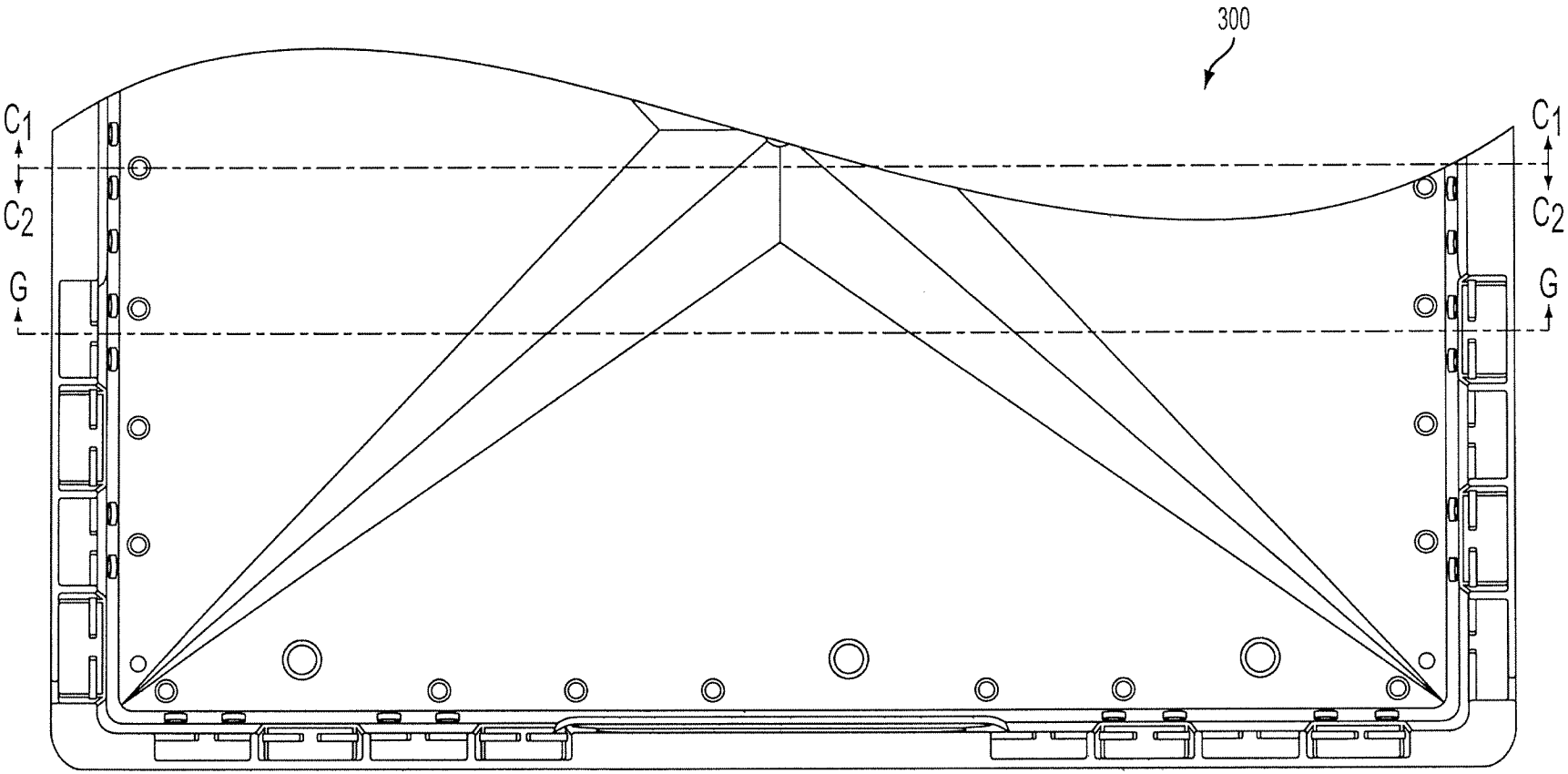
FIG. 18 is an expanded partial top view of the tray shown in FIG. 9.
Figure 19:
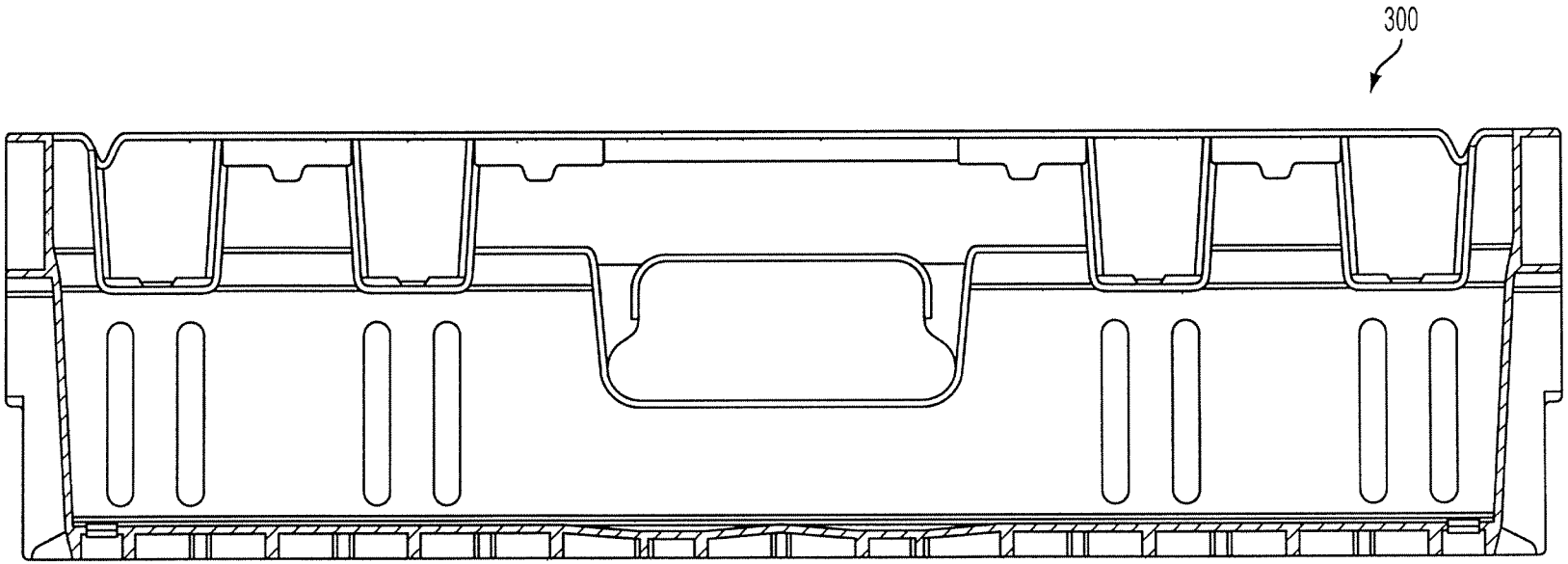
FIG. 19 is a cross sectional view of the tray shown in FIG. 9, along line C2-C2 as shown in FIG. 18, illustrating an interior view of the first handle.
Figure 20:
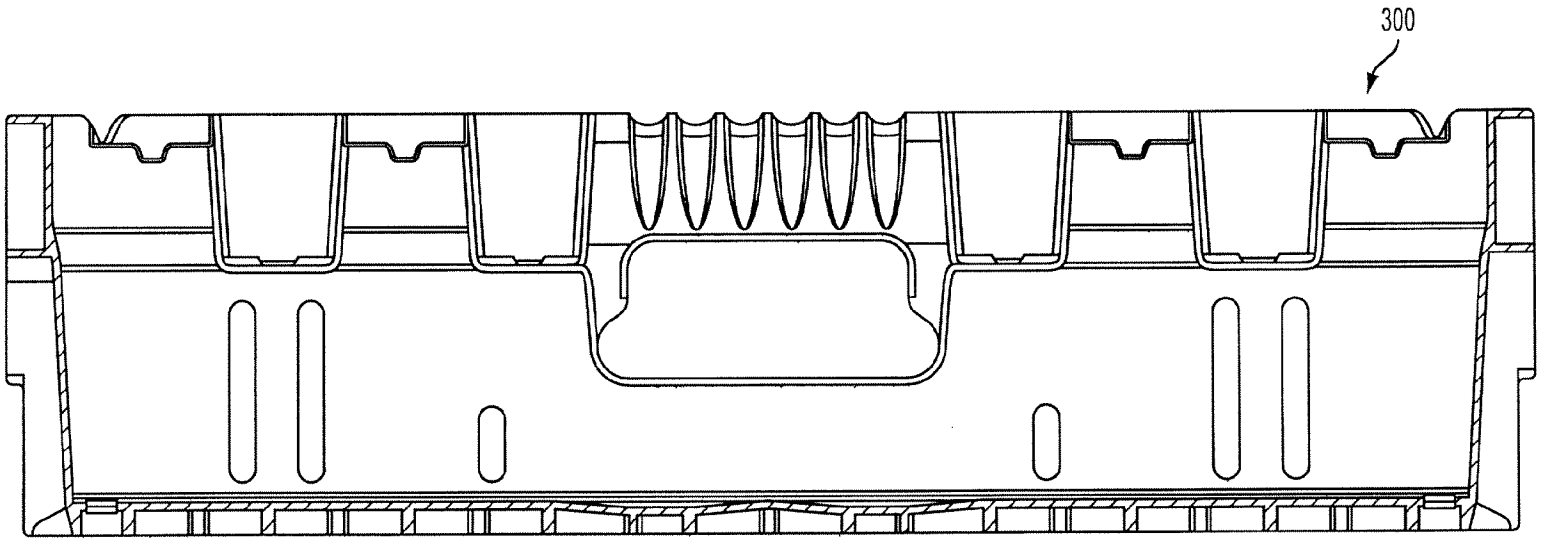
FIG. 20 is a cross sectional view of the tray shown in FIG. 9, along line C1-C1 as shown in FIG. 18, illustrating an interior view of the second handle.
Figure 21:
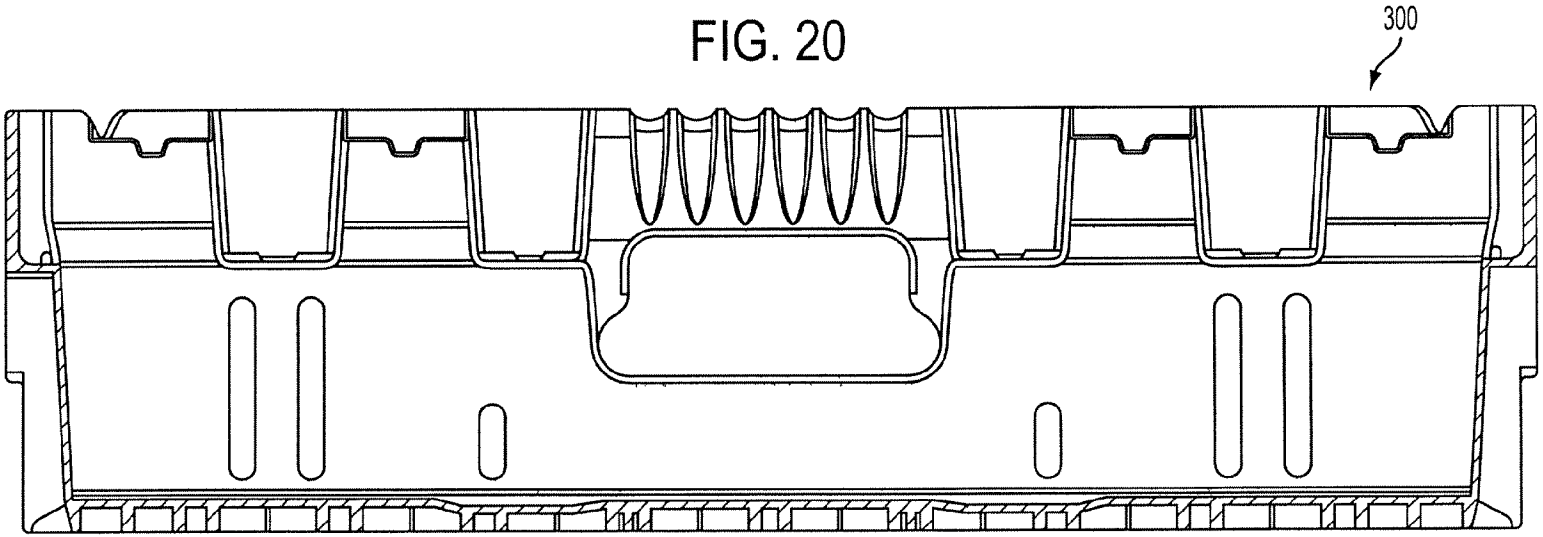
FIG. 21 is a cross sectional view of the tray shown in FIG. 9, along line G-G as shown in FIG. 18, illustrating a cross section view of a stacking receptacle.
Figure 22:
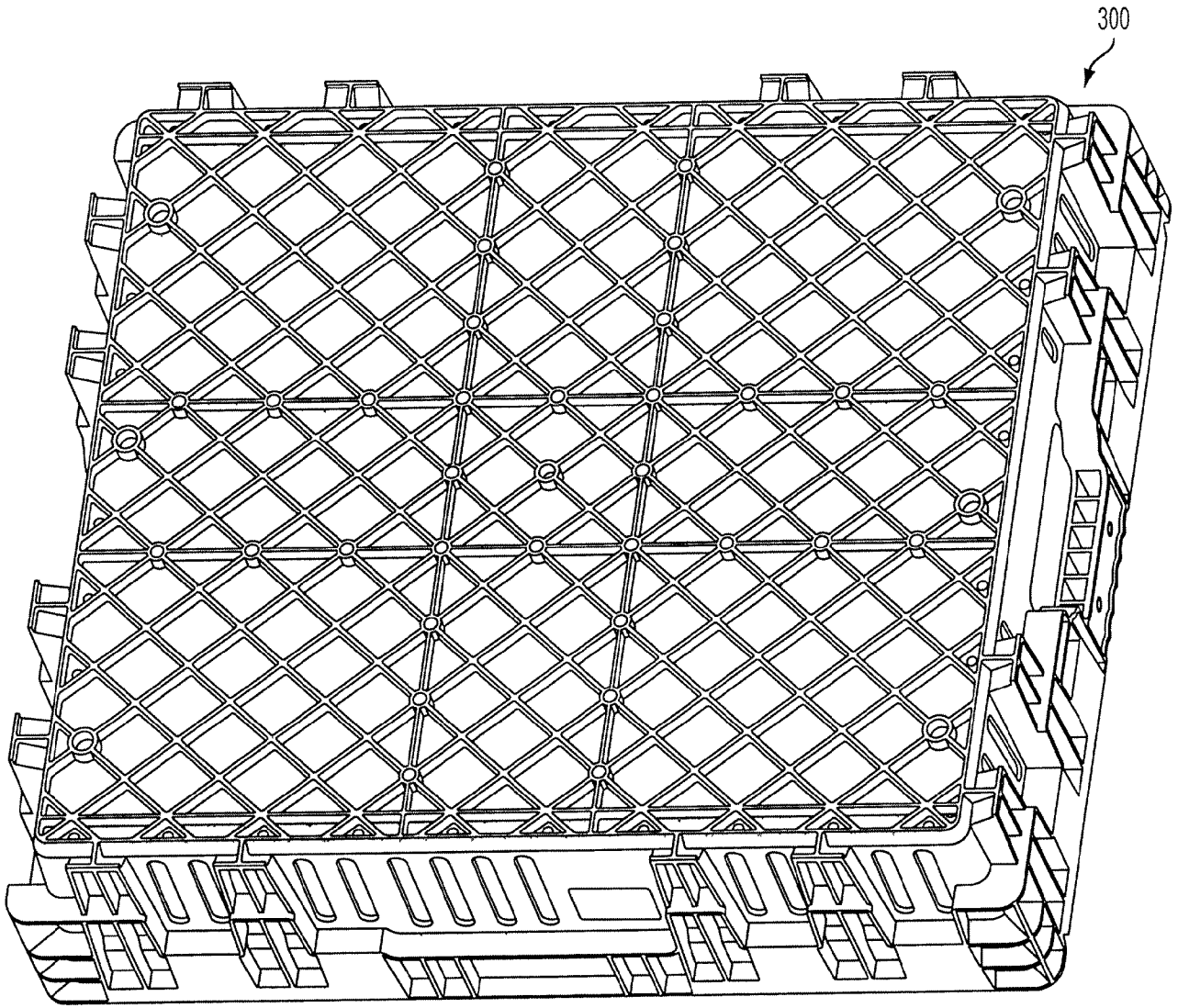
FIG. 22 is a bottom perspective view of the nestable, stackable food tray shown in FIG. 9.
Figure 23:
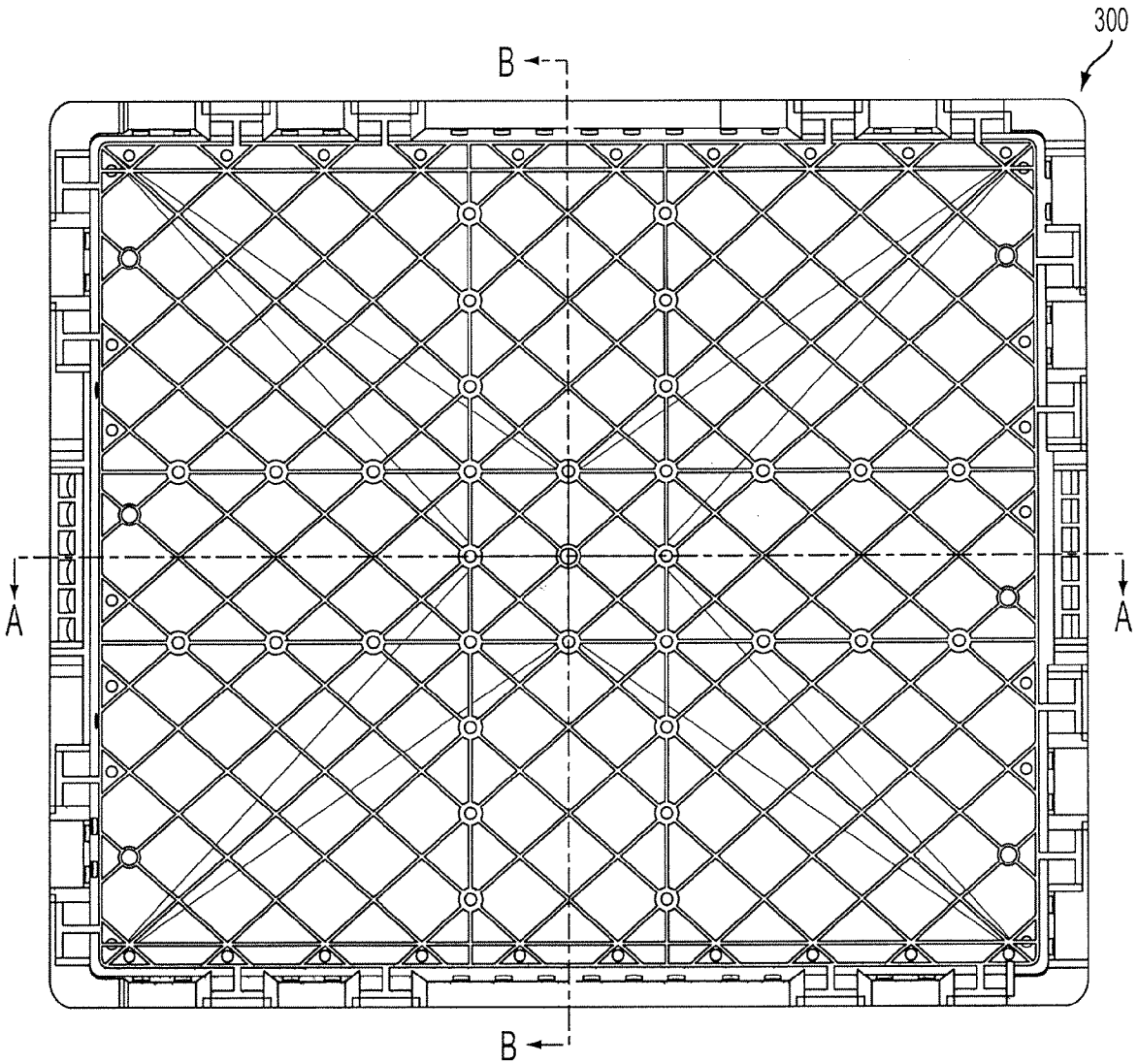
FIG. 23 is a bottom view of the tray shown in FIG. 9.
Figure 24:
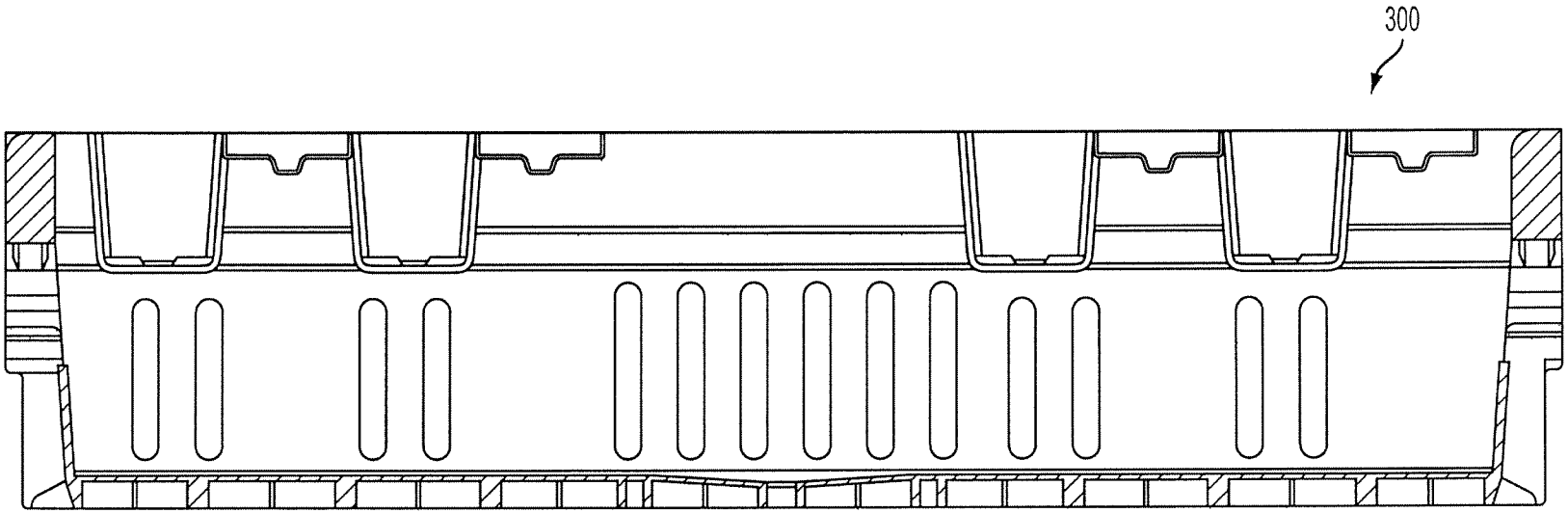
FIG. 24 is a cross sectional view of the tray shown in FIG. 9 along line A-A as shown in FIG. 23 illustrating a first cross-sectional view of a center drain hole portion and surrounding drain channels.
Figure 25:
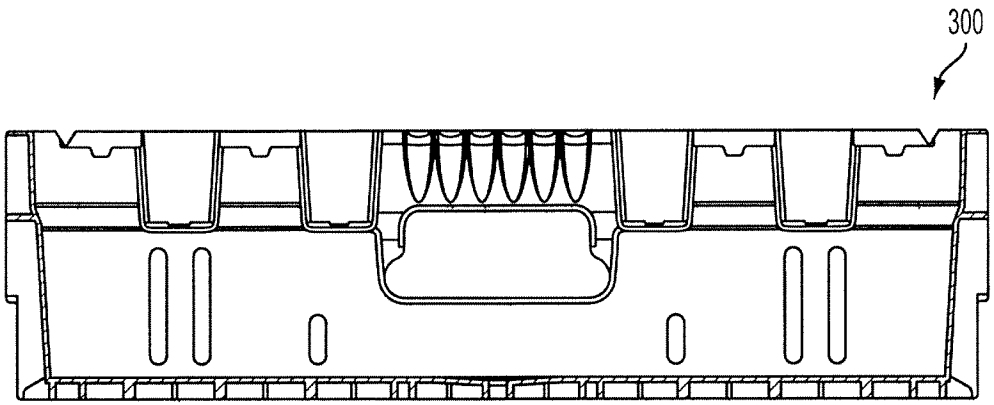
FIG. 25 is a cross sectional view of the tray shown in FIG. 9 along line B-B as shown in FIG. 23 illustrating a second cross-sectional view of a center drain hole portion and surrounding drain channels.
Figure 26:
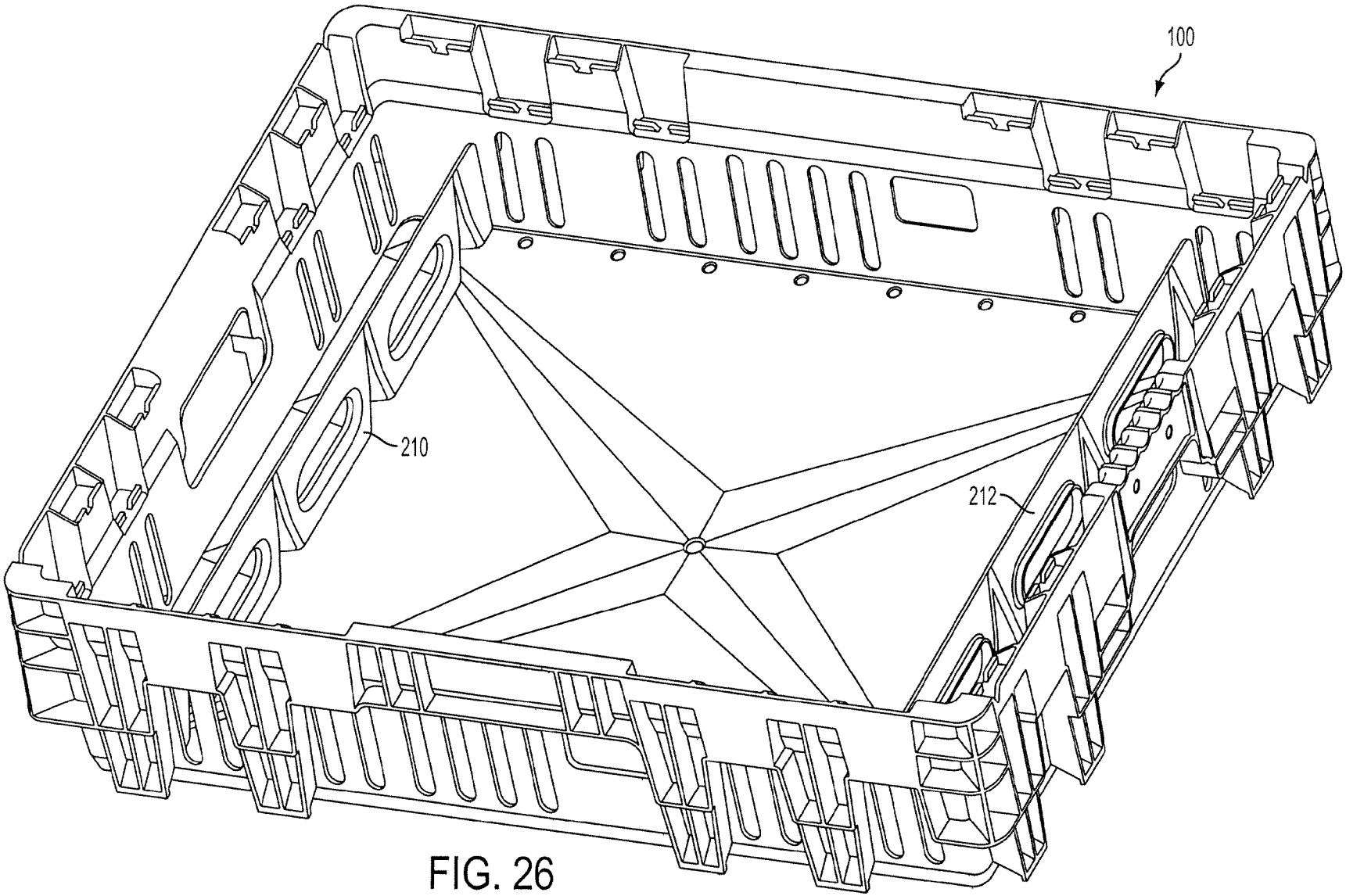
FIG. 26 is a top isometric view of the tray shown in FIG. 1 illustrating a plurality of spacers to contain different types of products substantially motion-free within the tray according to an additional embodiment of the invention.
Figure 27:
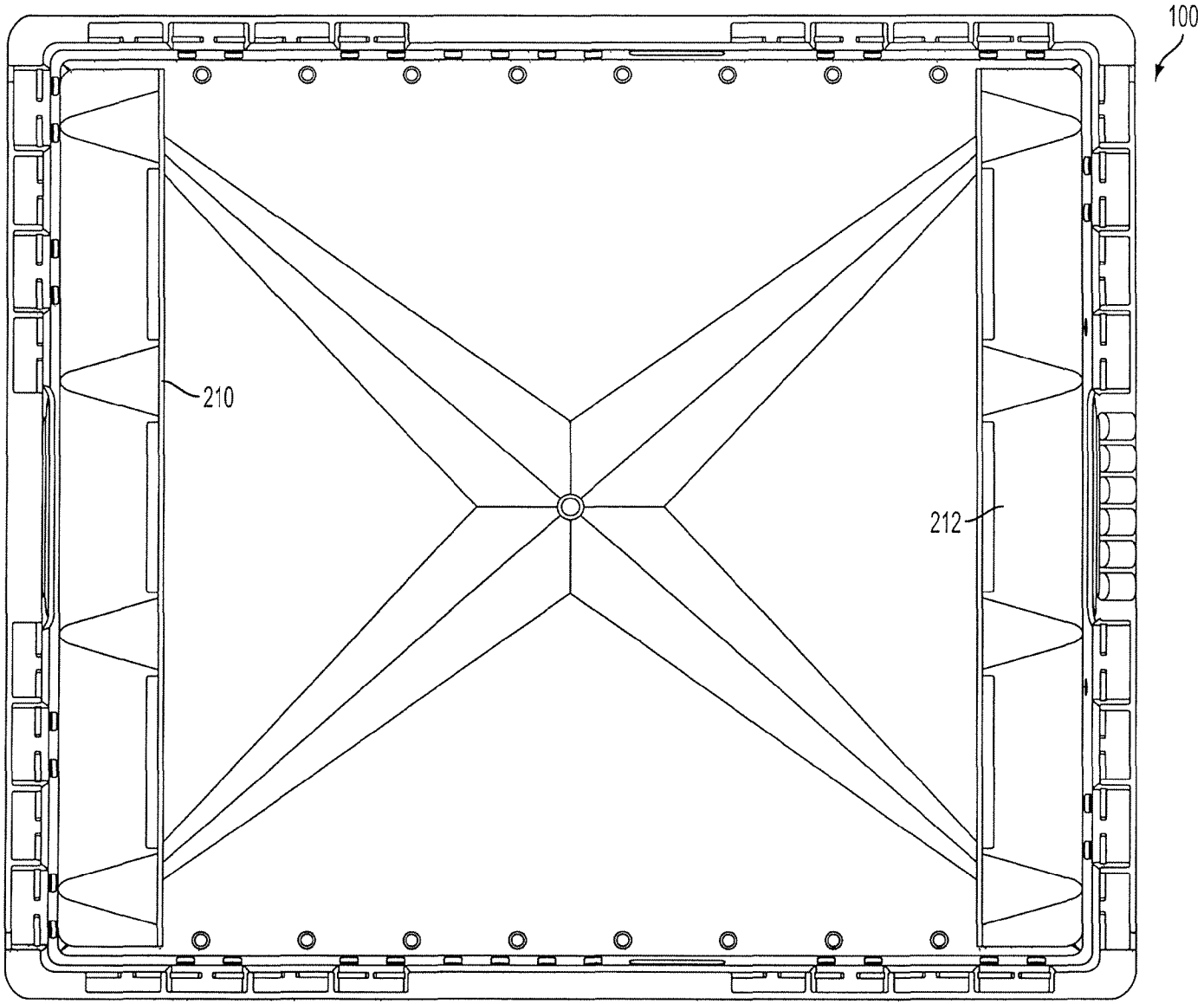
FIG. 27 is a top view of the tray shown in FIGS. 1 and 26.
Figure 28:
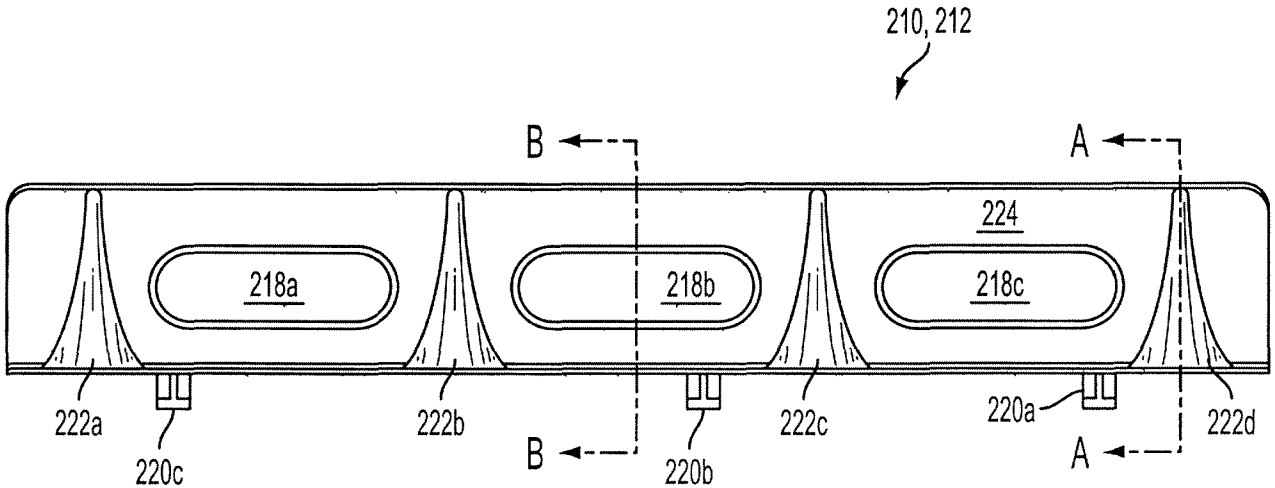
FIG. 28 is a front view of the spacer shown in FIG. 26, for use in the tray shown in FIGS. 1 and 9, to contain different types of products substantially motion-free according to an additional embodiment of the invention.
Figure 29:
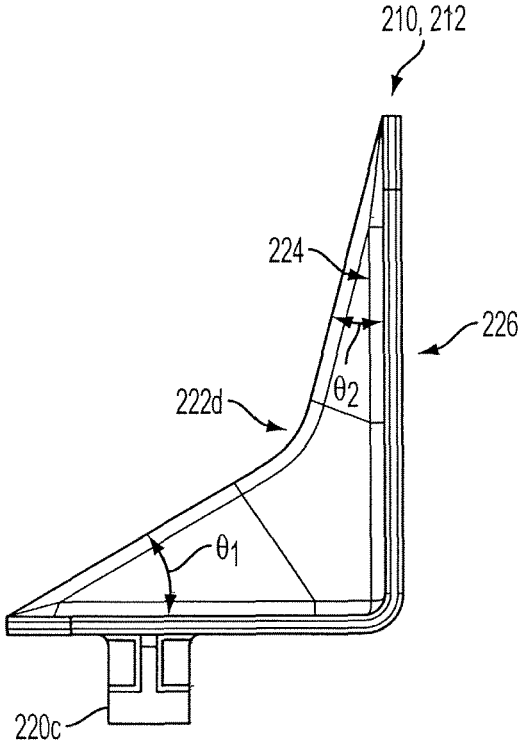
FIG. 29 is a right side view of the spacer shown in FIG. 26.
Figure 30:
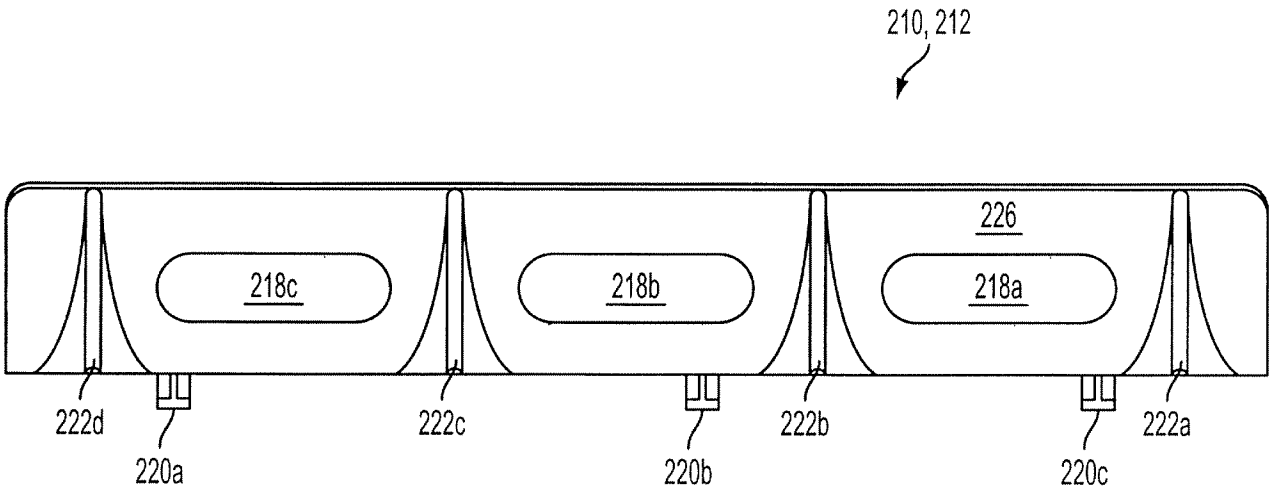
FIG. 30 is rear view of the spacer shown in FIG. 26.
Figure 31:
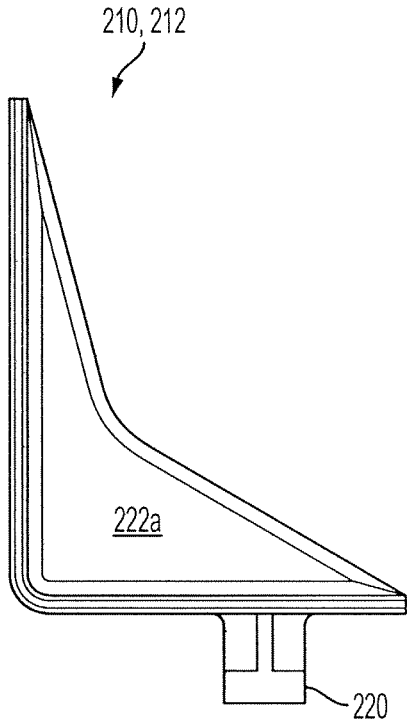
FIG. 31 is a left side view of the spacer shown in FIG. 26.
Figure 32:
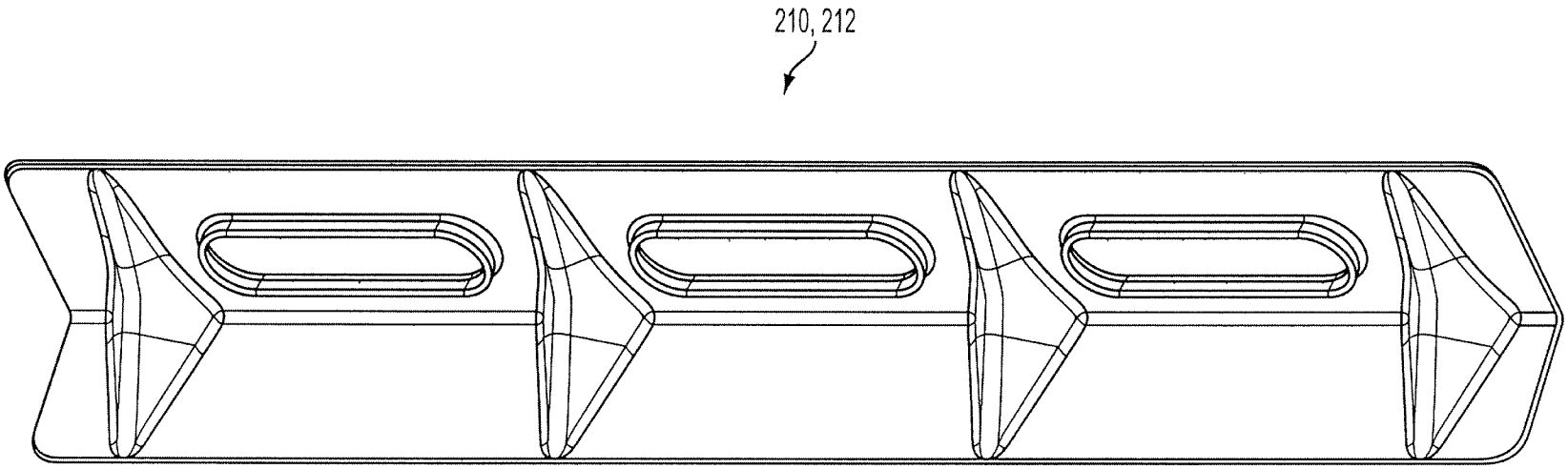
FIG. 32 is a top perspective view of the spacer shown in FIG. 26.
Figure 33:
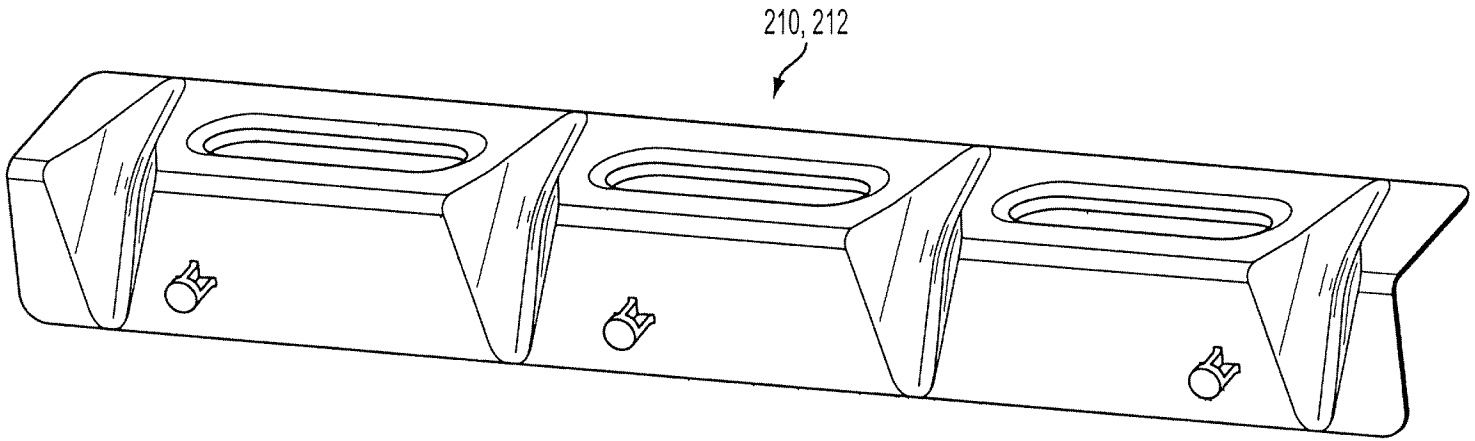
FIG. 33 is a bottom perspective view of the spacer shown in FIG. 26.
Figure 35:
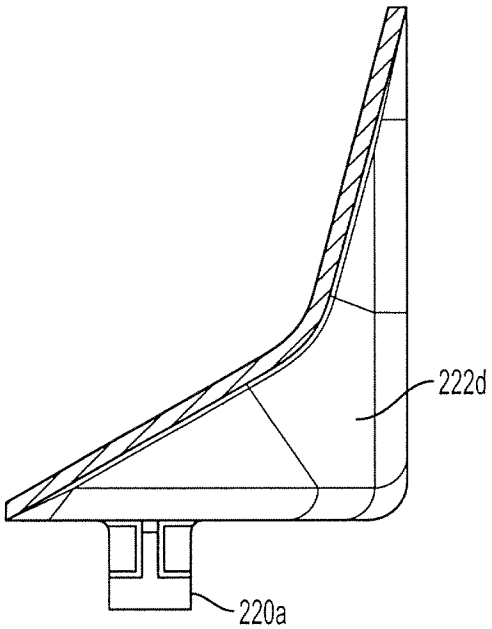
FIG. 35 is a cross sectional view of the spacer shown in FIG. 26, along line A-A shown in FIG. 28 illustrating an internal portion of the stiffener of the spacer.
Figure 34:
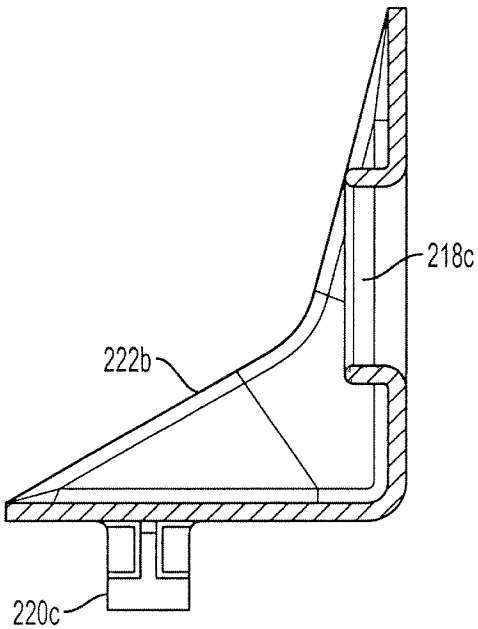
FIG. 34 is a cross sectional view of the spacer shown in FIG. 26, along line B-B shown in FIG. 28 illustrating a hole and a sloped surface of a stiffener of the spacer.

Referring to FIGS. 26-35, left and right spacers 210, 212 are illustrated in tray 100 according to an embodiment of the present invention. FIG. 26 is a top isometric view of the tray shown in FIG. 1 illustrating a plurality of spacers to contain different types of products substantially motion-free within tray 100 according to an additional embodiment of the invention; FIG. 27 is a top view of the tray shown in FIGS. 1 and 26; FIG. 28 is a front view of the spacer shown in FIG. 26, for use in the tray shown in FIGS. 1 and 9, to contain different types of products substantially motion-free according to an additional embodiment of the invention; FIG. 29 is a right side view of the spacer shown in FIG. 26; FIG. 30 is rear view of the spacer shown in FIG. 26; FIG. 31 is a left side view of the spacer shown in FIG. 26; FIG. 32 is a top perspective view of the spacer shown in FIG. 26; FIG. 33 is a bottom perspective view of the spacer shown in FIG. 26; FIG. 34 is a cross sectional view of the spacer shown in FIG. 26, along line B-B shown in FIG. 28 illustrating a hole and a sloped surface of a stiffener of the spacer; and FIG. 35 is a cross sectional view of the spacer shown in FIG. 26, along line A-A shown in FIG. 28 illustrating an internal portion of the stiffener of the spacer.

Spacers 210, 212 provide a means for users to change the interior dimensions of tray 100 so that it can be adapted to carry different types of products. Although FIGS. 26 and 27 illustrate both left spacer 210, and right spacer 212 in tray 100, this need not be the case as one of ordinary skill in the art of the present invention can appreciate. For example, only one of the spacers can be utilized if that provides the best fit for a certain type of product.

Spacers 210, 212 comprise a single piece of molded plastic, manufactured from the same or similar materials as tray 100. Spacers 210, 212 can further optionally include glossy free surfaces 278 as disuse above. Referring to FIGS. 28-35, spacers 210, 212 each comprise a plurality of spacer plugs 220*a-c* that fit within spacer holes 214, 216 as shown in FIGS. 7, 26 and 27. As one of ordinary skill in the art of the present invention can appreciate, for each spacer there is only one way the spacer can fit within spacer holes 214, 216 because of the spacing between the holes 214, 216 and the corresponding spacing of spacer plugs 220. Manufacturing spacers 210, 212 such that they can only be located within tray 100 in one orientation prevents a user from inadvertently placing spacers 210, 212 in tray 100 incorrectly (i.e., with spacer wall side facing the baked product, thereby damaging it). Spacers 210, 212 have a substantially vertical planar product side 226, which preferably faces the baked product being carried in tray 100. Spacers 210, 212 have several features that provide additional strength for retaining baked products within tray 100. Spacer stiffeners 222*a-c*, which can be seen in greater detail in FIGS. 29-35, provide a significant amount of strength to spacers 210, 212. As shown in FIG. 29, spacer stiffener 222*d* comprises a relatively thicker lower portion formed at an angle $\theta_1$ that is between about 25° and about 35°. According to a preferred embodiment of the present invention, $\theta_1$ is about 30°. Spacer stiffener 22*d* also comprises a relatively narrower upper portion that is formed at an angle $\theta_2$ between about 10° and 20°. According to a preferred embodiment of the present invention, $\theta_2$ is about 15°. As those of ordinary skill in the art of the present invention can appreciate, however, spacers 210, 212 can be shaped differently, yet still function as effectively. For example, the particular shape shown in FIG. 29 optimizes the strength of spacers 210, 212, yet minimizes the amount of plastic used in manufacturing spacer s210, 212.

Referring to FIGS. 29-35 in general, but especially FIG. 34, which is a cross sectional view along lines B-B as shown in FIG. 28, spacer vent 218 is shown, which also provides stiffness and strength to spacers. Spacer vents 218 allow air to flow through spacers 210, 212 and are substantially rectangular in shape, with substantially circular ends (at the narrow ends). According to an exemplary embodiment of the present invention, spacer vents 218 further include a ribbed edge that provides additional stiffness and strength to spacers 210, 212. Use of spacers 210, 212 is discussed in greater detail below.

G. Glossy Free Surfaces 278

The glossy free surfaces 278, as briefly described above, can include a plurality of micro-bumps, diamond etching, recesses, ribs, grooves, and various other types of markings, indentations and other alterations (micro-bumps) 279*a-f* of the surfaces of tray 100. Micro-bumps 279*a-f* are raised or depressed areas on various surfaces of tray 100 that can also assist in preventing commonly used stickers from adhering permanently to the surfaces of tray 100, as one of ordinary skill in the art can appreciate. These stickers can indicate, for example, the time and date of processing, the type of product, the source of the product, the plant that baked and/or packed the product, and other such information that might be necessary. Once the product is retrieved from tray 100, the stickers are no longer pertinent, and must be removed. Micro-bumps 279*a-f* make such removal much easier, because there is less surface area of tray 100 for the sticker to adhere to. Because of micro-bumps 279*a-f*, only about 30% to about 40% of the sticker surface area adheres to tray 100. On a substantially flat tray surface, however, close to about 100% of the surface area of the sticker adheres to the substantially flat tray surface.

Figure 36A:
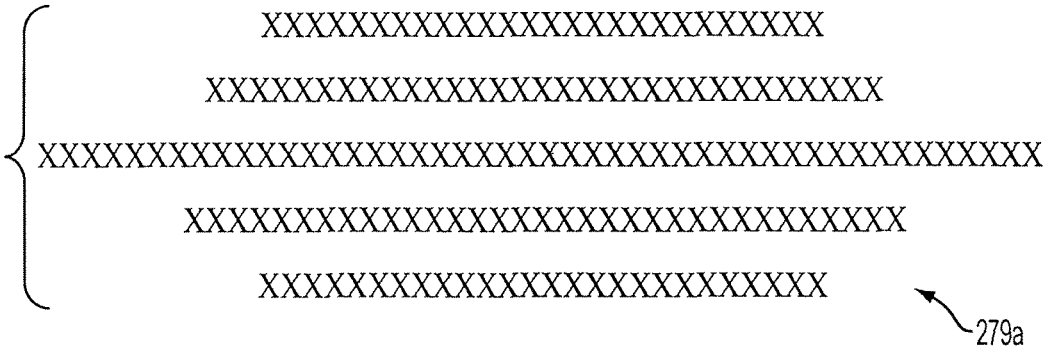
FIGS. 36A-36F illustrate a plurality of designs for micro-bumps used on the trays and spacers shown in FIGS. 1 through 35 according to an alternative embodiment of the present invention.
Figure 36B:
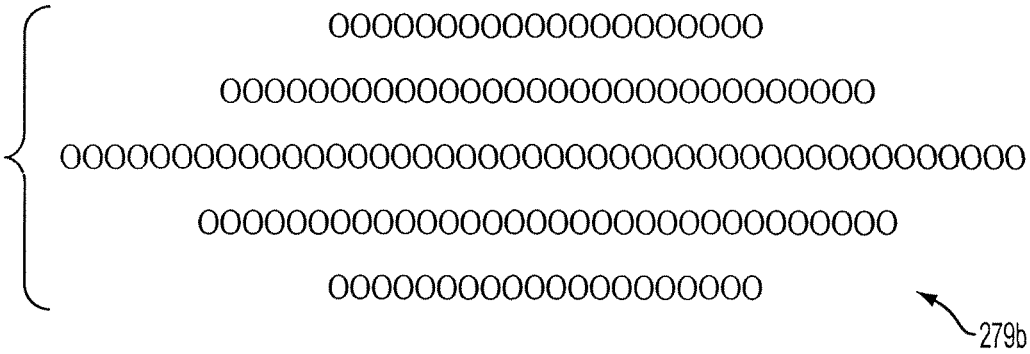
Figure 36C:
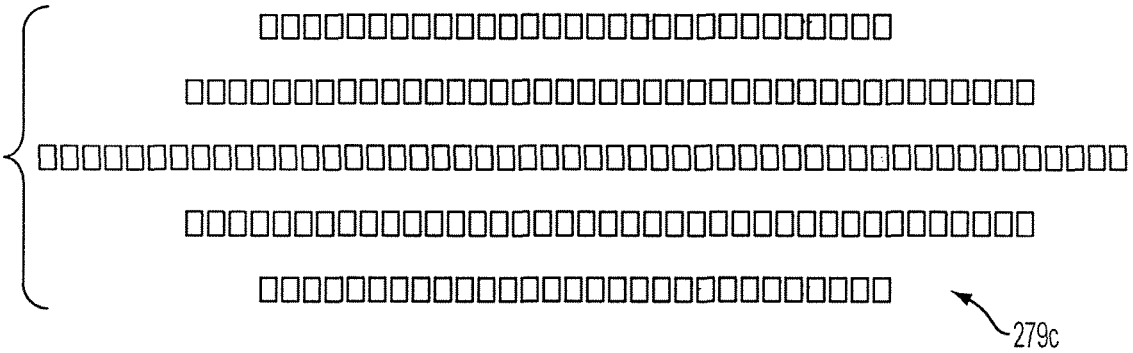
Figure 36D:
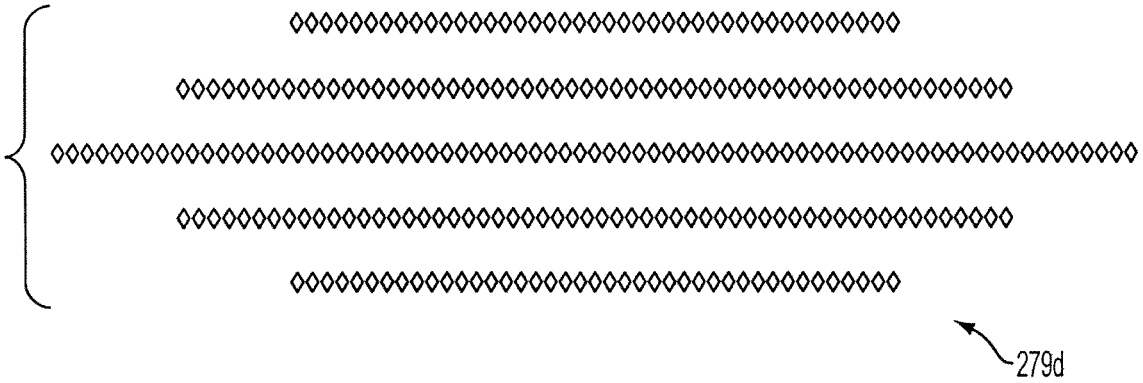
Figure 36E:
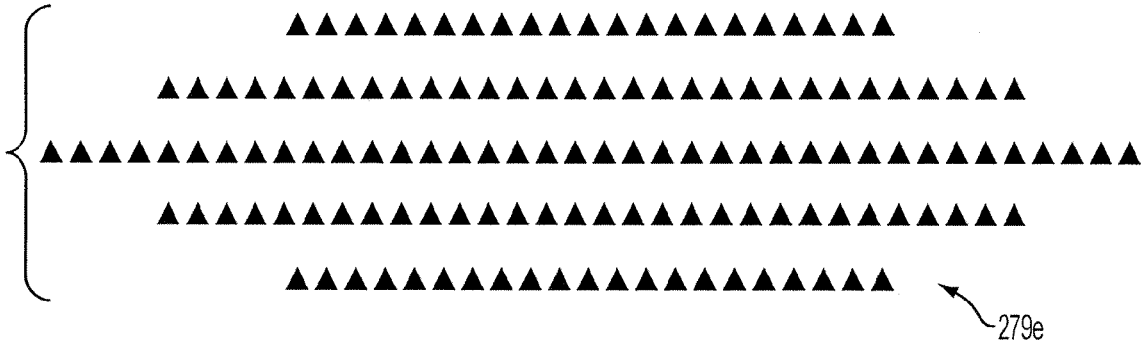
Figure 36F:
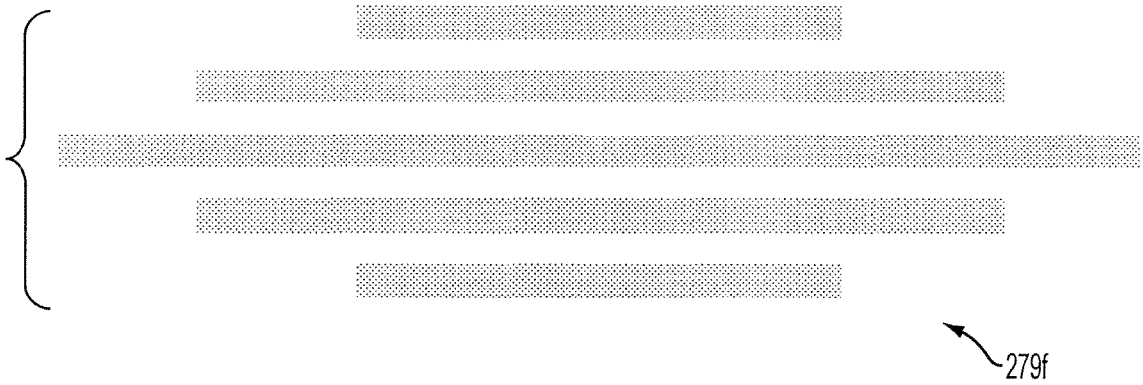

Examples of different types of micro-bumps 279*a-f* are shown in FIGS. 36A-F. Micro-bumps 279*a-f* can be in almost any imaginable shape, though, as FIGS. 36A-F illustrate, there are more common designs prevalent throughout the industry. As shown in FIG. 36A, micro-bumps 279*a* are in the form of an "X"; in FIG. 36B, micro-bumps 279*b* are in the form of and circles ○; in FIG. 36C, micro-bumps 279*c* are in the form of a box □; in FIG. 36D, micro-bumps 279*d* are in the form of a diamond ◇; in FIG. 36E, micro-bumps 279*e* are in the form of a triangle ▲; and in FIG. 36F, micro-bumps 279*f* are in the form of dots ▒. According to another embodiment of the present invention, the micro-bumps 279*a-f* can be in the shape of alternating grooves or ridges that can be curved (elliptical, circular, oval, "s" shaped, among others) or substantially straight. As those of ordinary skill in the art of the present invention can appreciate, glossy free surfaces can be located on nearly any surface portion of tray 100.

III. Stacking

A. 0° Stacking Configuration

FIG. 40 is a front isometric view of the two trays shown in FIG. 1 in a 0° stacking orientation according to an embodiment of the present invention. As shown in FIG. 40, and referring also to FIGS. 1-8, and the descriptions of each provided above, upper tray 100' is stacked upon lower tray 100 in a 0° stacking orientation. According to a preferred embodiment of the present invention, in the 0° stacking orientation, there is about 4.75" clearance between the lower surface 14' of base 2' of upper tray 100', and upper surface 12 of base 2 of lower tray 100. As those of ordinary skill in the art of the present invention can appreciate, however, the clearance between the lower surface 14' of base 2' of upper tray 100', and upper surface 12 of base 2 of lower tray 100 can be designed to be any practical value. The clearance value in the 0° stacking configuration will be determined by the type of products stored and shipped by tray 100, which, according to a preferred embodiment of the present invention, is baked goods. As discussed above, when trays 100, 100' are stacked in the 0° stacking orientation, they normally can carry the maximum amount of weight of the two stacking orientations because of the clearances between lower surface 14 of base 2' of upper tray 100', and upper surface 12 of lower tray 100. Because trays 100, 100' can carry a significant amount of weight, they have been designed to be exceptionally sturdy in all stacking orientations, but especially in the 0° stacking orientation according to a preferred embodiment of the present invention. It is for this reason that the above described features of the stacking feet and stacking receptacle have been incorporated. In the discussion below, reference shall be made only to the interface between front wall 4' of upper tray 100' and front wall 4 of lower tray 100, and the interface between right side wall 6' of upper tray 100' and right side wall 6 of lower tray 100, with the understanding, as can be appreciated by those of ordinary skill in the art of the present invention, that the interface between rear wall 8' of upper tray 100' and rear wall 8 of lower tray 100 is substantially similar to that of the front walls of upper and lower rays 100', 100, and likewise applies to the interface between left side wall 6' of upper tray 100' and left side wall 6 of lower tray 100. The discussion of the latter two sets of walls has been omitted for the purpose of brevity. The same shall apply to the discussion below of the 180° stacking orientation.

To stack upper tray 100' onto lower tray 100 in the 0° stacking orientation, the user simply places upper tray 100' tray over and then onto lower tray 100. The same operation applies for un-stacking trays, although tray retrieval tool, as discussed above, can be used whenever un-stacking is desired, especially when trays 100 are retrieved from hot water baths to clean and sterilize them.

In the 0° stacking orientation, front wall 4' of upper tray 100 is aligned with front wall 4 of lower tray 100, right side wall 6' of upper tray 100' is aligned with right side wall 6 of lower tray 100, and so on. As shown in FIGS. 3, 7, 8, and 40, and in reference to front walls 4' and 4 of the upper and lower trays 100' 100, respectively, in the 0° stacking orientation, front wall left outer stacking foot 76*a'* is received within 0° front wall left outer stacking foot receptacle 94*a*, front wall left inner stacking foot 76*b'* is received within 0° front wall left inner stacking foot receptacle 94*b*, front wall right outer stacking foot 86*a'* is received within 0° front wall right outer stacking foot receptacle 98*a*, and front wall right inner stacking foot 86*b'* is received within 0° front wall right inner stacking foot receptacle 98*b*. According to a preferred embodiment of the present invention, front wall left outer stacking foot flat portion 78*a'* rests upon a substantially horizontal flat surface formed within 0° front wall left outer stacking foot receptacle 94*a*, and front wall left outer stacking foot cross member 80*a'* fits within 0° front wall left outer stacking foot cross member receptacle 96*a* of 0° front wall left outer stacking foot receptacle 94*a*.

Figure 8:
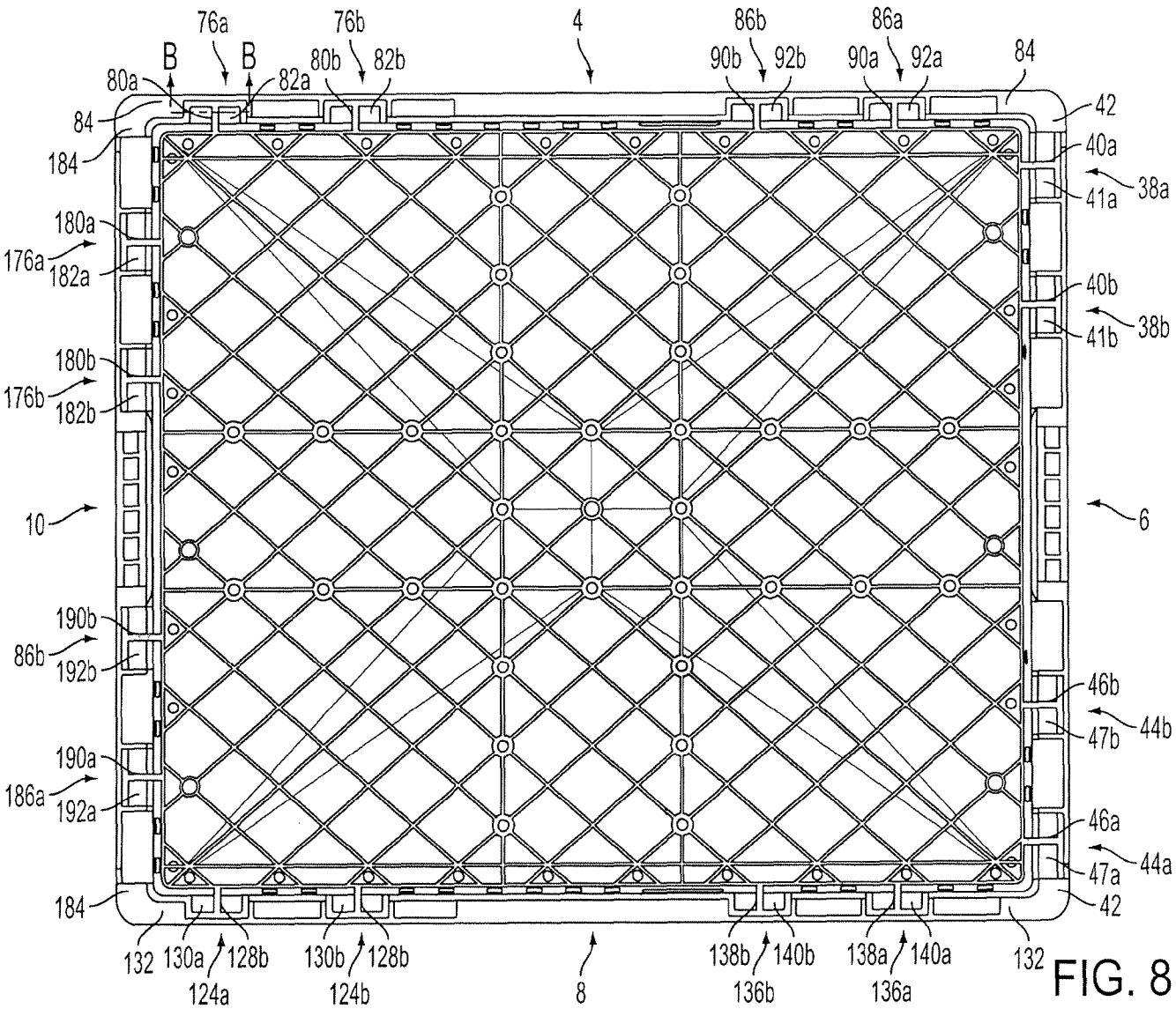
FIG. 8 is a bottom view of the tray shown in FIG. 1.
Figure 42:
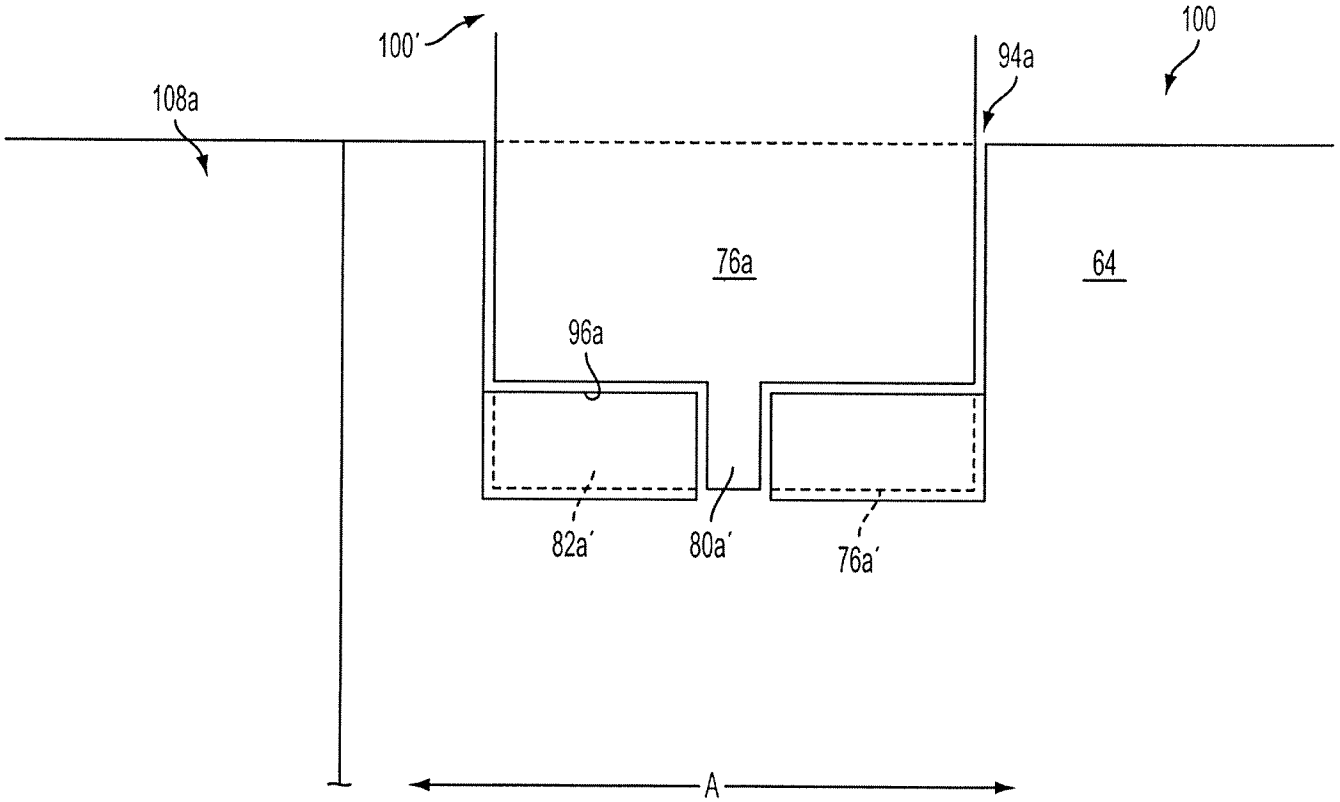
FIG. 42 is a cross sectional view along line A-A shown in FIG. 7 and line B-B shown in FIG. 8, illustrating location and interaction between a front wall left outer stacking foot cross member of a front wall left outer stacking foot of an upper tray and 0° front wall left outer stacking foot cross member receptacle of a lower tray, when the trays are stacked in a 0° stacking orientation, according to an embodiment of the present invention.

Attention is directed towards FIG. 42, which is a cross sectional view along line A-A shown in FIG. 7 and line B-B shown in FIG. 8, illustrating location and interaction between front wall left outer stacking foot cross member 80*a'* of a front wall left outer stacking foot 76*a'* of upper tray 100 and 0° front wall left outer stacking foot cross member receptacle 94*a* of lower tray 100, when trays 100', 100 are stacked in a 0° stacking orientation, according to an embodiment of the present invention. As shown in FIG. 41, according to an exemplary embodiment of the present invention, front wall left outer stacking foot 76*a'* of upper tray 100' sits within 0° front wall left outer stacking foot receptacle 94*a* of lower tray 100. Front wall left outer stacking foot 76*a'* rests upon the substantially horizontal lower portion of 0° front wall left outer stacking foot receptacle 94*a*. Front wall left outer stacking foot cross member 80*a'* fits within and interfaces with a slot in 0° front wall left outer stacking foot cross member receptacle 96*a* of lower tray 100. Those of ordinary skill in the art of the present invention can appreciate that because front wall left outer stacking foot cross member 80*a'* is restrained by the slot of 0° front wall left outer stacking foot cross member receptacle 96*a*, side-to-side motion, as represented by line A in FIG. 42, is substantially restricted. Further. because there are four such stacking feet on each wall of tray 100, for both the 0° and 180° stacking orientations, side-to-side motion is substantially restricted in all directions. Similarly, the other stacking feet components 76*b'*, 86*a'*, and 86*b'* of front wall 4' of upper tray 100' interface in a similar manner with receptacle components 94*b*, 98*a*, and 98*b*, of lower tray 100.

According to a preferred embodiment of the present invention, by locating and interfacing front wall left outer stacking foot cross member 80*a'* within 0° front wall left outer stacking foot cross member receptacle 96*a* of 0° front wall left outer stacking foot receptacle 94*a* (and having the same happen for all sixteen stacking feet and receptacles), upper tray 100' is substantially secured to lower tray 100 in the 0° stacking orientation, and side-to-side, front-wards and backwards motions are substantially reduced or eliminated according to an exemplary embodiment of the present invention. Further, greater amounts of weight can be carried by trays 100 because all the walls are substantially vertical, and substantially all the weight carried by trays 100 is substantially directly transferred to lower trays 100 and the surface upon which the lowest tray 100 is sitting upon. A substantially small portion of the weight of the tray 100 and baked goods is transferred to a horizontal component, thereby making trays 100 extremely efficient in terms of their weight carrying capacity and structure.

The front wall left outer stacking foot cross member 80*a*, as well as all the other cross members for all the other stacking feet (86*a*, 86*b*, 76*a*, 76*b*, 38*a*, 38*b*, 44*a*, 44*b*, 134*a*, 134*b*, 124*a*, 124*b*, 186*a*, 186*b*, 176*a*, and 176*b*) will retain their respective stacking foot flat portions (88*a*, 88*b*, 78*a*, 78*b*, 39*a*, 39*b*, 45*a*, 45*b*, 136*a*, 136*b*, 126*a*, 126*b*, 188*a*, 188*b*, 178*a*, 178*b*) in the event tray 100 is hit by a large object or force, and breakage about the stacking feet occurs. If the cross members were not there, then if the stacking foot flat portion was separated from the rest of the stacking foot, the trays would not be as sturdy, and would not be able to stack as much baked product, and would not function properly in the event of such breakage.

As shown in FIGS. 4, 7, 8, and 40, and in reference to right side walls 6' and 6 of the upper and lower trays 100' 100, respectively, in the 0° stacking orientation, right side wall front outer stacking foot 38*a*' is received within 0° right side wall front outer stacking foot receptacle 48*a*, right side wall front inner stacking foot 38*b*' is received within 0° right side wall front inner stacking foot receptacle 48*b*, right side wall rear outer stacking foot 44*a*' is received within 0° right side wall rear outer stacking foot receptacle 52*a*, and right side wall rear inner stacking foot 44*b*' is received within 0° right side wall rear inner stacking foot receptacle 52*b*. Right side wall front outer stacking foot flat portion 39*a*' of right side wall front outer stacking foot 38*a*' rests upon a substantially horizontal flat surface formed within 0° right side wall front outer stacking foot receptacle 48*a*, and right side wall front outer stacking foot cross member 40*a*' fits within 0° right side wall front outer stacking foot cross member receptacle 50*a* of 0° right side wall front outer stacking foot receptacle 48*a*. Similarly, the other stacking feet components 38*b*', 44*a*', and 44*b*' of right side wall 6' of upper tray 100' interface in a similar manner with receptacle components 60*b*, 52*a*, and 52*b*, of lower tray 100.

According to a preferred embodiment of the present invention, by locating and interfacing right side wall front outer stacking foot cross member 40*a*' within 0° right side wall front outer stacking foot cross member receptacle 50*a* of 0° front side wall front outer stacking foot receptacle 48*a*, upper tray 100' is substantially secured to lower tray 100 in the 0° stacking orientation, and side-to-side, front-wards and backwards motions are substantially reduced or eliminated according to an exemplary embodiment of the present invention.

As discussed above, the stacking feet 124*a, b*' and 134*a, b*' of rear wall 8' of upper tray 100' interface with the 0° stacking receptacle 142*a, b* and 146*a, b* of lower tray 100 in a similar manner as above with respect to front wall 4' of upper tray 100' and front wall 4 of lower tray 100. Furthermore, the stacking feet 176*a, b*' and 186*a, b*' of left side wall 10' of upper tray 100' interface with the 0° stacking receptacle 198*a, b* and 202*a, b* of left side wall 10 of lower tray 100 as described above with respect to right side wall 6' of upper tray 100' and right side wall 6 of lower tray 100.

B. 180° Stacking

FIG. 41 is a front isometric view of the two trays shown in FIG. 1 in a 180° stacking orientation according to an embodiment of the present invention. As shown in FIG. 41, and referring also to FIGS. 1-8, and the description of each above, upper tray 100' is stacked upon lower tray 100 in a 180° stacking orientation. According to a preferred embodiment of the present invention, in the 180° stacking orientation, there is about 3.25" clearance between the lower surface 14' of base 2' of upper tray 100, and upper surface 12 of base 2 of lower tray 100. As those of ordinary skill in the art of the present invention can appreciate, however, the clearance between the lower surface 14' of base 2' of upper tray 100', and upper surface 12 of base 2 of lower tray 100 can be designed to be any practical value. The clearance value in the 180° stacking configuration will be determined by the type of products stored and shipped by tray 100, which, according to a preferred embodiment of the present invention, is baked goods. As discussed above, trays 100, 100', when stacked in the 180° stacking orientation, can still carry a significant amount of weight. In the discussion below, reference shall be made only to the interface between front wall 4' of upper tray 100' and rear wall 8 of lower tray 100, and the interface between right side wall 6' of upper tray 100' and left side wall 10 of lower tray 100, with the understanding, as can be appreciated by those of ordinary skill in the art of the present invention, that the interfaces between rear wall 8' of upper tray 100' and front wall 4 of lower tray 100 is substantially similar to that of the front wall 4' and rear wall 8 of upper and lower rays 100', 100, and likewise applies to the interface between left side wall 10' of upper tray 100' and right side wall 6 of lower tray 100. The discussion of the latter two sets of walls has been omitted for the purpose of brevity.

To stack upper tray 100' onto lower tray 100 in the 180° stacking orientation, the user simply places upper tray 100' tray over and then onto lower tray 100. The same operation applies for un-stacking trays, although tray retrieval tool 276, as discussed above, can be used whenever un-stacking is desired, especially when trays 100 are retrieved from hot water baths to clean and sterilize them.

In the 180° stacking orientation, as shown in FIG. 41, and in reference to FIGS. 3, 5, 7, and 8, front wall 4' of upper tray 100 is aligned with rear wall 8 of lower tray 100, right side wall 6' of upper tray 100' is aligned with left side wall 10 of lower tray 100, and so on. In the 180° stacking orientation, front wall left outer stacking foot 76*a*' is received within 180° rear wall right outer stacking foot receptacle 150*a*, front wall left inner stacking foot 76*b*' is received within 180° rear wall right inner stacking foot receptacle 150*b*, front wall right outer stacking foot 86*a*' is received within 180° rear wall left outer stacking foot receptacle 154*a*, and front wall right inner stacking foot 86*b*' is received within 180° rear wall left inner stacking foot receptacle 154*b*. Front wall left outer stacking foot flat portion 78*a*' of front wall left outer stacking foot 76*a*' rests upon a substantially horizontal flat surface formed within 180° rear wall right outer stacking foot receptacle 150*a*, and front wall left outer stacking foot cross member 80*a*' fits within 180° rear wall right outer stacking foot cross member receptacle 152*a* of 180° rear wall right outer stacking foot receptacle 150*a*.

Those of ordinary skill in the art of the present invention can appreciate that because of the similarities between the 0° and 180° stacking receptacles, a detailed description of the interface between the stacking feet and the 180° stacking receptacles is not necessary, and has been omitted for the purpose of brevity. The illustration shown in FIG. 42 applies equally well for the corresponding components in the 180° stacking orientation. Certain dimensions are different as well. The interface and functioning of the stacking and receptacle components in the 180° stacking orientation is substantially identical to the interface and functioning of the stacking and receptacle components in the 0° stacking orientation according to an exemplary embodiment of the present invention.

By fitting front wall left outer stacking foot cross member 80*a*' within 180° rear wall right outer stacking foot cross member receptacle 152*a* of 180° rear wall right outer stacking foot receptacle 150*a* (and having the same happen for all sixteen stacking feet and corresponding 180° stacking receptacle), upper tray 100' is substantially secured to lower tray 100, and side-to-side, front-wards and backwards motions are substantially reduced or eliminated.

In the 180° stacking orientation as shown in FIG. 41, and referring again to FIGS. 4, 6, 7, and 8, right side wall front outer stacking foot 38*a*' is received within 180° left side wall rear outer stacking foot receptacle 206*a*, right side wall front inner stacking foot 38*b*' is received within 180° left side wall rear inner stacking foot receptacle 206*b*, right side wall rear outer stacking foot 44*a*' is received within 180° left side wall front outer stacking foot receptacle 202*a*, and right side wall rear inner stacking foot 44*b*' is received within 180° left side wall front inner stacking foot receptacle 202*b*. Right side wall front outer stacking foot flat portion 39*a*' of right side wall front outer stacking foot 38*a*' rests upon a substantially horizontal flat surface formed within 180° left side wall rear outer stacking foot receptacle 206*a*, and right side wall front outer stacking foot cross member 40*a*' fits within 180° left side wall rear outer stacking foot cross member receptacle 208*a* of 180° left side wall rear outer stacking foot receptacle 206*a*.

Similarly, the same components of the other stacking feet for right side wall 6' interface with the corresponding components for left side wall 10, as does the stacking feet and stacking feet receptacles for rear wall 8' and front wall 4, and left side wall 10' and right side wall 6. Further more, right side wall 180° stacking ledge 42 rests upon left side wall top surface 162, rear wall stacking 180° ledge 132 rests upon front wall top surface 70, left side wall stacking 180° ledge 184 rests upon right side top surface 24, and front wall stacking 180° ledge 84 rests upon rear wall top surface 118.

IV. Use of Spacers

In use, spacers 210, 212 are simply inserted in either or both sided of tray 100, with spacer product side 226 facing an interior portion of tray 100. One or two spacers 210, 212 can be used according to a preferred embodiment of the invention. According to alternative embodiments of the present invention, spacers 210, 212 can be provide for front wall 4 and rear wall 8, and along a plurality of lines formed by spacer holes. For example, a series of spacer holes can be formed on or about a centerline of tray 100 extending from front wall 4 to rear wall 8 effectively cutting the storage space of tray 100 by about one-half. Although not shown in the accompanying drawings, those of ordinary skill in the art can appreciate that three, for or even more spacers can be used in a single tray 100, with a multitude of spacer hole configurations to allow storage and transport of many different types of products in tray 100, all of which are considered to be within the scope of the present invention.

V. Draining Water

Figure 37:
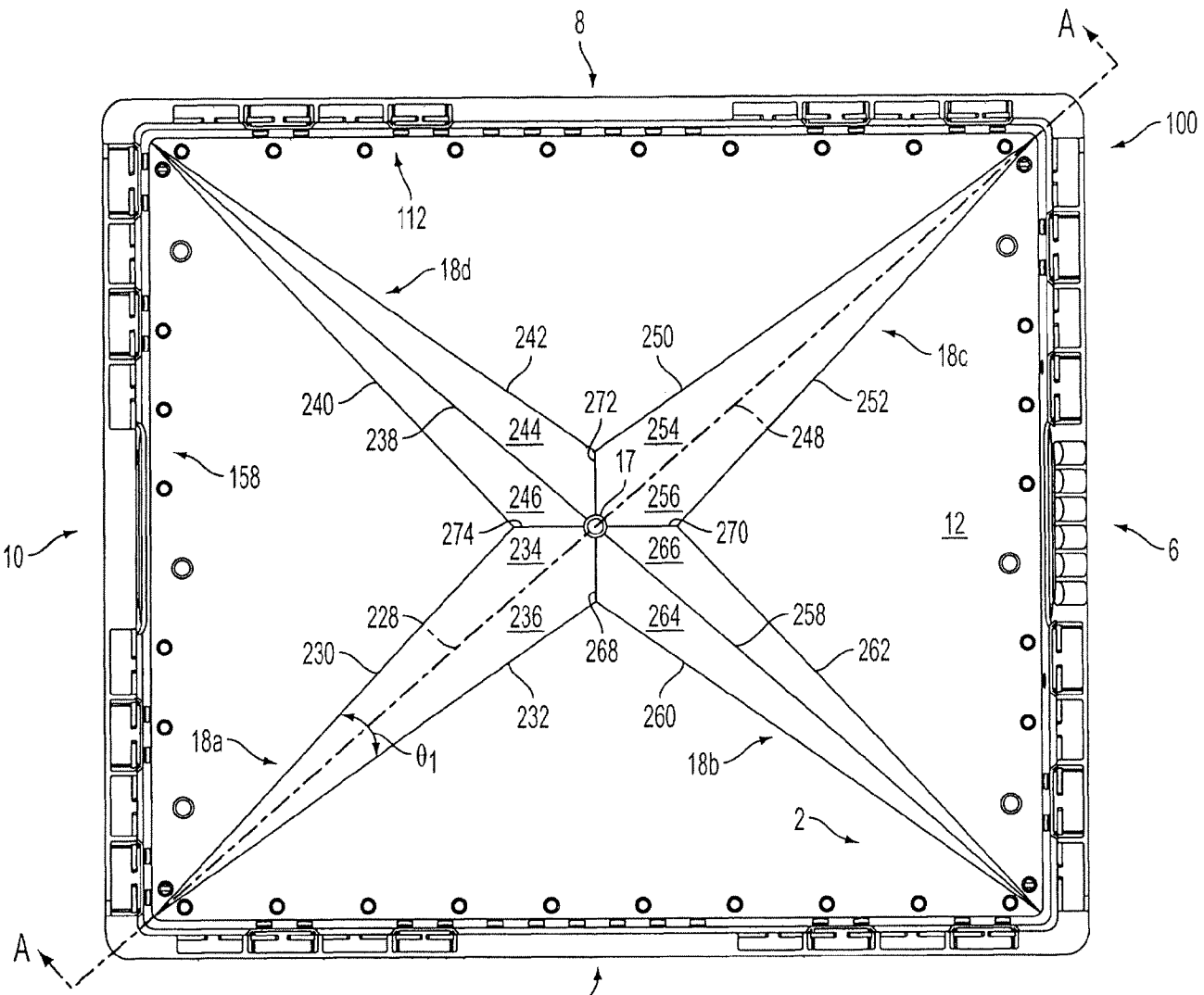
FIG. 37 is a top view of the tray shown in FIG. 1 with sectional line A-A.

Referring to FIGS. 1, 2, 7, 37, and 38, draining of water via drain channels 18*a-d* will be discussed. According to a preferred embodiment of the present invention, tray 100 comprises four drain channels 18*a-d* as shown in FIG. 37. As those of ordinary skill in the art of the present invention can appreciate, however, tray 100 need not be exclusively limited to four drain channels, as more or less drain channels 18 can be accommodated within base 2. As shown in FIG. 37, first drain channel 18*a* includes a centerline 228, a first upper surface 230, a second upper surface 232, a first sloped surface 234 and a second sloped surface 236. Drain channels 18*b-d* are similarly fabricated. Separating first drain channel 18*a* from second drain channel 18*b* is first drain interface surface 268; separating second drain channel 18*b* from third drain channel 18*c* is second drain interface surface 270; separating third drain channel 18*c* from fourth drain channel 18*d* is third drain interface surface 272; and separating fourth drain channel 18*d* from first drain channel 18*a* is fourth drain interface surface 274.

Figure 38:
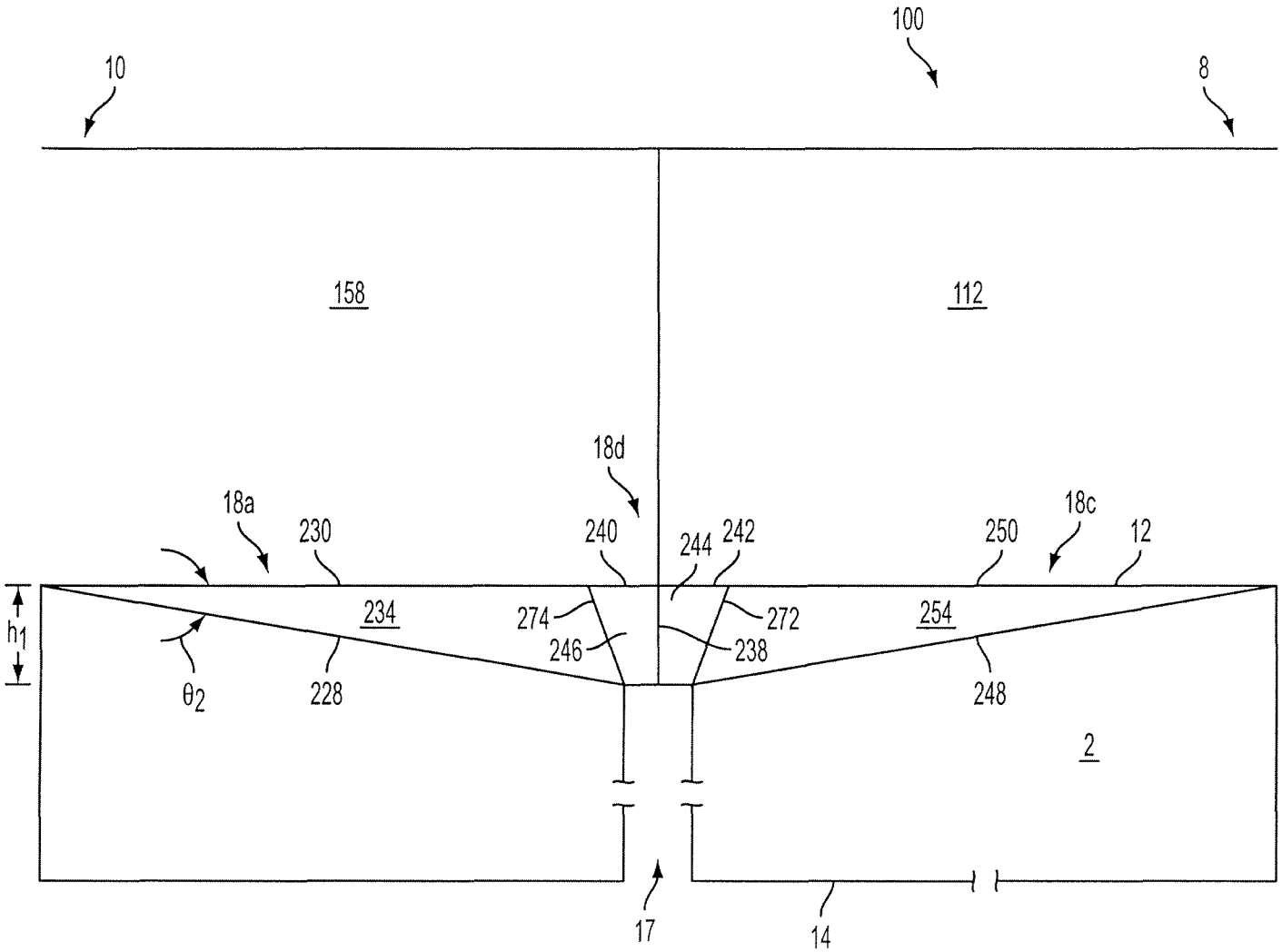
FIG. 38 is a cross sectional view of the trays shown in FIGS. 1 and 37 along sectional line A-A as shown in FIG. 37.

According to preferred embodiment of the present invention, each drain channel 18*a-d* is substantially similar in dimensions, and are substantially equally angularly spaced about upper surface 12 of base 2 (in a star shaped pattern), although this need not be the case, as those of ordinary skill in the art can appreciate. According to an exemplary embodiment of the present invention, spread angle $\theta_1$, as shown in FIG. 37, is the spread angle of each of the drain channels 18*a-d*, and can range from about 13.5° to about 15.5°. According to a preferred embodiment of the present invention, angle $\theta_1$ is about 14.6°. Referring to FIG. 38, which is a cross section view of base 2 of tray 100 along sectional line A-A shown in FIG. 37, drain angle $\theta_2$ ranges between about 0.10° and about 0.40Y°. According to a preferred embodiment of the present invention, drain angle $\theta_2$ is about 0.25°. According to a preferred embodiment of the present invention, each drain channel has a drain angle that is substantially similar. Height $h_1$, which shows the maximum depth of drain channels 18*a-d* at center drain hole 17, ranges between about 0.050" to about 0.070", and according to a preferred embodiment of the present invention, height $h_1$ is about 0.060". Further, as shown in FIGS. 37 and 38, lines 268, 270, 272, 274 also are formed at an angle from upper surface 12 of base 2, to center hole 17. This angle, $\theta_3$, is between about 1° and 3°, and according to a preferred embodiment of the present invention, $\theta_3$ is about 1.5°.

Following use (i.e., storage and transporting of baked product), trays 100 are washed in a high temperature, high pressure washer. Even though the plastic that trays 100 are made from naturally beads water, it is still advantageous to have the water left over from the washing process removed from trays 100 as quickly as possible. Drain channels 18*a-d* facilitate the water removal process by channeling water contained in the substantially flat, sold base 2 to center drain hole 17, whereby the water can be removed from trays 100. While drain channels 18*a-d* function effectively to drain water from trays 100, they must substantially eliminate or reduce the possibility of marking baked product after it is baked and placed in trays 100. Because drain channels are made with such slight angles, they effectively reduce or eliminate the possibility of marking the baked product, especially tortillas.

VI. Tray 300

An alternative embodiment of tray 100 is shown in FIGS. 9-25. Tray 300, is shown and discussed in reference to FIGS. 9-25, is substantially similar in design and functionality as tray 100, and so a detailed description of tray 300 will not be provided, for the purpose of brevity. Tray 300 does not include front wall hook area 68 nor rear wall hook area 116. Otherwise, tray 300 retains substantially similar stacking features in both the 0° and 180° stacking orientations, water draining capabilities via drain channels 18*a-d*, scalloped surface 28, and right side wall handle 34 and left side wall handle 172. Further, tray 300 can utilize spacers 210, 212, as discussed above in regard to tray 100.

The present invention has been described with reference to certain exemplary embodiments thereof. However, it will be readily apparent to those skilled in the art that it is possible to embody the invention in specific forms other than those of the exemplary embodiments described above. This may be done without departing from the spirit and scope of the invention. The exemplary embodiments are merely illustrative and should not be considered restrictive in any way. The scope of the invention is defined by the appended claims and their equivalents, rather than by the preceding description.

All United States patents and applications, foreign patents, and publications discussed above are hereby incorporated herein by reference in their entireties.

What is claimed is:

1. A tray for transporting baked products, comprising:

a base having an upper surface and a lower surface, the lower surface including a plurality of ribs, a front wall, a right side wall, a rear wall, and a left side wall, wherein the front wall and rear wall are substantially parallel to each other, the front wall and rear wall are each substantially perpendicular to the left side wall and right side wall, the left and right side walls are substantially parallel to each other, and each of the front wall, right side wall, rear wall, and left side walls are all substantially perpendicular to the base;

a plurality of outer drain holes in the base positioned proximate the front wall, rear wall, and left and right side walls and a center drain hole located substantially centrally on the base; and a plurality of drain channels located on an upper surface of the base, wherein each of the drain channels slopes downward from a respective wall towards the center drain hole, and wherein the drain channels are configured to drain fluid out of the tray.

2. The tray for transporting baked products according to claim 1, wherein the plurality of drain channels comprises four drain channels, each of the four drain channels originating at a drain channel originating point located at a corner of the tray.

3. The tray for transporting baked products according to claim 2, wherein a width of each of the four drain channels increases from the drain channel originating point to the center drain hole.

4. The tray for transporting baked products according to claim 2, wherein each of the four drain channels comprises:

a first sloped surface;

a second sloped surface; and a centerline formed at an intersection between the first sloped surface and the second sloped surface.

5. The tray for transporting baked products according to claim 4, wherein the centerline is formed at a first angle with respect to a substantially horizontal and substantially planar upper surface of the base.

6. The tray for transporting baked products according to claim 5, wherein the first angle is between about 0.10° and about 0.40°.

7. The tray for transporting baked products according to claim 5, wherein the first angle is about 0.25°.

8. The tray for transporting baked products according to claim 4, wherein each of the four drain channels further comprises:

a first upper surface located at a junction between the upper surface of the base and the first sloped surface;

a second upper surface located at a junction between the upper surface of the base and the second sloped surface; and a spread angle that is formed between the first and second upper surfaces.

9. The tray for transporting baked products according to claim 8, wherein the spread angle is between about 13.5° and about 15.5°.

10. The tray for transporting baked products according to claim 8, wherein the spread angle is about 14.6°.

11. The tray for transporting baked products according to claim 2, wherein each of the four drain channels comprises a range in depth from substantially no depth at the drain hole originating point to a first depth at the center drain hole.

12. The tray for transporting baked products according to claim 11, wherein the first depth is between about 0.50 inches and about 0.70 inches.

13. The tray for transporting baked products according to claim 11, wherein the first depth is about 0.60 inches.

14. The tray for transporting baked products according to claim 2, wherein each of the four drain channels terminates at a drain channel terminating portion located at a central portion of the base adjacent to two other drain channels.

15. The tray for transporting baked products according to claim 14, wherein each drain channel terminating portion comprises:

a drain interface surface shared by two adjacent drain channels, wherein each of the drain interface surfaces originates from an upper surface of the base of the tray, and wherein each of the drain interface surfaces terminates at the center drain hole, whereby, each of the drain interface surfaces is formed at a drain interface angle with respect to the upper surface of the base.

16. The tray for transporting baked products according to claim 15, wherein the drain interface angle is between about 1° and about 3°.

17. The tray for transporting baked products according to claim 15, wherein the drain interface angle is about 1.5°.

18. The tray for transporting baked products according to claim 1, wherein the upper surface of the base is substantially smooth and even, and further wherein each of the plurality of drain channels is configured to substantially prevent marking of any baked products stored in the tray.

19. The tray for transporting baked products according to claim 1, further comprising:

a first handle, wherein the first handle is substantially centrally located on one of the left side wall and the right side wall, and includes an open portion, wherein the open portion includes a first open portion part that is substantially rectangular, and wherein a long side of the first open portion part is substantially parallel to an upper surface of the side wall and to the base, and further wherein the open portion includes a second open portion part, adjacent to the first open portion part, wherein the second open portion part is substantially rectangular and wherein a long side of the second open portion part is substantially parallel to the upper surface of the side wall and to the base, and wherein the first handle farther includes an inner flat portion located above the first open portion and on an inner surface of the side wall where the first handle is located, and an outer flat portion that is located above the first open portion and on an outer surface of the side wall where the first handle is located, and a scalloped portion located on an upper portion of the side wall where the first handle is located, the scalloped portion including a plurality of scallops, each of the scallops extending from the inner surface of the side wall up to and including the upper surface of the side wall, and further wherein the first handle enables a user to grip the tray and identify an orientation of the tray.

20. The tray for transporting baked products according to claim 19, further comprising:

a second handle, wherein the second handle is substantially centrally located on one of the left side wall and the right side wall, and includes an open portion, wherein the open portion includes a first open portion part that is substantially rectangular, and wherein a long side of the first open portion part is substantially parallel to an upper surface of the side wall and to the base, and a second open portion part, adjacent to the first open portion part, wherein the second open portion part is substantially rectangular and wherein a long side of the second open portion part is substantially parallel to the upper surface of the side wall and to the base, and wherein the second handle further includes an inner flat portion located above the first open portion and on an inner surface of the side wall where the second handle is located, an outer flat portion located above the first open portion and on an outer surface of the side wall where the second handle is located, and wherein on both of the first and second handles, the second open portion part is longer than the first open portion part, and is thereby configured to provide an opening for a tray retrieving tool such that the tray retrieving tool can retrieve the tray from a storage location.

21. A tray for transporting baked products, comprising:

a base, a front wall, a right side wall, a rear wall, and a left side wall, wherein the front wall and rear wall are substantially parallel to each other, the front wall and rear wall are each substantially perpendicular to the left side wall and right side wall, the left and right side walls are substantially parallel to each other, and further wherein, each of the front wall, right side wall, rear wall, and left side walls are all substantially perpendicular to the base; and a first handle, wherein the first handle is substantially centrally located on one of the left side wall and the right side wall, and includes an open portion, wherein the open portion includes a first open portion part that is substantially rectangular, and wherein a long side of the first open portion part is substantially parallel to an upper surface of the side wall and to the base, and a second open portion part, adjacent to the first open portion part, wherein the second open portion part is substantially rectangular and wherein a long side of the second open portion part is substantially parallel to the upper surface of the side wall and to the base, and wherein the first handle further includes an inner flat portion located above the first open portion and on an inner surface of the side wall where the first handle is located, an outer flat portion that is located above the first open portion and on an outer surface of the side wall where the first handle is located, and a scalloped portion located on an upper portion of the side wall where the first handle is located, the scalloped portion including a plurality of scallops, each of the scallops extending from the inner surface of the side wall up to and including the upper surface of the side wall, and a second handle having a smooth non-scalloped surface extending to a smooth non-scalloped upper surface of the side wall, and further wherein the plurality of scallops on the first handle enables a user to grip the tray and identify an orientation of the tray.

22. The tray for transporting baked products according to claim 21, wherein the second open portion part is longer than the first open portion, and wherein the second open portion part is configured to provide an opening for a tray retrieving tool such that the tray retrieving tool can retrieve the tray from a storage location.

23. The tray for transporting baked products according to claim 22, further comprising:

the second handle including a first open portion part, and a second open portion part, and wherein the first open portion part of the second handle is substantially similar to the first open portion part of the first handle, and further wherein, the second open portion part of the second handle is substantially similar to the second open portion part of the first handle.

24. The tray for transporting baked products according to claim 21, further comprising:

a plurality of drain holes, including a center drain hole located substantially centrally on the base of the tray; and a plurality of drain channels located on an upper surface of the base, wherein each of the drain channels slopes downward from a respective wall towards the center drain hole, and wherein the drain channels are configured to drain fluid out of the tray.

25. The tray for transporting baked products according to claim 21, further comprising:

a plurality of spacers, wherein each of the plurality of the spacers include a plurality of plugs on a bottom surface of the spacer, and wherein each of the plurality of plugs fits within a corresponding spacer plug receptacle on the base of the tray, such that the spacer is removably attached to the base of the tray at a predetermined distance from each the left side wall and the right side wall, and further wherein the spacers are configured to change an internal storage dimension of the tray, such that a plurality of baked products can be stored and/or transported in the tray without significant damage to any of the plurality of baked products.

* * * * *